US007223528B2

(12) United States Patent
Yamamoto et al.

(10) Patent No.: US 7,223,528 B2
(45) Date of Patent: May 29, 2007

(54) PHOTOTHERMOGRAPHIC MATERIAL AND IMAGE FORMING METHOD

(75) Inventors: Seiichi Yamamoto, Kanagawa (JP); Masaharu Sugai, Shizuoka-ken (JP); Rikio Inoue, Kanagawa (JP)

(73) Assignee: Fujifilm Corporation, Tokyo (JP)

( * ) Notice: Subject to any disclaimer, the term of this patent is extended or adjusted under 35 U.S.C. 154(b) by 22 days.

(21) Appl. No.: 11/023,670

(22) Filed: Dec. 29, 2004

(65) Prior Publication Data

US 2005/0208438 A1 Sep. 22, 2005

(30) Foreign Application Priority Data

Mar. 22, 2004 (JP) ..... 2004-083697
Oct. 29, 2004 (JP) ..... 2004-316846

(51) Int. Cl.
*G03C 5/16* (2006.01)
*G03C 1/498* (2006.01)
*G03C 1/76* (2006.01)

(52) U.S. Cl. ..... 430/350; 430/513; 430/516; 430/517; 430/519; 430/522; 430/523; 430/554; 430/558; 430/561; 430/563; 430/619

(58) Field of Classification Search ..... 430/513, 430/516, 517, 522, 519, 523, 561, 563, 554, 430/558, 350, 619
See application file for complete search history.

(56) References Cited

U.S. PATENT DOCUMENTS 4,483,914 A * 11/1984 Naito et al. ..... 430/203
5,998,126 A 12/1999 Toya et al.
2004/0234909 A1* 11/2004 Inoue et al. ..... 430/617

FOREIGN PATENT DOCUMENTS

JP 9-311403 12/1997
JP 2000-039685 2/2000

* cited by examiner

*Primary Examiner*—Thorl Chea
(74) *Attorney, Agent, or Firm*—Margaret A. Burke; Sheldon J. Moss

(57) ABSTRACT

The present invention provides a photothermographic material having, on at least one side of a support, at least an image forming layer containing a photosensitive silver halide, a non-photosensitive organic silver salt, and a reducing agent for the organic silver salt, and at least one non-photosensitive layer, wherein the material contains a water-soluble magenta dye, and also provides an image forming method.

28 Claims, No Drawings

PHOTOTHERMOGRAPHIC MATERIAL AND IMAGE FORMING METHOD

CROSS-REFERENCE TO RELATED APPLICATIONS

This application claims priority under 35 USC 119 from Japanese Patent Application Nos. 2004-083697 and 2004-316846, the disclosures of which are incorporated by reference herein.

BACKGROUND OF THE INVENTION

1. Field of the Invention

The present invention relates to a photothermographic material and an image forming method. More specifically, the invention relates to a photothermographic material and an image forming method which produce excellent image quality with a good degree of sharpness and little residual color.

2. Description of the Related Art

There has been a strong demand recently in the medical imaging field and the graphic arts field for a dry photographic process made with consideration for environmental conservation and economy of space. Further, the development of digitization in these fields has resulted in the rapid development of systems in which image information is accepted by and stored in a computer, and when needed the image information is processed and sent to a desired location, where the image information is output onto a photosensitive material using a laser image setter or a laser imager, followed by development thereof to form instantly an image on the photosensitive material. It is a requirement that the photosensitive material be able to have an image recorded by exposure to a high-intensity laser and that a clear black-tone image with high resolution and sharpness can be formed. While various kinds of hard copy systems using pigment or dye such as ink-jet printers or electrophotographic systems have available using this kind of digital imaging recording material, images in the digital imaging recording material obtained by these systems are insufficient in terms of the image quality and recording speed required for medical-purpose images. To enable medical diagnosis, aspects of image quality such as sharpness, granularity, gradation, and tone as well as high recording speed (sensitivity) are required. However, digital imaging recording materials such as those described above have not reached a level at which they can replace medical-use silver halide film processed with conventional wet development.

Photothermographic materials utilizing organic silver salts are already known in the field. These materials have an image forming layer that includes a reducible silver salt (for example, an organic silver salt), a photosensitive silver halide, and, if needed, a toner for controlling the color tone of silver, these being dispersed in a binder.

After exposure imagewise, a photothermographic material forms a black silver image when heated to a high temperature (for example, 80° C. or higher) to cause an oxidation-reduction reaction between a silver halide or a reducible silver salt (functioning as an oxidizing agent) and a reducing agent. The oxidation-reduction reaction is accelerated by the catalytic action of a latent image on the silver halide generated by imagewise exposure. As a result, a black silver image is formed in an exposed region of the material. Much literature is available describing photothermographic materials, with the Fuji Medical Dry Imager FM-DP L being a practical example of a marketed medical image forming system which uses a photothermographic material.

To attain images with a good degree of sharpness, it is important to incorporate dyes in photosensitive materials undergoing imagewise exposure with a laser beam that provide sufficient antihalation and anti-irradiation effects for the wavelength region of the exposure. A wide range of wavelength regions such as near infrared, infrared, or visible regions from red to blue can be applied as for the wavelength of a laser beam used for the exposure.

For photosensitive materials exposed with either a near infrared or infrared laser beam, the dyes which have an absorption maximum within the near infrared or infrared regions outside of luminous efficiency, have a narrow half band width, and have little light absorption within the visible regions are effectively applied. Japanese Patent Application Laid-Open (JP-A) Nos. 9-146220 and 11-228698 disclose photosensitive materials comprising such dyes, which require substantially no color bleaching mechanism.

However, infrared sensitized photosensitive materials are sensitive to low-energy light and therefore there is concern of their becoming sensitized thermally depending on environmental conditions, for example, under a high temperature condition. Therefore, photosensitive material has been proposed for imagewise exposure with a laser beam having a wavelength within the visible blue to red regions of the spectrum, these colors having higher energy. For the antihalation dyes used in this kind of photothermographic material, the inclusion of some sort of color bleaching reaction mechanism had been desired. As an example of a method for decoloring dyes by way of heating during a thermal development process, U.S. Pat. No. 5,135,842 discloses a method of decoloring polymethine dyes of a specific structure by heating. U.S. Pat. Nos. 5,314,795, 5,324,627, and 5,384,237 also disclose methods where polymethine dyes are decolorized by heating using a carbanion generating agent.

However, the color bleaching mechanisms described above often led to problems such as incomplete decoloring of the dyes, or dye decolorization occurring during storage of the photothermographic material due to insufficient dye stability occurring after the bleaching ability has been enhanced. Moreover, when the polymethine dyes are used, the decomposition products of dyes which remain after the decoloring process have a small amount of light absorption, with residual color in the image (especially in the highlight portion) posing a problem. Especially with image recording materials used in medical diagnosis, image tone is an important factor affecting the ability to carry out diagnosis, and thus more improvements in image tone are required. Furthermore, demand has increased recently for image forming methods used for processing photothermographic materials with a higher speed within a short time. For medical use especially, there is a strong demand for rapid image forming processing so as to swift diagnosis possible.

Also, JP-A Nos. 2000-39685 and 9-311403 disclose the use of magenta dye in order to adjust image tone. Conventionally, with regard to dyes used for adjusting the image tone of the photosensitive silver halide materials processed with wet development processing, oil-soluble dyes such as described in JP-A No. 4-247449 are generally used to prevent their dissolution into the processing solution during the wet developing process. The oil-soluble dyes are added in the form of a solution dissolved in an organic solvent, a solid dispersion, or an emulsified dispersion.

SUMMARY OF THE INVENTION

A first aspect of the invention is to provide a photothermographic material having, on at least one side of a support, an image forming layer comprising at least a photosensitive silver halide, a non-photosensitive organic silver salt, and a reducing agent for the organic silver salt, and at least one non-photosensitive layer, wherein the photothermographic material contains a water-soluble magenta dye.

A second aspect of the invention is to provide an image forming method comprising: exposing imagewise a photothermographic material which has, on at least one side of a support, an image forming layer comprising at least a photosensitive silver halide, a non-photosensitive organic silver salt, and a reducing agent for the organic silver salt, and at least one non-photosensitive layer, and which contains a water-soluble magenta dye having a hue angle of 280° to 360° or 0° to 60°; and thermally developing the photothermographic material by heating for a period of from 1 second to 14 seconds.

DETAILED DESCRIPTION OF THE INVENTION

The present invention provides a photothermographic material and an image forming method which produce excellent image quality and a preferable image tone. In particular, the present invention provides a photothermographic material and an image forming method which are suitable for rapid processing.

The inclusion of dyes in photothermographic materials may present problems such as discoloration of images and loss of surface gloss caused by crystallization of the reaction products on the surface of the material, taking the form of a powdery deposit, which often occur during storage after a thermal developing process. These are problems inherent in photothermographic materials.

The inventors found that the use of water-soluble magenta dyes having a specific hue angle is effective in solving the problems described above, and thereby arrived at the present invention. Further, the above problems are greater when a rapid thermal developing process applied to a photothermographic material is carried out in 14 seconds or less. The image forming method of the present invention is devised to provide an effective means for solving the above problems.

The present invention provides a photothermographic material and an image forming method that produce images with high quality and a preferable image tone.

The present invention is explained below in detail.

(Water-soluble Magenta Dye)

The water-soluble magenta dye used for the present invention is the compound that has at least one water-soluble group in the molecule. The preferred water-soluble group can be selected from a carboxyl group, a sulfo group, a phosphate group, a group containing a quaternary salt structure of nitrogen atom, and a group having an ethyleneoxy group as a repeating unit. In the case where a carboxyl group, a sulfo group, or a phosphate group is selected, the compound may have a counter cation if necessary. As the counter cation, a cation selected from an alkali metal ion, an alkaline earth metal ion, a group containing a quaternary salt structure of nitrogen atom, and a group containing a quaternary salt structure of phosphorus atom is used.

The water-soluble magenta dyes according to the present invention are readily soluble in water, and the aqueous solution of dyes is colored in reddish. The reddish color of the dye solution includes the colors such as red, red violet, violet, blue violet, pink and orange.

The rapid processing of the photothermographic material containing no water-soluble magenta dyes of the present invention often result in deteriorating the residual color from cyan to bluish. On the contrary, the incorporation of the said magenta dyes in the photothermographic material can decrease the residual color thereof.

<Hue Angle>

The hue angle of the water-soluble magenta dye used for the present invention is the value measured as follows. The photothermographic material using the dyes, where colored products other than the dye were removed, is formed and then the unexposed area of the sample is measured about the hue angle after thermal development. The hue angle of the water-soluble dye of the present invention is preferably in the following ranges. The hue angle θ, where the hue angle θ is defined as tan θ=b*/a* in CIELAB color spaces, is 280° to 360°, or 0° to 60°. Preferably, the hue angle is 280° to 360°, and still more preferably 290° to 340°. The chromaticity coordinates on L*a*b* colorimetric system can be derived as follows. The transmission non-uminous color of the highlight portion in the image portion of the present invention is measured based on the measuring method described in JIS Z8722: 2000. As for a light source for observation, various colorimetric lights can be properly used according to the actual conditions for viewing images. The chromaticity coordinate is calculated using a spectral distribution of fluorescent light source F5 generally used for viewing the medical images. L*, a*, and b* can be calculated by the calculation method from the non-luminous color, as described in JIS Z9829: 1944.

<Specific Description of Dye>

The water-soluble magenta dye according to the present invention is preferably the compound represented by the following formula (I).

Formula (I)

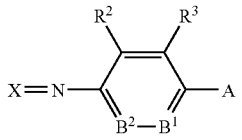

In formula (I), X represents a residual of a color photograph coupler, A represents —$NR^4R^5$ or a hydroxy group, and $R^4$ and $R^5$ each independently represent one selected from a hydrogen group, an aliphatic group, an aryl group, and a heterocyclic group. A is preferably —$NR^4R^5$. The above mentioned $R^4$ and $R^5$ each independently are preferably a hydrogen atom or an aliphatic group, more preferably a hydrogen atom, an alkyl group, or a substituted alkyl group, and further preferably a hydrogen atom, an alkyl group having 1 to 18 carbon atoms, or a substituted alkyl group having 1 to 18 carbon atoms. In more detail, most preferably, both of $R^4$ and $R^5$ are a methyl group, both of $R^4$ and $R^5$ are an ethyl group, $R^4$ is an ethyl group and $R^5$ is a 2-hydroxylethyl group, or $R^4$ is an ethyl group and $R^5$ is (2-methanesulfonyl amino)ethyl group. At least one of X, $R^2$, $R^3$, $B^1$, $B^2$ and A has a water-soluble group.

In the aforementioned formula (I), $B^1$ represents ═$C(R^6)$— or ═N—, and $B^2$ represents —$C(R^7)$═ or —N═. Preferably, $B^1$ and $B^2$ are not —N═ at the same time, and more preferably, $B^1$ is ═$C(R^6)$—, and $B^2$ is —$C(R^1)$═.

In this case, in formula (I), $R^2$, $R^3$, $R^6$, and $R^7$ each independently represent one selected from a hydrogen atom, a halogen atom, an aliphatic group, an aromatic group, a heterocyclic group, a cyano group, —$OR^{51}$, —$SR^{52}$, —$CO_2R^{53}$, —$OCOR^{54}$, —$NR^{55}R^{56}$, —$CONR^{57}R^{58}$, —$SO_2R^{59}$, $SO_2NR^{60}R^{61}$, —$NR^{62}CONR^{63}R^{64}$, —$NR^{65}CO_2R^{66}$, —$COR^{67}$, —$NR^{68}COR^{69}$, or —$NR^{70}SO_2R^{71}$. $R^{51}$, $R^{52}$, $R^{53}$, $R^{54}$, $R^{55}$, $R^{56}$, $R^{57}$, $R^{58}$, $R^{59}$, $R^{60}$, $R^{61}$, $R^{62}$, $R^{63}$, $R^{64}$, $R^{65}$, $R^{66}$, $R^{67}$, $R^{68}$, $R^{69}$, $R^{70}$, and $R^{71}$ are each independently one selected from a halogen atom, an aliphatic group, and an aromatic group.

Among them, the aforementioned $R^2$ and $R^7$ are each independently, preferably, a hydrogen atom, a halogen atom, an aliphatic group, —$OR^5$, —$NR^{62}CONR^{63}R^{64}$, —$NR^{65}CO_2R^{66}$, —$NR^{68}COR^{69}$, or —$NR^{70}SO_2R^{71}$, more preferably a hydrogen atom, a fluorine atom, a chlorine atom, an alkyl group, a substituted alkyl group, —$NR^{62}CONR^{63}R^{64}$, or —$NR^{68}COR^{69}$, still more preferably a hydrogen atom, a chlorine atom, an alkyl group having 1 to 10 carbon atoms, or a substituted alkyl group having 1 to 10 carbon atoms, and most preferably a hydrogen atom, an alkyl group having 1 to 4 carbon atoms, or a substituted alkyl group having 1 to 4 carbon atoms. In more detail, most preferably, $R^2$ represents a hydrogen atom or a methyl group and $R^7$ is a hydrogen atom.

$R^3$ and $R^6$ are each independently, preferably, a hydrogen atom, a halogen atom, or an aliphatic group, more preferably a hydrogen atom, a fluorine atom, a chlorine atom, an alkyl group, or a substituted alkyl group, further preferably a hydrogen atom, a chlorine atom, an alkyl group having 1 to 10 carbon atoms, a substituted alkyl group having 1 to 10 carbon atoms, and most preferably a hydrogen atom, an alkyl group having 1 to 4 carbon atoms, or a substituted alkyl group having 1 to 4 carbon atoms. In more detail, most preferably, both of $R^3$ and $R^7$ represent a hydrogen atom.

In the aforementioned formula (I), $R^2$ and $R^3$, $R^3$ and $R^4$, $R^4$ and $R^5$, $R^5$ and $R^6$, and $R^6$ and $R^7$ may bind each other to form a ring. The combination to form a ring is preferably $R^3$ and $R^4$, $R^4$ and $R^5$, or $R^5$ and $R^6$. The ring which is formed by bonding the aforementioned $R^2$ and $R^3$, or $R^6$ and $R^7$, is preferably a 5 or 6 membered ring. The rings are preferably an aromatic ring (for example, a benzene ring) or unsaturated heterocyclic ring (for example, a pyridine ring, an imidazole ring, a pyrimidine ring, a thiazole ring, a pyrimidine ring, a pyrrole ring or a furan ring).

The ring which is formed by bonding the aforementioned $R^3$ and $R^4$, or $R^5$ and $R^6$, is preferably a 5 or 6 membered ring. Examples of the ring include a tetrahydroquinoline ring and a dihydroindole ring. The ring, which is formed by bonding the aforementioned $R^4$ and $R^5$, is preferably a 5 or 6 membered ring. Examples of rings include a pyrrolizine ring, a piperidine ring, and a morpholine ring.

In the aforementioned formula (I), at least one of A, $R^2$, $R^3$, $B^1$, $B^2$ and X has a water-soluble group as a substituent, and preferably, A or X has a water-soluble group as a substituent.

In the present specification, the aliphatic group means an alkyl group, a substituted alkyl group, an alkenyl group, a substituted alkenyl group, an alkynyl group, a substituted alkynyl group, an aralkyl group, and a substituted aralkyl group. The aforementioned alkyl group may have a branch or may form a ring. The alkyl group preferably has 1 to 20 carbon atoms, and more preferably 1 to 18 carbon atoms. The alkyl moiety in the aforementioned substituted alkyl group is similar to the above mentioned alkyl group.

The aforementioned alkenyl group may have a branch or may form a ring. The alkenyl group has preferably 2 to 20 carbon atoms, and more preferably 2 to 18 carbon atoms. The alkenyl moiety in the aforementioned substituted alkenyl group is similar to the above mentioned alkenyl group. The aforementioned alkynyl group may have a branch or may form a ring. The alkynyl group has preferably 2 to 20 carbon atoms, and more preferably 2 to 18 carbon atoms. The alkynyl moiety in the aforementioned substituted alkynyl group is similar to the above mentioned alkynyl group.

The alkyl moiety in the aforementioned aralkyl group and in the aforementioned substituted aralkyl group is similar to the above mentioned alkyl group. The aryl moiety in the aforementioned aralkyl group and in the aforementioned substituted aralkyl group is similar to the aryl group mentioned below. Examples of the substituent of the alkyl moiety in the aforementioned substituted alkyl group, substituted alkenyl group, substituted alkynyl group and substituted aralkyl group include a halogen atom, cyano, nitro, a heterocyclic group, —$OR^{141}$, —$SR^{142}$, —$CO_2R^{143}$, —$NR^{144}R^{145}$, —$CONR^{146}R^{147}$, —$SO_2R^{148}$, —$SO_3R^{149}$, and —$SO_2NR^{150}R^{151}$. $R^{141}$, $R^{142}$, $R^{143}$, $R^{144}$, $R^{145}$, $R^{146}$, $R^{147}$, $R^{148}$, $R^{149}$, $R^{150}$, and $R^{151}$ are each independently a hydrogen atom, an aliphatic group, or an aromatic group. In addition to these, $R^{143}$ and $R^{149}$ may be a metal atom selected from Li, Na, K, Mg and Ca.

In this case, Li, Na, and K are preferable, and Na is more preferable. Examples of the substituent of the aryl moiety in the aforementioned substituted aralkyl group are similar to the examples of the substituent of the substituted aryl group described below.

In the present specification, an aromatic group means an aryl group and a substituted aryl group.

The aryl group is preferably phenyl or naphthyl, and particularly preferably phenyl. The aryl moiety of the aforementioned substituted aryl group is similar to the above-mentioned aryl group. Examples of the substituent of the aforementioned substituted aryl group include a halogen atom, cyano, nitro, an aliphatic group, a heterocyclic group, —$OR^{161}$, —$SR^{162}$, —$CO_2R^{163}$, —$NR^{164}R^{165}$, —$CONR^{166}R^{167}$, —$SO_2R^{168}$, —$SO_3R^{169}$ and $SO_2NR^{170}R^{171}$. $R^{161}$, $R^{162}$, $R^{163}$, $R^{164}$, $R^{165}$, $R^{166}$, $R^{167}$, $R^{168}$, $R^{169}$, $R^{170}$, and $R^{171}$ are each independently a hydrogen atom, an aliphatic group, or an aromatic group. In addition to these, $R^{163}$ and $R^{169}$ may be a metal atom selected from Li, Na, K, Mg, and Ca. In this case, Li, Na, and K are preferable, and Na is more preferable.

In the present specification, a heterocyclic group preferably contains a 5 or 6 membered saturated or unsaturated heterocycle. A heterocycle may be condensed with an aliphatic ring, aromatic ring, or other heterocycle. Examples of the heteroatom in the heterocycle include B, N, O, S, Se and Te. As a heteroatom, N, O, and S are preferable. The heterocycle preferably has a free monovalent carbon atom (the heterocyclic group binds at a carbon atom).

Examples of the saturated heterocycle include a pyrrolidine ring, a morpholine ring, 2-bora-1,3-dioxolane ring, and 1,3-thiazoline ring. Examples of the unsaturated heterocycle include an imidazole ring, a thiazole ring, a benzothiazole ring, a benzoxazole ring, a benzotriazole ring, a benzoselenazole ring, a pyridine ring, a pyrimidine ring, and a quinoline ring. The heterocyclic group may have a substituent. Examples of the substituent include a halogen atom, cyano, nitro, an aliphatic group, an aromatic group, a heterocyclic group, —$OR^{171}$, —$SR^{172}$, —$CO_2R^{173}$, —$NR^{174}R^{175}$, —$CONR^{176}R^{177}$, —$SO_2R^{178}$, and $SO_2NR^{179}R^{180}$. $R^{171}$, $R^{172}$, $R^{173}$, $R^{174}$, $R^{175}$, $R^{176}$, $R^{177}$, $R^{178}$, $R^{179}$, and $R^{180}$ are each independently a hydrogen atom, an aliphatic group, or an aromatic group.

In the aforementioned formula (I), a coupler represented by X is preferably the coupler mention below. U.S. Pat. Nos. 4,310,619 and 4,351,897, European Patent (EP) No. 73636, U.S. Pat. Nos. 3,061,432 and 3,725,067, Research Disclosure Nos. 24220 (June, 1984) and 24230 (June, 1984), JP-A Nos. 60-33552, 60-43659, 61-72238, 60-35730, 55-118034, and 60-185951, U.S. Pat. Nos. 4,500,630, 4,540,654, and 4,556,630, WO No. 88/04795, JP-A No. 3-39737 {L-57 (page 11, at the lower right), L-68 (page 12, at the lower right), L-77 (page 13, at the lower right)}, EP No. 456257 {[A-4]-63 (page 134), [A4]-73, -75 (page 139){, EP No. 486965 {M-4, -6 (page 26), M-7 (page 27)}, EP No. 571959A {M-45 (page 19), JP-A No. 5-204106 (M-1) (page 6)}, JP-A No. 4-362631 (paragraph No. 0237, M-22), and U.S. Pat. Nos. 3,061,432 and 3,725,067.

Among the compounds represented by the aforementioned formula (I), the compound represented by the following formula (II) is preferable. Next, formula (II) is explained.

Formula (II)

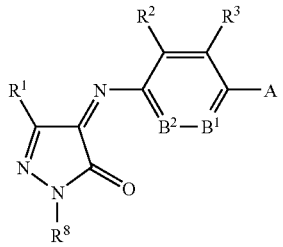

In formula (II), $R^1$ represents one selected from a hydrogen atom, an aliphatic group, an aromatic group, a heterocyclic group, cyano, —$OR^{81}$, —$SR^{82}$, —$CO_2R^{83}$, —$OCOR^{84}$, —$NR^{85}R^{86}$, —$CONR^{87}R^{88}$, —$SO_2R^{89}$, —$SO_2NR^{90}R^{91}$, —$NR^{92}CONR^{93}R^{94}$, —$NR^{95}CO_2R^{96}$, —$COR^{97}$, —$NR^{98}COR^{99}$ and —$NR^{100}SO_2R^{101}$. $R^{81}$, $R^{82}$, $R^{83}$, $R^{84}$, $R^{85}$, $R^{86}$, $R^{87}$, $R^{88}$, $R^{89}$, $R^{90}$, $R^{91}$, $R^{92}$, $R^{93}$, $R^{94}$, $R^{95}$, $R^{96}$, $R^{97}$, $R^{98}$, $R^{99}$, $R^{100}$, and $R^{101}$ are each independently a hydrogen atom, an aliphatic group, or an aromatic group. $R^8$ represents an aliphatic group or an aromatic group.

Further, $R^2$, $R^3$, A, $B^1$, and $B^2$ have the same respective meanings as defined in the aforementioned formula (I), and the preferable range is also the same. In formula (II), at least one of $R^1$, $R^2$, $R^3$, $R^8$, $B^1$, $B^2$, and A has a water-soluble group, and preferably, one of A, $R^1$, and $R^8$ has a water-soluble group.

Among the compounds represented by the aforementioned formula (II), the one with A being —$NR^4R^5$ is more preferable.

Next, the compounds represented by the aforementioned formula (II) are explained in more detail. The aforementioned $R^1$ is, among the previously mentioned groups, preferably an aliphatic group, an aromatic group, —$NR^{85}R^{86}$, —$NR^{92}CONR^{93}R^{94}$, —$NR^{95}CO_2R^{96}$, —$NR^{98}COR^{99}$ or —$NR^{100}SO_2R^{101}$, more preferably —$NR^{85}R^{86}$, —$NR^{98}COR^{99}$ or —$NR^{100}SO_2R^{101}$, and particularly preferably —$NR^{85}R^{86}$, or —$NR^{98}COR^{99}$.

The aforementioned $R^8$ is an aliphatic group or an aromatic group, and preferably an aromatic group.

Among the compounds represented by the aforementioned formula (II), the compounds represented by the following formula (III) is preferable. Next, formula (III) is explained.

Formula (III)

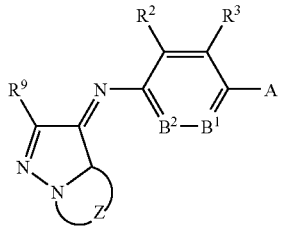

In formula (III), $R^9$ represents one selected from a hydrogen atom, an aliphatic group, an aromatic group, a heterocyclic group, cyano, —$OR^{11}$, —$SR^{12}$, —$CO_2R^{13}$, —$OCOR^{14}$, —$NR^{15}R^{16}$, $CONR^{17}R^{18}$, —$SO_2R^{19}$, —$SO_2NR^{20}R^{21}$, —$NR^{22}CONR^{23}R^{24}$, —$NR^{25}CO_2R^{26}$, —$COR^{27}$, —$NR^{28}COR^{29}$ and —$NR^{30}SO_2R^{31}$. $R^{11}$, $R^{12}$, $R^{13}$, $R^{14}$, $R^{15}$, $R^{16}$, $R^{17}$, $R^{18}$, $R^{19}$, $R^{20}$, $R^{21}$, $R^{22}$, $R^{23}$, $R^{24}$, $R^{25}$, $R^{26}$, $R^{27}$, $R^{28}$, $R^{29}$, $R^{30}$ and $R^{31}$ are each independently a hydrogen atom, an aliphatic group, or an aromatic group. And at least one of $R^2$, $R^3$, $R^4$, $R^5$, $R^6$, $R^7$, $R^9$, $X^1$, and $X^2$ has a water-soluble group, and preferably, at least one of A, $R^9$, and Z has a water-soluble group.

Z is a group of atoms that forms a 5 or 6 membered nitrogen containing heterocycle, and may be substituted by at least one of an aliphatic group, an aromatic group, a heterocyclic group, cyano, —$OR^{111}$, —$SR^{112}$, —$CO_2R^{113}$, —$OCOR^{114}$, —$NR^{115}R^{116}$, —$CONR^{117}R^{118}$, —$SO_2R^{119}$, —$SO_2NR^{120}R^{121}$, —$NR^{122}CONR^{123}R^{124}$, —$NR^{125}CO_2R^{126}$, —$COR^{127}$, —$NR^{128}COR^{129}$ and —$NR^{130}SO_2R^{131}$. This heterocycle may further form a condensed ring with other ring.

Herein, $R^{111}$, $R^{112}$, $R^{113}$, $R^{114}$, $R^{115}$, $R^{116}$, $R^{117}$, $R^{118}$, $R^{119}$, $R^{120}$, $R^{121}$, $R^{122}$, $R^{123}$, $R^{124}$, $R^{125}$, $R^{126}$, $R^{127}$, $R^{128}$, $R^{129}$, $R^{130}$, and $R^{131}$ are each independently a hydrogen atom, an aliphatic group, or an aromatic group.

Further, $R^2$, $R^3$, A, $B^1$, and $B^2$ have the same respective meanings as defined in the aforementioned formula (I), and the preferable range is also the same.

Among the compounds represented by the aforementioned formula (III), the one with A being —$NR^4R^5$ is more preferable.

Next, the compounds represented by the aforementioned formula (III) are explained in more detail. The aforementioned $R^9$ is, among the aforementioned groups, preferably a hydrogen atom, an aliphatic group, an aromatic group, —$OR^{11}$, —$SR^{12}$, —$NR^{15}R^{16}$, —$SO_2R^{19}$, —$NR^{22}CONR^{23}R^{24}$, —$NR^{25}CO_2R^{26}$, —$NR^{28}COR^{29}$ or —$NR^{30}SO_2R^{31}$, more preferably a hydrogen atom, an aliphatic group, an aromatic group, —$OR^{11}$, or —$NR^{15}R^{16}$, still more preferably a hydrogen atom, an alkyl group, a substituted alkyl group, an aryl group, a substituted aryl group, an alkoxy group, a substituted alkoxy group, a phenoxy group, a substituted phenoxy group, a dialkylamino group, or a substituted dialkylamino group, even more preferably a hydrogen atom, an alkyl group having 1 to 18 carbon atoms, a substituted alkyl group having 1 to 18 carbon atoms, an aryl group having 6 to 10 carbon atoms, or a substituted aryl group having 6 to 18 carbon atoms, and most preferably a hydrogen atom, an alkyl group having 1 to 10 carbon atoms, or a substituted alkyl group having 1 to 18 carbon atoms.

The aforementioned Z preferably forms a 5 or 6 membered nitrogen containing heterocycle, and more preferably a 5 membered nitrogen containing heterocycle. Examples of the 5 membered nitrogen containing heterocycle include a imidazole ring, a triazole ring, and a tetrazole ring.

Further, among the compounds represented by the aforementioned formula (III), pyrazolotriazoleazomethine compound represented by the following formula (IV) is particularly preferable.

Formula (IV)

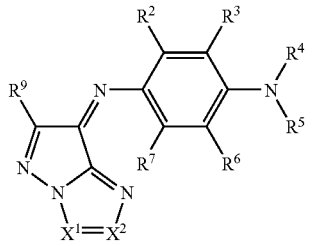

In the aforementioned formula (IV), $R^2$, $R^3$, $R^4$, $R^5$, $R^6$, $R^7$, and $R^9$ have the same respective meanings as defined in the aforementioned formulae (I) and (III). And, in the aforementioned formula (IV), $X^1$ and $X^2$ each independently represent —C($R^{10}$)═ or —N═, and $R^{10}$ represents a hydrogen atom, an aliphatic group, or an aromatic group. One of $X^1$ and $X^2$ is —N═, $X^1$ and $X^2$ not being —N═ at the same time. In the aforementioned formula (IV), at least one of $R^2$, $R^3$, $R^4$, $R^2$, $R^6$, $R^7$, $R^9$, $X^1$, and $X^2$ has a water-soluble group as a substituent. It is preferred that at least one of $R^4$, $R^2$, $R^9$, $X^1$, and $X^2$ has a water-soluble group as a substituent.

In this case, the aforementioned $R^{10}$ is preferably a hydrogen atom, an alkyl group, a substituted alkyl group, an aryl group, or a substituted aryl group, more preferably a hydrogen atom, a substituted alkyl group having 1 to 150 carbon atoms, or a substituted aryl group having 1 to 150 carbon atoms, and especially preferably a substituted alkyl group having 1 to 100 carbon atoms or a substituted aryl group having 1 to 100 carbon atoms.

As the substituted alkyl group represented by the aforementioned $R^{10}$, an alkyl group, which has a hydrophilic group and has 1 to 100 carbon atoms, is most preferable. Herein, the hydrophilic group means a carboxyl group, a sulfo group, a phosphate group, a group having a quaternary salt structure of nitrogen, a group having a quaternary salt structure of phosphorus, or a polyoxyethylene group. When the hydrophilic group is a carboxyl group, a sulfo group, or a phosphate group, it may have a counter cation if necessary, and as the counter ion, a metal cation, a group having a quaternary salt structure of nitrogen, or a group having a quaternary salt structure of phosphorus is used.

In the case where $R^4$ and $R^5$ are a group having a quaternary salt structure of nitrogen or a group having a quaternary salt structure of phosphorus, they may have a counter anion if necessary, and as the counter anion, for example, a halogen ion, a sulfate ion, a nitrate ion, a phosphate ion, an oxalate ion, an alkanesulfonate ion, an arylsulfonate ion, an alkanecarboxylate ion, an arylcarboxylate ion may be selected.

As the hydrophilic group, a carboxyl group, a sulfo group, and a phosphate group are preferable, and more preferable are a carboxyl group and a sulfo group. A sulfo group is especially preferable. In this case, positive ion of Li, Na, K, Mg, or Ca is preferably used as a counter ion, more preferably positive ion of Li, Na, or K is used, and particularly preferably positive ion of Na is used.

In the aforementioned formula (IV), more preferable is a pyrazotriazoleazomethine compound wherein $X^1$ is —N═ and $X^2$ is —C($R^{10}$)═.

Specific examples of the compound according to the invention are shown below, but the invention is not restricted to them.

(1)

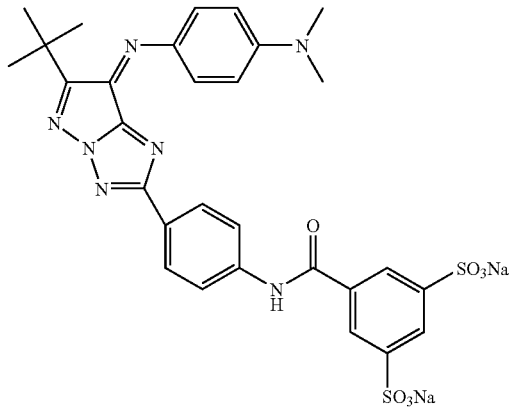

(2)

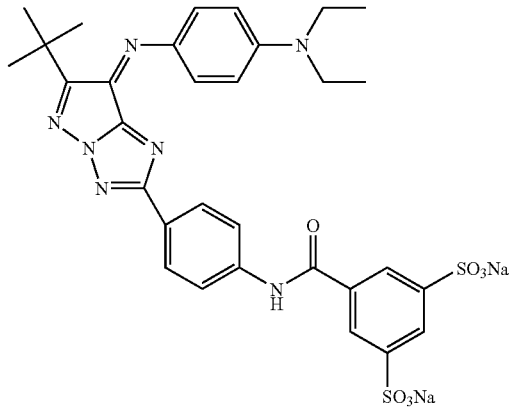

(3)

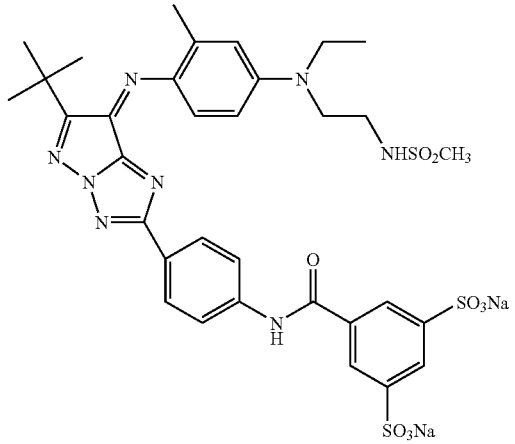

-continued
(4)
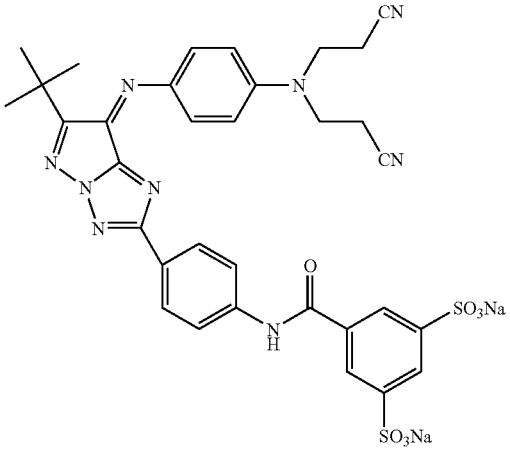
(5)
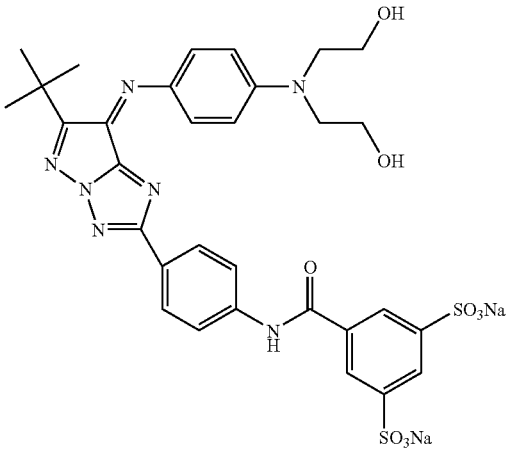
(6)
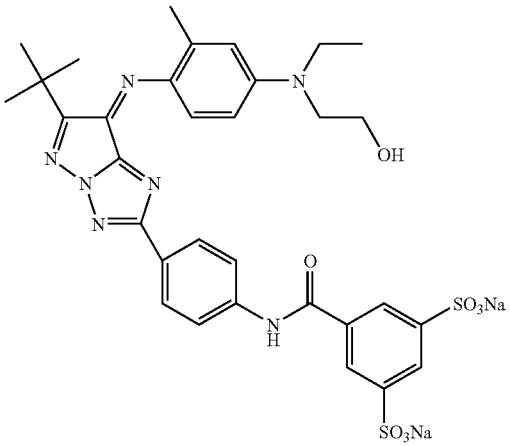
-continued
(7)
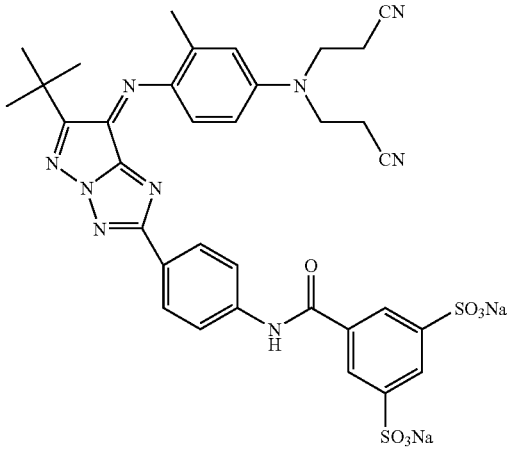
(8)
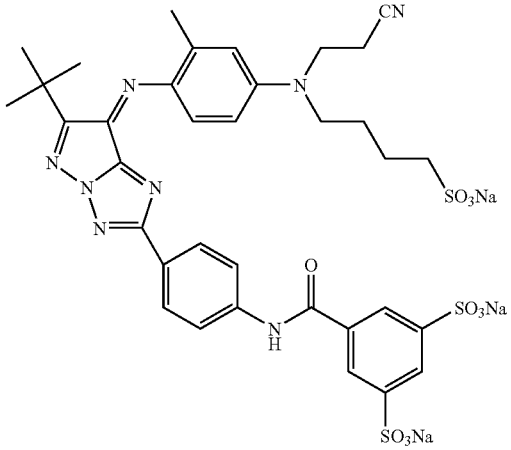
(9)
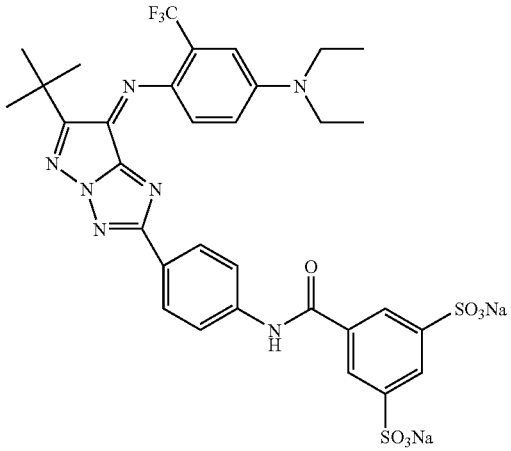

-continued
(10)
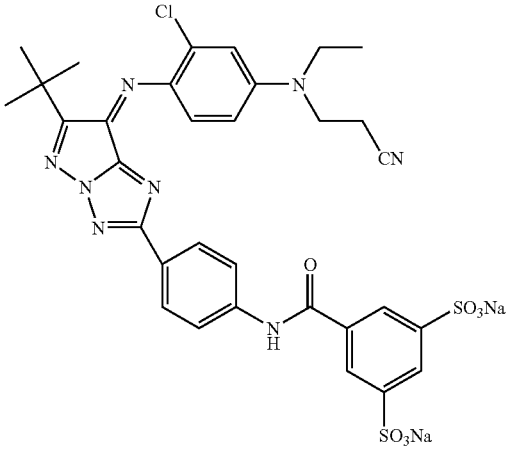
(11)
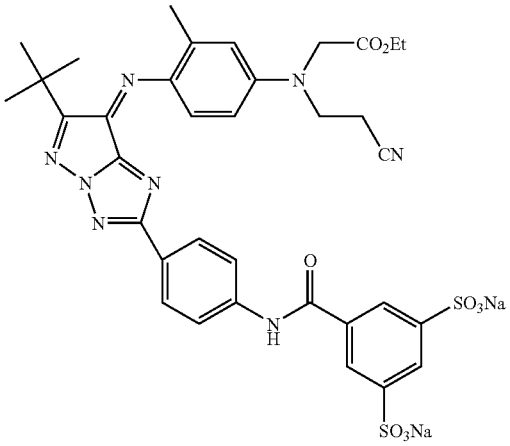
(12)
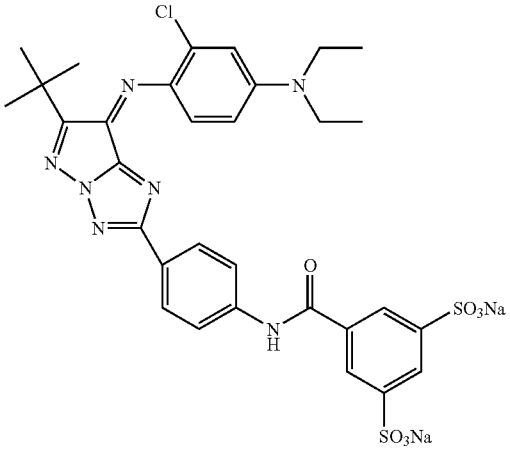
-continued
(13)
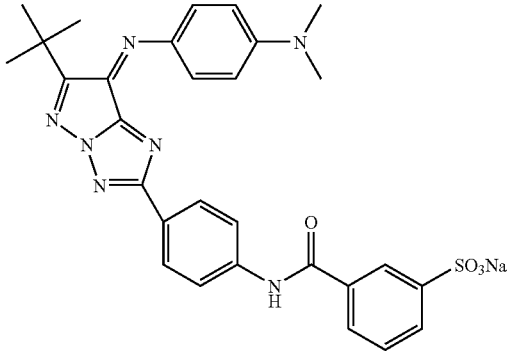
(14)
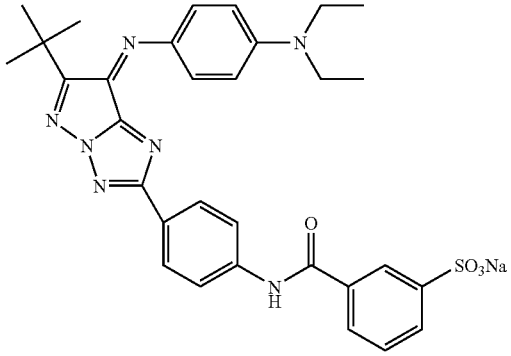
(15)
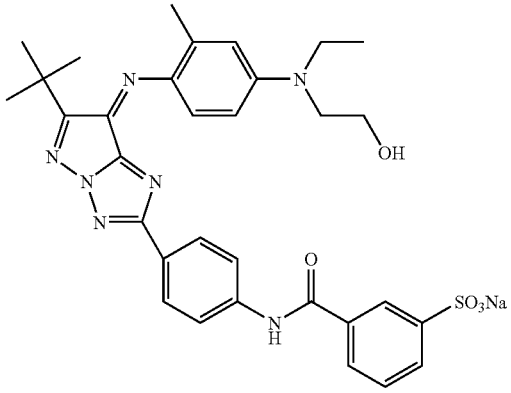

-continued
(16)
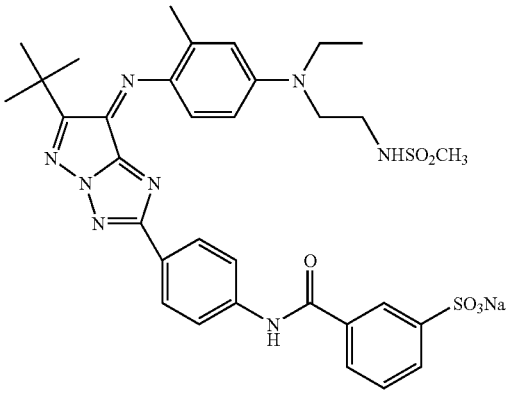
(17)
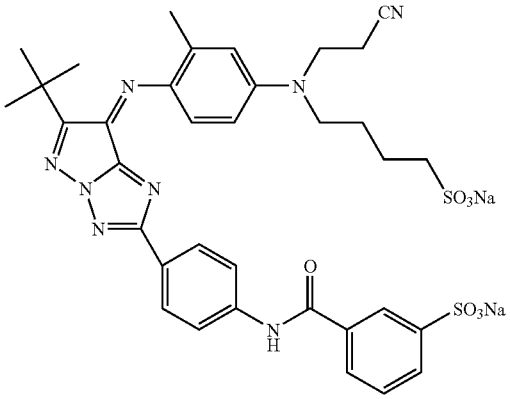
(18)
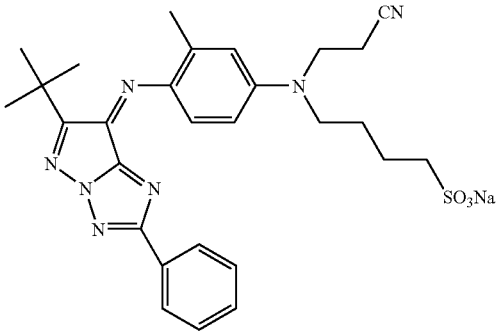
-continued
(19)
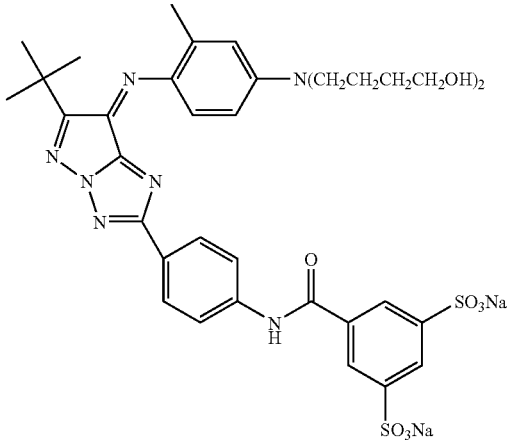
(20)
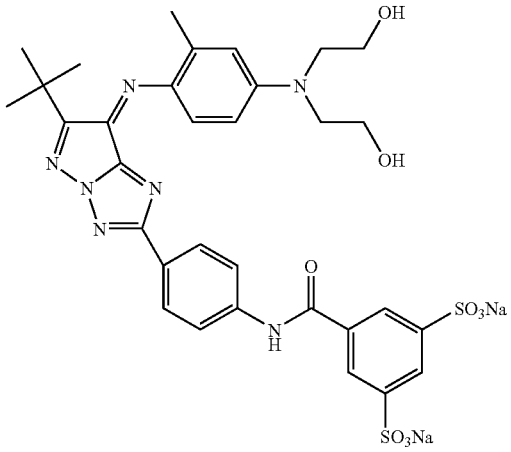
(21)
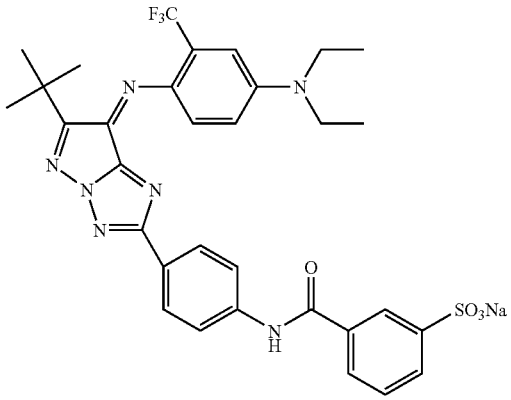

-continued
(22)
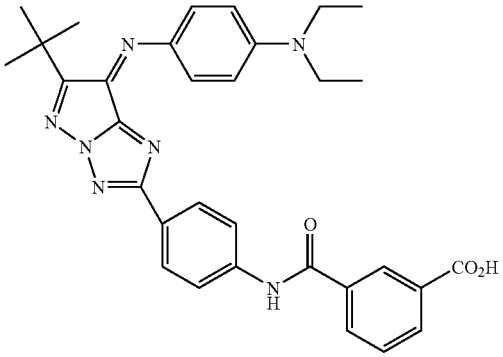
(23)
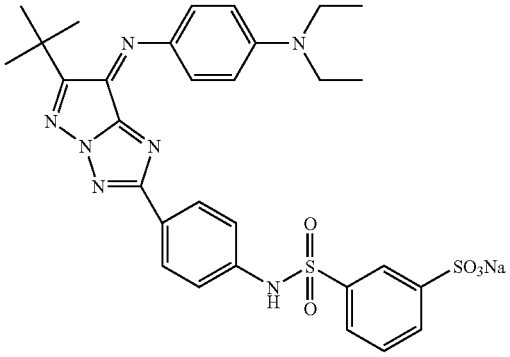
(24)
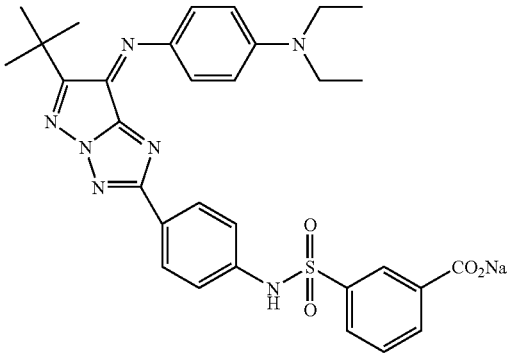
-continued
(25)
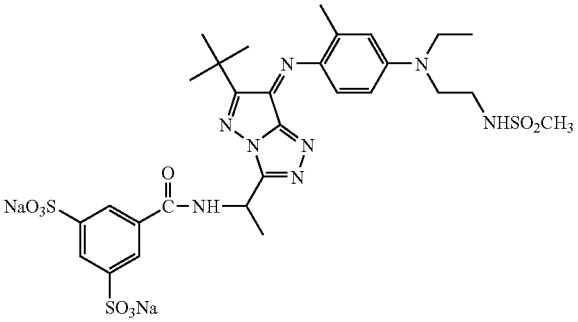
(26)
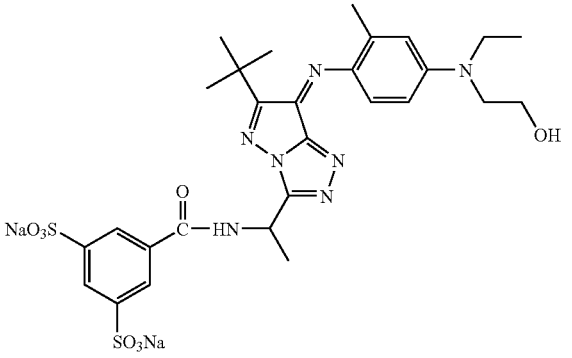
(27)
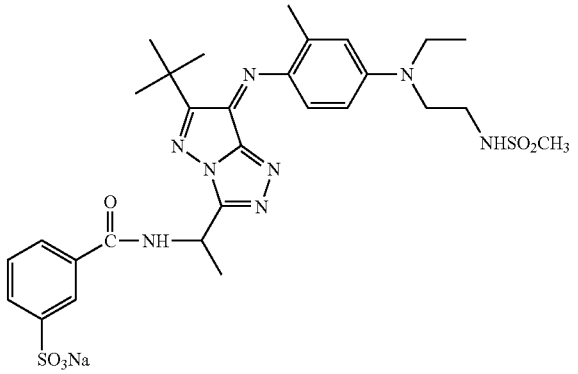

-continued (28)

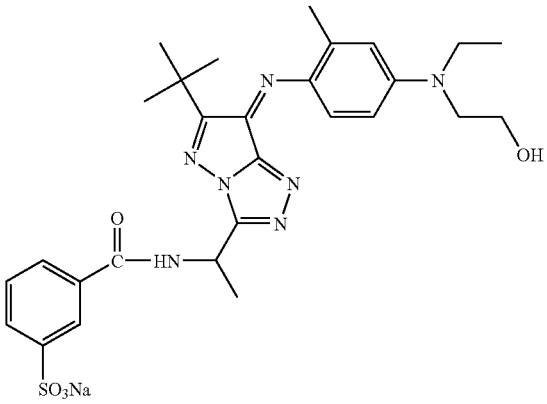

(29)

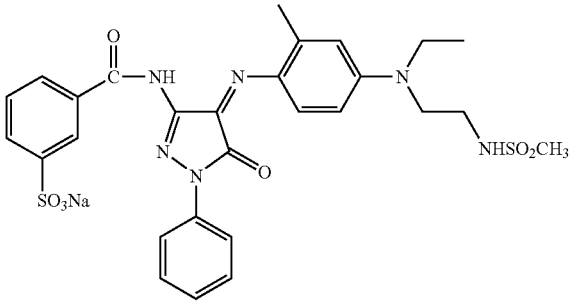

(30)

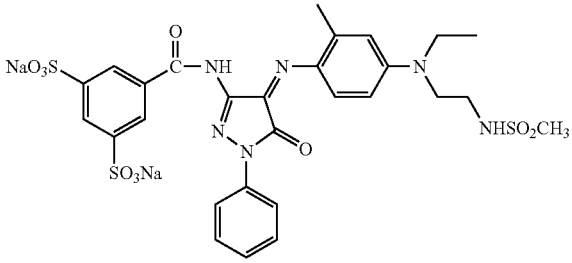

(31)

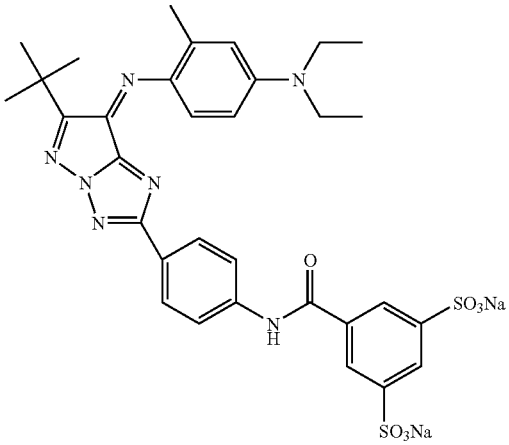

-continued (32)

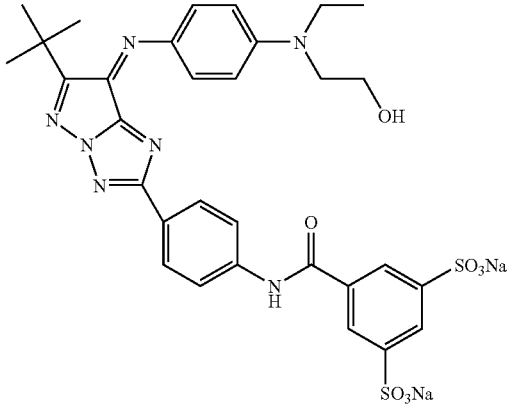

(33)

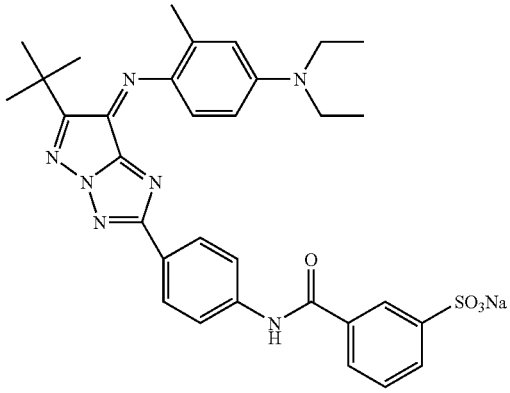

(34)

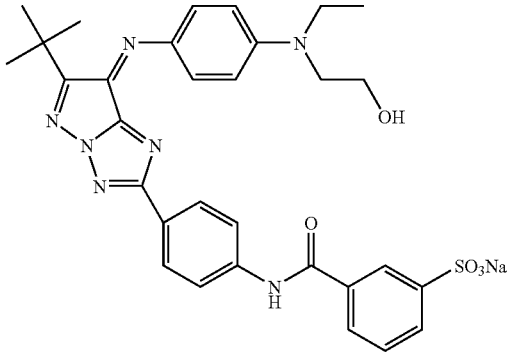

The dyes represented by the aforementioned formula (III) may be synthesized referring to the methods described, for example, in JP-A No. 4-126772, and Japanese Patent Application Publication (JP-B) No. 7-94180.

As other azomethine dyes which can be used in the invention, formula (I) described in JP-A No. 4-247449, formula (I) described in JP-A No. 63-145281, formula (1) described in JP-A No. 2002-256164, formula (I) described in JP-A No. 3-244593, formula (I) described in JP-A No. 3-7386, formulae (II), (III), and (IV) described in JP-A No. 2-252578, formulae (I) and (II) described in JP-A No. 4-359967, formula (I) and (II) described in JP-A No. 4-359968 and the like can be described. Dyes described in these patents can be also included as specific compounds.

Synthesis of Compound (1) in the Examples

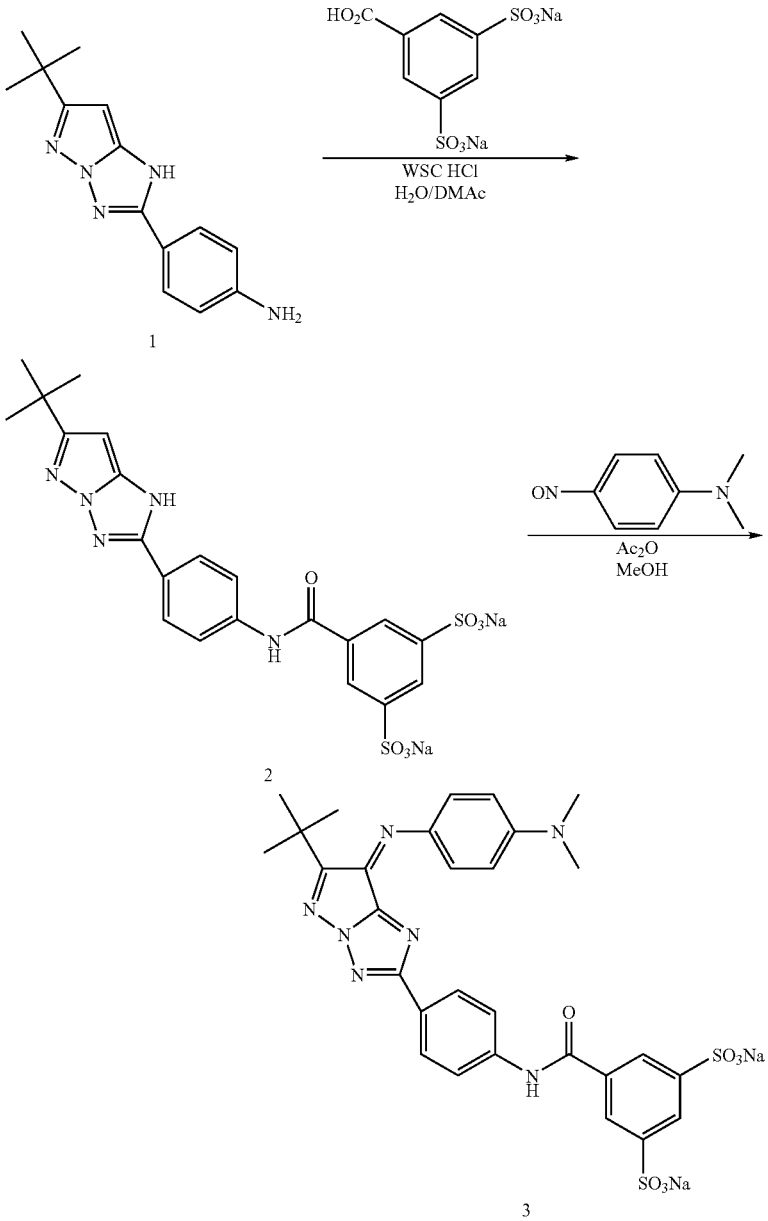

To a solution of 3,5-disulfobenzoic acid, disodium salt (13.7 g, 41.9 mmol) in water/dimethylacetamide (125 mL each), was added a synthesis intermediate 1 (10.1 g, 39.6 mmol) and WSC (condensing agent, 55.4 mmol, 10.6 g) in order. After stirring for 5 hours at room temperature, it was poured to an aqueous solution (500 mL) of sodium chloride (100 g), then stirred for 30 minutes. Thus precipitated solids were filtered off while washing with water and acetonitrile, then after drying, 18.7 g of 2 was obtained (yield 84%). 2 (16.1 g, 28.6 mmol) was added into methanol (300 mL), and dissolved thoroughly under heating. After bringing it to room temperature, 4-nitro-N,N-dimethylaniline (4.29 g, 28.6 mmol) and acetic anhydride (43.0 mL) were added and stirred over for 3 hours. After that, a part of methanol was removed under reflux, brought it back to room temperature again, and the precipitates were filtered off (washing with methanol). After drying, 13.3 g of the illustrated compound (1) was obtained (yield 67%).

<Adding Method>

The water-soluble magenta dye according to the invention is preferably used as an aqueous solution prepared previously with water solvent at the production of photothermographic material. In the said aqueous solution, the water-soluble magenta dye is contained in a range from 0.1% by weight to 30% by weight, preferably from 0.5% by weight to 20% by weight, and more preferably from about 1% by weight to 8% by weight. The said aqueous solution may further contain water-soluble organic solvent or an auxiliary additive.

As for water-soluble organic solvent, the content is about 0% by weight to 30% by weight, preferably 2% by weight to 30% by weight, and as for auxiliary additive, 0% by weight to 5% by weight, preferably 0% by weight to 2% by weight.

Specific examples of water-soluble organic solvent, which can be used at preparing an aqueous solution of water-soluble magenta dye according to the invention, include alkanols having 1 to 4 carbon atoms such as methanol, ethanol, propanol, isopropanol, butanol, isobutanol, sec-butanol, tert-butanol and the like, carboxylic amides such as N,N-dimethylformamide, N,N-dimethylacetamide and the like, lactams such as ϵ-caprolactam, N-methylpyrrolidine-2-one and the like, ureas, cyclic ureas such as 1,3-dimethylimidazolidine-2-one, 1,3-dimethylhexahydropyrimide-2-one and the like, ketones or ketoalcohols such as acetone, methylethylketone, 2-methyl-2-hydroxypentan-4-one and the like, ethers such as tetrahydrofuran, dioxane and the like, monomers, oligomer or polyalkylene glycol or thioglycol having alkylene unit with 2 to 6 carbon atoms such as ethylene glycol, 1,2- or 1,3-propylene glycol, 1,2- or 1,4-butylene glycol, 1,6-hexylene glycol, diethylene glycol, triethylene glycol, dipropylene glycol, thiodiglycol, polyethylene glycol, polypropylene glycol and the like, polyol (triol) such as glycerin, hexane-1,2,6-triol and the like, alkylether having 1 to 4 carbon atoms of polyhydric alcohol such as ethylene glycol monomethyl ether, ethylene glycol monoethyl ether, diethylene glycol monomethyl ether, diethylene glycol monoethyl ether, triethylene glycol monomethyl ether, triethylene glycol monoethyl ether and the like, γ-butylolactone, dimethyl sulfoxide, and the like. Two or more kinds of these water-soluble organic solvents may be used in combination.

Among the aforementioned water-soluble organic solvents, urea, N-methylpyrrolizine-2-one, and mono, di, or trialkylene glycol having an alkylene unit with 2 to 6 carbon atoms are preferable, and more preferably used are mono, di, or triethylene glycol, dipropylene glycol, dimethyl sulfoxide and the like. Particularly, N-methylpyrrolidine-2-one, diethylene glycol, dimethyl sulfoxide, and urea are used preferably, and urea is especially preferable.

As the auxiliary additive, for example, an antiseptic agent, a pH control agent, a chelating agent, an antistain agent, a water-soluble ultraviolet ray absorbent, a water-soluble polymer, a dye solvent, a surfactant, and the like are added respectively, when necessary.

As the antiseptic agent, for example, sodium dihydroacetate, sodium sorbinate, sodium 2-pyridinethiol-1-oxide, sodium benzoate, sodium pentachloro phenol, benzoisothiazolinone and a salt thereof, p-hydroxybenzoic acid esters and the like can be used.

As the pH control agent, any compounds can be applied so long as they can control the pH of the prepared solution in a range of 4 to 11 without any bad effect. Preferred examples of the pH control agent include alkanolamines such as diethanolamine and triethanol amine, hydroxide of alkali metal such as lithium hydroxide, sodium hydroxide, and potassium hydroxide, and carbonate of alkali metal such as lithium carbonate, sodium carbonate, and potassium carbonate.

As the chelating agent, for example, sodium salts of ethylenediaminetetraacetic acid, sodium salts of nitrilotriacetic acid, sodium salts of hydroxyethyl ethylenediaminetriacetic acid, sodium salts of diethylene triaminepentaacetic acid, sodium salts of uracil diacetic acid and the like can be described. As the antistain agent, for example, hyposulfites, sodium thiosulfate, thioglycolic acid ammonium salt, diisopropyl ammonium nitrite, pentaerythrithol tetranitrate, and dicyclohexylammonium nitrite and the like can be described. As the water-soluble polymer, for example, polyvinyl alcohol, cellulose derivatives, polyamines, and polyimines and the like can be described. As the water-soluble ultraviolet ray absorbent, for example, sulfonated benzophenones, sulfonated benzotriazoles and the like can be described. As for the dye solvent, for example, ϵ-caprolactam, ethylene carbonate, urea and the like can be described. As the surfactant, for example, known surfactants such as anionic, cationic and nonionic surfactant and the like can be described, and surfactant of acetyleneglycols and the like are also used preferably.

<Layer to be Added>

The water-soluble magenta dye according the present invention can be incorporated in at least one layer on the image forming layer coated side toward the support, or in at least one layer which is coated on the side opposite to the image forming layer coated side. Preferred is the above water-soluble compound incorporated in a layer on the image forming layer coated side toward the support. At this time, it is a preferred embodiment that the organic polyhalogen compound set forth below is incorporated in at least one layer on the side where the image forming layer is coated.

<Addition Amount>

The addition amount of the water-soluble magenta dye according to the inventin is determined by considering the combination with the color tone given by a color tone of a developed silver image or other additives. In general, the dye is used at an amount as such that the optical density (absorbance) does not exceed 0.5 when measured at the desired wavelength. The optical density is preferably 0.01 to 0.5, more preferably, 0.01 to 0.1, and further preferably, 0.01 to 0.05. The addition amount of dyes to obtain the above optical density is generally 0.5 $mg/m^2$ to 150 $mg/m^2$, more preferably, 0.5 $mg/m^2$ to 30 $mg/m^2$, and further preferably, about 0.5 $mg/m^2$ to 15 $mg/m^2$.

The aforementioned water-soluble magenta dye is preferably used in photothermographic materials that have an antihalation layer explained below.

(Antihalation Layer)

The photothermographic material of the present invention preferably comprises an antihalation layer provided to the side farther from the light source with respect to the image forming layer. Preferably, it is a back layer, or a layer provided between the support and the image forming layer, and more preferably a back layer.

Descriptions on the antihalation layer can be found in paragraph Nos. 0123 to 0124 of JP-A No. 11-65021, in JP-A Nos. 11-223898, 9-230531, 10-36695, 10-104779, 11-231457, 11-352625, 11-352626, and the like.

The antihalation layer contains an antihalation dye that has absorption at exposure wavelength. Especially, in case of laser exposure, dyes that have a maximum absorption wavelength correspondent to the laser wavelength and a narrow half band width are preferable. When the exposure wavelength is in near infrared to infrared region, infrared absorption dye that have maximum absorption in that wavelength region are used, but since line wing of an absorption spectrum is generally extending to red region, it has a cyan color tone. Also, dyes used in that case of red laser have a high cyan color tone.

It is preferred that such cyan color would not substantially reside after image formation.

As decoloring methods, many kinds of methods are proposed, but decoloring by the heat of thermal development is preferable. In particular, it is preferred to add a thermal bleaching dye and a base precursor to a non-photosensitive layer to impart function as an antihalation layer.

1) Thermal Bleaching Dye

In the invention, a thermal bleaching dye means a dye used for optical function such as for filter, for preventing irradiation, for preventing halation and the like, and it is preferred that the dye is in a state of solid particles. Further, the thermal bleaching dye used in the invention may be used along with a dye which does not decolor at a thermal developing process.

As the method of dispersing dye to be solid fine particles, there can be mentioned a method comprising dispersing the powder of the dye in a proper medium such as water, by means of ball mill, colloid mill, vibrating ball mill, sand mill, jet mill, roller mill, or ultrasonics, thereby obtaining solid dispersion. In this case, there can also be used a protective colloid (such as polyvinyl alcohol), or a surfactant (for instance, an anionic surfactant such as sodium triisopropylnaphthalenesulfonate (a mixture of compounds having the isopropyl groups in different substitution sites)). In the mills enumerated above, generally used as the dispersion media are beads made of zirconia and the like, and Zr and the like eluting from the beads may be incorporated in the dispersion. Although depending on the dispersing conditions, the amount of Zr and the like generally incorporated in the dispersion is in the range from 1 ppm to 1000 ppm. It is practically acceptable so long as Zr is incorporated in an amount of 0.5 mg or less per 1 g of silver.

Preferably, a preservative (for instance, sodium salt of benzoisothiazolinone) is added in the water dispersion.

A thermal bleaching dye can be added to the non-photosensitive back layer or to an undercoat layer provided between the image forming layer and the support. In the invention, it is preferred that the thermal bleaching dye is contained in at least one layer provided on the back layer side.

One kind or two or more kinds of the aforementioned thermal bleaching dye can be added. And, in a case where many layers contain the thermal bleaching dye, it different kinds of thermal bleaching dyes may be added, and identical kind of thermal bleaching dyes may be added at each layer.

<1> Form

In the invention, number of solid fine particles of the thermal bleaching dye is counted, provided that the thermal bleaching dye is contained in a back layer, by defilming the image forming layer side of the photothermographic material, picturing a transmittance image or reflection image by an optical microscope for any 0.1 $mm^2$ square unit area, and counting particles having an equivalent circular diameter of projected area being 1 μm or more. In this condition, number of particles having an equivalent circular diameter of projected area being 1 μm or more is preferably 100 or less, more preferably 50 or less, and particularly preferably 25 or less.

Further, in case of the aforementioned thermal bleaching dye being in solid fine particle state, volume weighted average of size of solid fine particles is preferably 1.0 μm or less, more preferably 0.6 μm or less, and particularly preferably 0.3 μm or less.

Calculation of volume weighted average of particle size is carried out as the following procedure. After drying the dye dispersion on a mesh, carbon evaporation is conducted. A picture of the particle is taken by an electron microscope at an appropriate angle, equivalent spherical diameter and particle volume of each dye particle are calculated, and volume weighted average of particle size is calculated. In the procedure, overlapping of particles may be possible, but such overlap is counted as 1. Particle number of a population is preferably about 500 to 1000.

<2> Addition Amount

An addition amount of the aforementioned thermal bleaching dye is provided so as the optical density (absorbance) exceeds 0.1 when measured at the desired wavelength. The optical density is preferably 0.15 to 2, and more preferably, 0.2 to 1. The addition amount of dyes to obtain the above optical density is generally about 0.001 $g/m^2$ to 1 $g/m^2$.

After thermal development, the optical density is preferably 0.1 or lower by decoloring of the dye.

<3> Preferable Thermal Bleaching Dye

Preferable thermal bleaching dyes in the present invention are set forth below.

A dye decolorable selectively by base, or a salt thereof (thereafter, it may be described as "bleaching dye") is preferably used as the aforementioned thermal bleaching dye. A cyanine dye represented by the following formula (1) or a salt thereof is preferably used.

Formula (1)

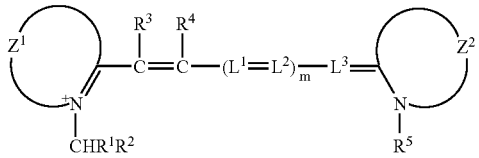

In formula (1), $R^1$ represents an electron-attracting group, $R^2$ represents one selected from a hydrogen atom, an aliphatic group, and an aromatic group. $R^3$ and $R^4$ each independently represent one selected from a hydrogen atom, a halogen atom, an aliphatic group, an aromatic group, —$NR^6R^7$, —$OR^6$, and $SR^7$, wherein $R^6$ and $R^7$ each independently represent one selected from a hydrogen atom, an aliphatic group, and an aromatic group. $R^5$ represents an aliphatic group. $L^1$, $L^2$, and $L^3$ are each independently a methine which may be substituted, and the substituents of methine may bind to form an unsaturated aliphatic ring or an unsaturated heterocycle. $Z^1$ and $Z^2$ are each independently an atomic group that forms nitrogen containing 5 or 6 membered heterocycle, the nitrogen containing heterocycle may be condensed with an aromatic group, and the nitrogen containing heterocycle and the condensed ring thereof may have a substituent. m represents 0, 1, 2, or 3.

The compound represented by formula (1) is explained in detail. In formula (1), $R^1$ represents an electron-attracting group, and as for its value, the one with a Hammett substituent constant σ m (for example, listed in Chem. Rev., 91, 165 (1991)) being 0.3 to 1.5 is preferable. The substituents represented by —C(=O)$R^{11}$ and —SOp$R^{12}$, and a cyano group can be described, and —C(=O)$R^{11}$ is preferable. $R^{11}$ represents one selected from a hydrogen atom, an aliphatic group, an aromatic group, —$OR^{13}$, —$SR^{13}$, and $NR^{13}R^{14}$, $R^{12}$ represents one selected from an aliphatic group, an aromatic group, —$OR^{13}$, and $NR^{13}R^{14}$, and p represents 1 or 2. Herein, $R^{13}$ and $R^{14}$ are each independently one selected from a hydrogen atom, an aliphatic group, and an aromatic group, or $R^{13}$ and $R^{14}$ bind each other to form a nitrogen containing heterocycle. $R^1$ is more preferably —C(=O)$R^{11}$, among that, $R^{11}$ being —$OR^{13}$ or $NR^{13}R^{14}$ is more preferable, and for storability of photothermographic material —$NR^{13}R^{14}$ is most preferable.

In formula (1), "an aliphatic group" means an alkyl group, a substituted alkyl group, an alkenyl group, a substituted alkenyl group, an alkynyl group, a substituted alkynyl group, an aralkyl group, or a substituted aralkyl group. In the present invention, an alkyl group, a substituted alkyl group, an alkenyl group, a substituted alkenyl group, an aralkyl group and a substituted aralkyl group are preferable, and an alkyl group, a substituted alkyl group, an aralkyl group and a substituted aralkyl group are more preferable. A linear aliphatic group is more preferable than a cyclic aliphatic group. The linear aliphatic group may have a branched chain. The alkyl group has preferably 1 to 30 carbon atoms, more preferably 1 to 20 carbon atoms, and further preferably 1 to 15 carbon atoms. The alkyl part of a substituted alkyl group is similar to the alkyl group.

An alkenyl group and an alkynyl group in formula (1) have preferably 2 to 30 carbon atoms, more preferably 2 to 20 carbon atoms, and further preferably 2 to 15 carbon atoms. The alkenyl part of a substituted alkenyl group and the alkynyl part of a substituted alkynyl group are similar to the alkenyl group and the alkynyl group, respectively.

An aralkyl group in formula (1) has preferably 2 to 30 carbon atoms, more preferably 2 to 20 carbon atoms, and further preferably 2 to 15 carbon atoms. The aralkyl part of a substituted aralkyl group is similar to the aralkyl group.

In formula (1), "an aromatic group" means an aryl group or a substituted aryl group. The aryl group has preferably 6 to 30 carbon atoms, more preferably 6 to 20 carbon atoms, and further preferably 6 to 15 carbon atoms. The aryl part of a substituted aryl group is similar to the aryl group.

There is particularly no limitation to the substituents which the aforementioned each group may have. Examples include a carboxyl group (it may be a salt), a sulfo group (it may be a salt), a sulfonamide group having 1 to 20 carbon atoms (for example, methanesulfonamide, benzenesulfonamide, butanesulfonamide, and n-octanesulfonamide), a sulfamoyl group having 0 to 20 carbon atoms (for example, unsubstituted sulfamoyl, methylsulfamoyl, phenylsulfamoyl, and butylsulfamoyl), a sulfonylcarbamoyl group having 2 to 20 carbon atoms (for example, mehtanesulfonylcarbamoyl, propanesulfonylcarbamoyl, and benzenesulfonylcarbamoyl), an acylsulfamoyl group having 1 to 20 carbon atoms (for example, acetylsulfamoyl, propionylsulfamoyl, and benzoylsulfamoyl), a linear or cyclic alkyl group having 1 to 20 carbon atoms (for example, methyl, ethyl, cyclohexyl, trifluoromethyl, 2-hydroxyethyl, 4-carboxybutyl, 2-methoxyethyl, 2-ethoxyethyl, benzyl, 4-carboxybenzyl, and 2-diethylaminoethyl), an alkenyl group having 2 to 20 carbon atoms (for example, vinyl, and aryl), an alkoxy group having 1 to 20 carbon atoms (for example, methoxy, ethoxy, and butoxy), a halogen atom (for example F, Cl, and Br), an amino group having 0 to 20 carbon atoms (for example, an unsubstituted amino group, dimethylamino, diethylamino, and carboxyethylamino), an alkoxycarbonyl group having 2 to 20 carbon atoms (for example, methoxycarbonyl), an amide group having 1 to 20 carbon atoms (for example, acetamide, benzamide, and 4-chlorobenzamide), a carbamoyl group having 1 to 20 carbon atoms (for example, unsubstituted carbamoyl, methylcarbamoyl, phenylcarbamoyl, and benzimidazole-2-one carbamoyl), an aryl group having 6 to 20 carbon atoms (for example, phenyl, naphtyl, 4-carboxyphenyl, 4-methanesulfonamidophenyl, and 3-benzoylaminophenyl), an aryloxy goup having 6 to 20 carbon atoms (for example, phenoxy, 3-methyphenoxy, and naphthoxy), an alkylthio group having 1 to 20 carbon atoms (for example, methylthio, and octylthio), an arylthio group having 6 to 20 carbon atoms (for example, phenylthio, and naphthylthio), an acyl group having 1 to 20 carbon atoms (for example, acetyl, benzoyl, and 4-chlorobenzoyl), a sulfonyl group having 1 to 20 carbon atoms (for example, methanesulfonyl, and benzenesulfonyl), an ureido group having 1 to 20 carbon atoms (for example, methyleureido, and phenylureido), an alkoxycarbonylamino group having 2 to 20 carbon atoms (for example, methoxycarbonylamino, and hexyloxycarbonylamino), a cyano group, a hydroxy group, a nitro group, a heterocyclic group (examples of the heterocycle include a 5-ethoxycarbonylbenzoxazol ring, a pyridine ring, a sulfolane ring, a furan ring, a pyrrole ring, a pyrrolidine ring, a morpholine ring, a piperazine ring, a pyrimidine ring, a phthalimide ring, a tetrachlorophthalimide ring, and a benzoisoquinolinedion ring) and the like.

In formula (1), $R^2$ represents one selected from a hydrogen atom, an aliphatic group, and an aromatic group. Definitions of an aliphatic group and an aromatic group are the same as mentioned before. $R^2$ is preferably a hydrogen atom or an aliphatic group, more preferably a hydrogen atom or an alkyl group, further preferably a hydrogen atom or an alkyl group having 1 to 15 carbon atoms, and most preferably a hydrogen atom.

In formula (1), $R^3$ and $R^4$ are each independently one selected from a hydrogen atom, a halogen atom, an aliphatic group, an aromatic group, —$NR^6R^7$, —$OR^6$, and $SR^7$. $R^6$ and $R^7$ are each independently one selected from a hydrogen atom, an aliphatic group, and an aromatic group. Definitions of an aliphatic group and an aromatic group are the same as mentioned before. $R^3$ and $R^4$ are preferably a hydrogen atom or an aliphatic group, more preferably a hydrogen atom, an alkyl group, a substituted alkyl group, an aralkyl group, or a substituted aralkyl group, further preferably a hydrogen atom, an alkyl group, or an aralkyl group, and most preferably a hydrogen atom.

In formula (1), $R^5$ is an aliphatic group. Definition of an aliphatic group is the same as mentioned before. $R^5$ is preferably a substituted alkyl group. For easier synthesis, $R^5$ is particularly preferably a substituted alkyl group that has the same definition as —$CHR^1R^2$.

In formula (1), $L^1$, $L^2$, and $L^3$ are each independently a methine that may be substituted. As examples of the substituent of methine, a halogen atom, an aliphatic group, and an aromatic group are included. Definitions of an aliphatic group and an aromatic group are the same as mentioned before. The substituents of methine may bind to form an unsaturated aliphatic ring or an unsaturated heterocycle. An unsaturated aliphatic ring is more preferable than an unsaturated heterocycle. The formed ring is preferably 6 or 7 membered ring, and more preferably a cycloheptene ring or a cyclohexene ring. The methine particular preferably is unsubstituted, or forms a cyclopentene ring or a cyclohexene ring.

In formula (1), $Z^1$ and $Z^2$ are each independently an atomic group that forms a 5 or 6 membered nitrogen containing heterocycle. As examples of the nitrogen containing heterocycle, an oxazole ring, a thiazole ring, a selenazole ring, a pyrroline ring, an imidazole ring and a pyridine ring are included. A 5 membered ring is more preferable than a 6 membered ring. The nitrogen containing heterocycle may be condensed with an aromatic ring (benzene ring, or naphthalene ring). The nitrogen containing heterocycle and the condensed ring thereof may have a substituent. The substituent is the same as defined before. In formula (1), m is 0, 1, 2, or 3.

The cyanine dye represented by formula (1) preferably forms a salt with an anion. In the case where the cyanine dye represented by formula (1) has an anionic group such as carboxyl or sulfo as a substituent, the dye can form an inner salt. Other than that case, the cyanine dye preferably forms a salt with outer anion. The anion is preferably monovalent or divalent, and more preferably monovalent. Examples of the anion include halogen ions ($Cl^-$, $Br^-$, $I^-$), a p-toluenesulfonate ion, an ethylsulfonate ion, 1,5-disulfonaphthalene dianion, $PF_6^-$, $BF_4^-$, and $ClO_4^-$. Preferable cyanine dyes are represented by the following formula (1a).

Formula (1a)

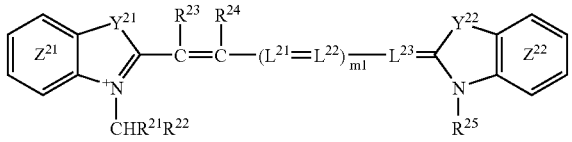

In formula (1a), $R^{21}$, $R^{22}$, $R^{23}$, $R^{24}$, $R^{25}$, $L^{21}$, $L^{22}$, $L^{23}$, and m, are the same as $R^1$, $R^2$, $R^3$, $R^4$, $R^5$, $L^1$, $L^2$, $L^3$, and m in formula (1), respectively.

Further, in formula (1a), $Y^{21}$ and $Y^{22}$ are each independently one selected from —$CR^{26}R^{27}$—, —$NR^{26}$—, —O—, —S—, and —Se—. $R^{26}$ and $R^{27}$ are each independently one selected from a hydrogen atom and an aliphatic group, and may bind each other to form a ring. The aliphatic group is particularly preferably an alkyl group or a substituted alkyl group.

In formula (1a), the benzene ring $Z^{21}$ and $Z^{22}$ may be further condensed with other benzene ring. The benzene ring $Z^{21}$, $Z^{22}$ and the condensed ring thereof may have a substituent. The substituent is the same as defined before.

In formula (1a), m, is 0, 1, 2 or 3. The cyanine dye represented by formula (1a) preferably forms a salt with an anion. Concerning the formation of salt, it is the same as explained in formula (1).

Specific examples of the dye that are decolorable by a base or the salt thereof are described below, but the invention is not limited to these.

(1)

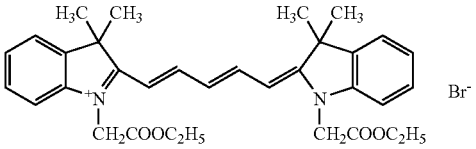

(2)

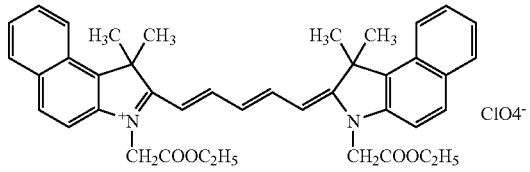

(3)

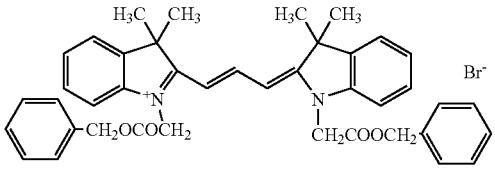

(4)

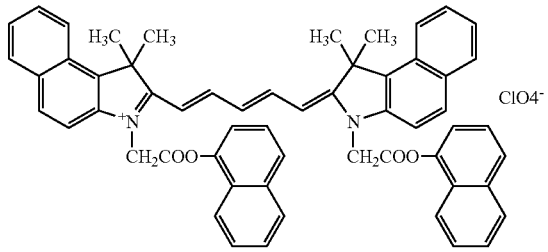

(5)

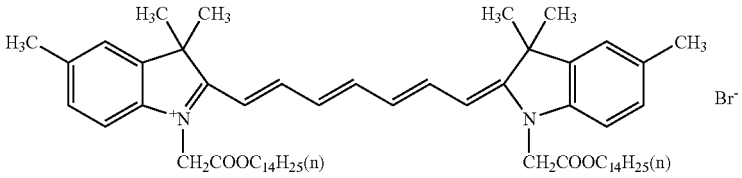

(6)

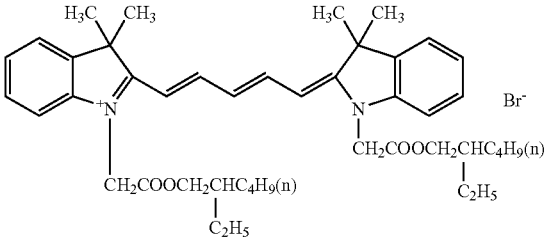

-continued (7)

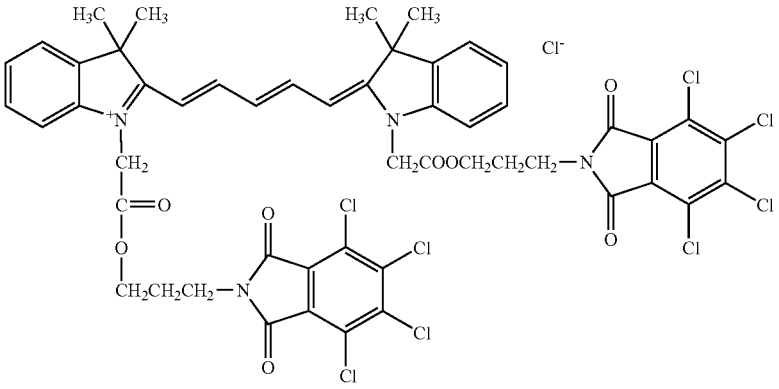

(8)

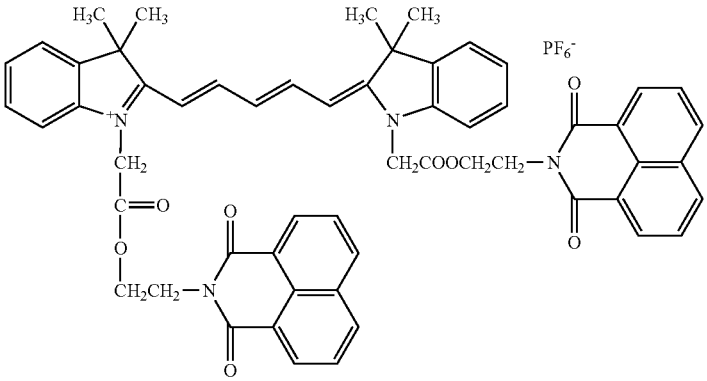

(9)

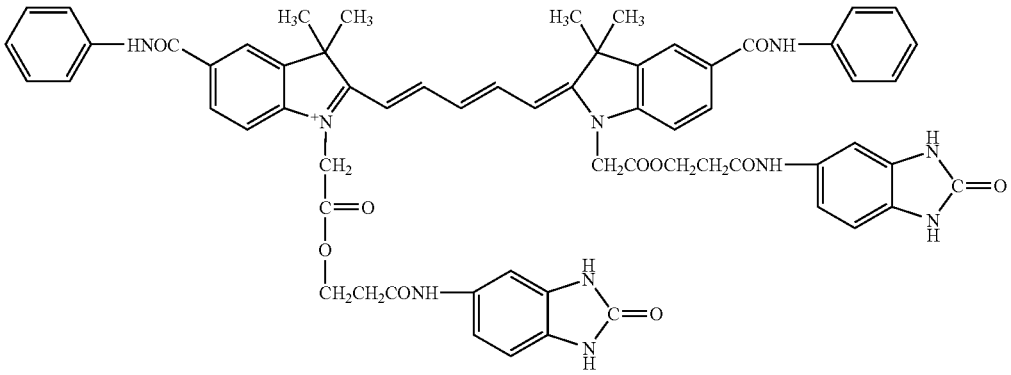

The coating amount of the thermal bleaching dye is preferably 0.001 g/m$^2$ to 1.0 g/m$^2$, and more preferably 0.01 g/m$^2$ to 0.1 g/m$^2$.

2) Base Precursor

In the present invention, in the case where the aforementioned thermal bleaching dye is added to the non-photosensitive back layer, it is preferred that a base precursor is included.

There are various kinds of base precursor that can be used in the invention, but since decoloring reaction is carried out under heating, it is preferred to use a kind of precursor that forms (or emit) a base by heating. Prime examples of base precursor that forms a base by heating are thermal decomposition type (decarboxylation type) base precursor composed of salt of carboxylic acid and a base. When a decarboxylation type base precursor is heated, a cabroxyl group of carboxylic acid undergoes decarboxylation reaction, and releases an organic base. As the carboxylic acid, sufonylacetic acid or propiolic acid that can be easily decarboxylated is used. Sufonylacetic acid or propiolic acid preferably has a group (an aryl group or an unsaturated heterocycle), that has aromaticity that help decarboxylation, as a substituent. Descriptions about base precursor of salt of sufonylacetic acid and base precursor of salt of propiolic acid can be found in JP-A No. 59-168441, and in JP-A No. 59-180537, respectively.

As a base component of decarboxylation type base precursor, an organic base is preferable, and amidine, guanine or the derivatives thereof are more preferable. The organic base is preferably diacidic base, triacidic base or tetraacidic base, more preferably diacidic base, and most preferably a diacidic base of amidine derivatives or guanidine derivatives.

As for the precursor of diacidic base, triacidic base and tetraacidic base of amidine derivatives, description can be found in JP-A No. 7-59545. As for the precursor of diacidic base, triacidic base, and tetraacidic base of guanidine derivatives, description can be found in JP-A No. 8-10321.

Diacidic base of amidine derivatives or guanidine derivatives comprises, (A) two amidine parts or guanidine parts, (B) substituents on amidine part or guanidine part and (C) a divalent linking group which binds two parts of amidine or guanidine. As examples of substituents in (B), an alkyl group (an cycloalkyl group is included), an alkenyl group, an alkynyl group, an aralkyl group and a heterocyclic group are included. Two or more substituents may bind to form a nitrogen containing heterocycle. The linking group in (C) is preferably an alkylene group or a phenylene group.

Examples (BP-1 to BP-13) of diacidic base precursor of amidine derivatives or guanidine derivatives are shown below.

BP-1

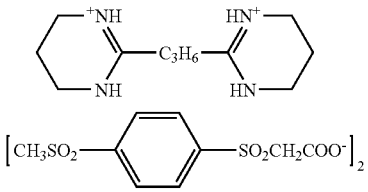

BP-2

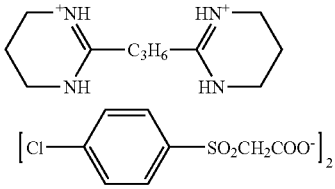

BP-3

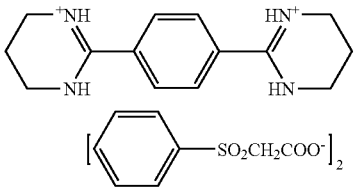

BP-4

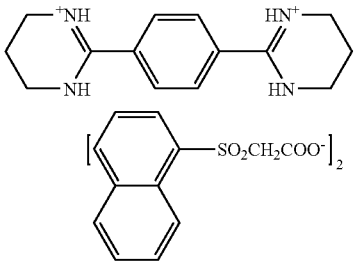

BP-5

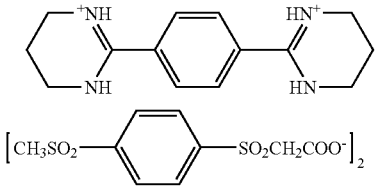

-continued

BP-6

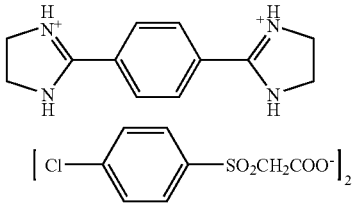

BP-7

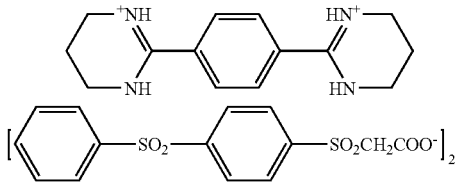

BP-8

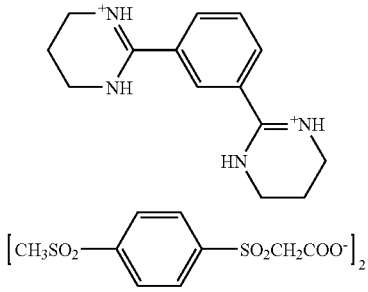

BP-9

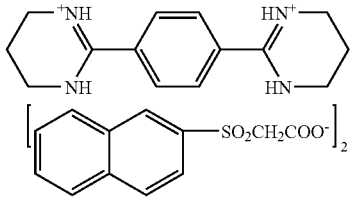

BP-10

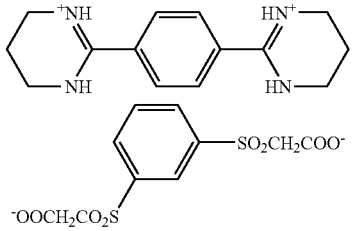

BP-11

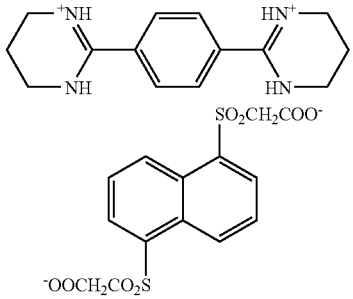

-continued

BP-12

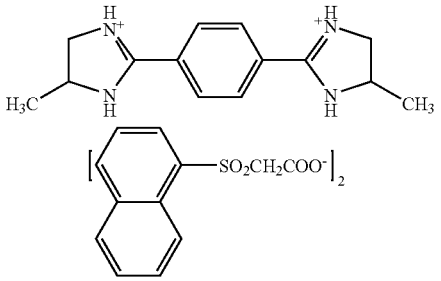

BP-13

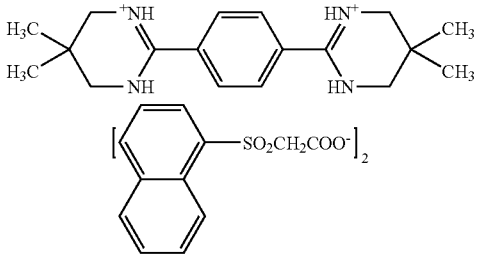

The addition amount (mole) of the base precursor according to the invention is preferably 1 time to 100 times with respect to the addition amount (mole) of the aforementioned thermal bleaching dye, and more preferably 3 times to 30 times.

Further, the aforementioned base precursor may be used by one kind alone, or two or more kinds may be used in combination.

3) Melting-point Lowering Agent

In the invention, a material that can lower the melting point of a base precursor (which is denoted "melting-point lowering agent" hereinafter) may be used in combination with a base precursor.

The melting-point lowering agent which can be used in the present invention is preferably a material that, when it is mixed with the base precursor, it can lower the melting point of the base precursor in a range of from 3° C. to 30° C.

The melting-point lowering agent which can be used in the present invention is more preferably a material that lowers the melting point of a base precursor by 3° C. to 20° C., and further preferably by 5° C. to 15° C.

Change in the melting point can be observed by carrying out a differential scanning calorimeter (DSC) to the sample which is obtained by mixing the powders of a base precursor and a melting-point lowering agent, or by mixing dispersions thereof and drying at room temperature. Two or more kinds of the melting-point lowering agents may be used simultaneously in combination.

Further, the melting-point lowering agent may be a material that lowers the melting point in a range of 3° C. to 30° C. (deg) by one kind of the compound, or the case may be that the melting point is lowered in a range of 3° C. to 30° C. only after using two or more kinds of the compounds.

As for the methods of addition, adding as a co-dispersion of mixture with a base precursor is preferable, and especially adding as a solid fine particle dispersion is preferable. In this case, a mean particle diameter of the fine particles is preferably from 0.03 μm to 0.3 μm.

In the present invention, it is preferred, providing comprising a non-photosensitive layer that contains a dye which is decolored by base or a salt thereof and a base precursor, and a non-photosensitive layer adjacent to the layer which contains a melting-point lowering agent, from a viewpoint of little residual color of the photothermographic material.

And, in the invention, it is also preferred, providing comprising a non-photosensitive layer that contains a dye which is decolored by base or a salt thereof, a base precursor, and a first melting-point lowering agent, and a non-photosensitive layer adjacent to the layer which contains a second melting-point lowering agent, from the viewpoint of little residual color of the photothermographic material.

Preferable melting-point lowering agents according to the present invention are set forth below.

As preferable melting-point lowering agents, the compounds represented by the following formulae (M1) to (M3) can be described.

Formula (M1)

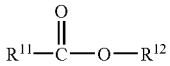

In formula (M1), $R^{11}$ and $R^{12}$ each independently represent one selected from an aliphatic group, an aromatic group, and a heterocyclic group. However, at least one of $R^{11}$ and $R^{12}$ is an aromatic group or a heterocyclic group.

Compounds represented by formula (M1) are explained below in detail.

The "aliphatic group" in formula (M1) means an alkyl group, a substituted alkyl group, an alkenyl group, a substituted alkenyl group, an alkynyl group, a substituted alkynyl group, an aralkyl group, or a substituted aralkyl group. In the invention, an alkyl group, a substituted alkyl group, an alkenyl group, a substituted alkenyl group, an aralkyl group and a substituted aralkyl group are preferable, and an alkyl group, a substituted alkyl group, an aralkyl group and a substituted aralkyl group are more preferable. A linear aliphatic group may have a branched chain.

An alkyl group in formula (M1) preferably has 1 to 30 carbon atoms, more preferably, 1 to 20 carbon aroms, and further preferably, 1 to 15 carbon atoms. The alkyl part of a substituted alkyl group is similar to the alkyl group.

An alkenyl group or an alkynyl group in formula (M1) preferably has 2 to 30 carbon atoms, more preferably 2 to 20 carbon aroms, and further preferably 2 to 15 carbon atoms. The alkenyl part of a substituted alkenyl group and the alkynyl part of a substituted alkynyl group are similar to the alkenyl group and the alkynyl group, respectively.

An aralkyl group in formula (M1) preferably has 2 to 30 carbon atoms, more preferably, 2 to 20 carbon aroms, and further preferably, 2 to 15 carbon atoms. The aralkyl part of a substituted aralkyl group is similar to the aralkyl group.

The "aromatic group" in formula (M1) means an aryl group of a single ring or a condensed ring, and it may have a substituent. The aryl group has preferably 6 to 30 carbon atoms, more preferably, 6 to 20 carbon atoms, and further preferably, 6 to 15 carbon atoms. The aryl part of the substituted aryl group is similar to the aryl group. For example, a benzene ring and a naphthalene ring can be described.

The "heterocyclic group" in formula (M1) means a 5 or 6 membered heterocyclic group or a substituted heterocyclic group. The heterocyclic group part of a substituted heterocyclic group is similar to the heterocyclic group.

As examples of the heterocycle of a heterocyclic group in formula (M1), pyrrole, indole, furan, thiophene, imidazole, pyrazole, indolidine, quinoline, carbazole, phenothiazine, indoline, thiazole, pyridine, pyridazine, thiadiazine, pyrane, thiopyrane, oxadiazole, banzoquinoline, thiadiazole, pyrrolothiazole, pyrrolopyridazine, tetrazole, oxazole, coumalin, chroman, and the like can be described. Each of these may have a substituent.

To the substituent that each group mentioned above may have, there is no special limit as long as it is other than a carboxyl group or a a salt of a carboxyl group. Examples of the substituent can include a sulfonamide group having 1 to 20 carbon atoms (for example, methanesulfonamide, benzenesulfonamide, butanesulfonamide, or n-octanesulfonamide), a sulfamoyl group having 0 to 20 carbon atoms (for example, unsubstituted sulfamoyl, methylsulfamoyl, phenylsulfamoyl, or butylsulfamoyl), a sufonylcarbamoyl group having 2 to 20 carbon atoms (for example, methanesulfonylcarbamoyl, propanesulfonylcarbamoyl, or benzenesulfonylcarbamoyl), an acylsulfamoyl having 1 to 20 carbon atoms (for example, acetylsulfamoyl, propionylsulfamoyl, or banzoylsulfamoyl), a linear or cyclic alkyl group having 1 to 20 carbon atoms (for example, methyl, ethyl, cycohexyl, 2-hydroxyethyl, 4-caboxybutyl, 2-methoxyethyl, benzyl, 4-carboxybenzyl, or 2-diethylaminoethyl), an alkenyl group having 2 to 20 carbon atoms (for example, vinyl, or allyl), an alkoxy group having 1 to 20 carbon atoms (for example, methoxy, ethoxy, or butoxy), a halogen atom (for example, F, Cl, or Br), an amino group having 0 to 20 carbon atoms (for example, an unsubstituted amino group, dimethylamino, diethylamino, or carboxyethylamino), an alkoxycarbonyl group having 2 to 20 carbon atoms (for example, methoxycarbonyl), an amide group having 1 to 20 carbon atoms (for example, acetamide, or benzamide), a carbamoyl group having 1 to 20 carbon atoms (for example, unsubstituted carbamoyl, methylcarbamoyl, or phenylcarbamoyl), an aryl group having 6 to 20 carbon atoms (for example, phenyl, naphthyl, 4-carboxyphenyl, 4-methanesulfonamidophenyl, or 3-benzoylaminophenyl), an aryloxy group having 6 to 20 carbon atoms (for example, phenoxy, 3-methylphenoxy, or naphthoxy), an alkylthio group having 1 to 20 carbon atoms (for example, methylthio, or octylthio), an arylthio group having 6 to 20 carbon atoms (for example, phenylthio, or naphthylthio), an acyl group having 1 to 20 carbon atoms (for example, acetyl, benzoyl, or 4-chlorobenzoyl), a sulfonyl group having 1 to 20 carbon atoms (for example, methanesulfonyl, or benzenesulfonyl), an ureido group having 1 to 20 carbon atoms (for example, methylureido, phenylureido), an alkoxycarbonylamino group having 2 to 20 carbon atoms (for example, methoxycarbonylamino, or hexyloxycarbonylamino), a cyano group, a hydroxy group, a nitro group, and a heterocyclic group (for example, a 5-ethoxycarbonylbenzoxazole ring, a pyridine ring, a sulfolane ring, a furan ring, a pyrrole ring, a pyrrolizine ring, a pyrrolizine ring, a morpholine ring, a piperazine ring and a pyrmidine ring).

$R^{11}$ in formula (M1) is preferably an aromatic group, and the substituent of a substituted aryl group is more preferably a substituted or unsubstituted alkyl group, a substituted or unsubstituted aryl group, a substituted or unsubstituted aralkyl group, an acyl group, a sulfonyl group, an alkoxycarbonyl group, an alkoxy group, a substituted or unsubstituted carbamoyl group, or a halogen atom. Among them, a substituted or unsubstituted alkyl group, a substituted or unsubstituted aryl group, a sulfonyl group, an alkoxy group, a halogen atom are more preferable, and a substituted or unsubstituted alkyl group, a sulfonyl group, and a halogen atom are most preferable.

$R^{12}$ in formula (M1) is preferably an aromatic group or a heterocyclic group, and when $R^{12}$ is an aromatic group, the substituent of the substituted aryl group is more preferably a substituted or unsubstituted alkyl group, a substituted or unsubstituted aryl group, a substituted or unsubstituted aralkyl group, an acyl group, a sulfonyl group, an alkoxycarbonyl group, an alkoxy group, a substituted or unsubstituted carbamoyl group, or a halogen atom. Among them, a substituted or unsubstituted alkyl group, a substituted or unsubstituted aryl group, a sulfonyl group, an alkoxy group, and a halogen atom are more preferable, and a substituted or unsubstituted alkyl group, a sulfonyl group, and a halogen atom are most preferable. When $R^{11}$ or $R^{12}$ is an aliphatic group, an aralkyl group is preferable.

Specific examples (M1-1 to M1-17) of the compound represented by formula (M1) are shown below, but the invention is not limited to these.

M1-1

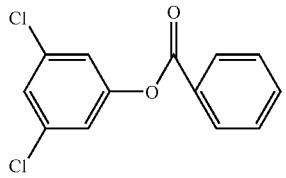

M1-2

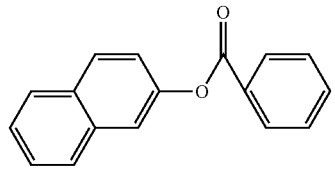

M1-3

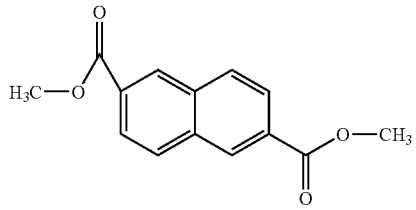

M1-4

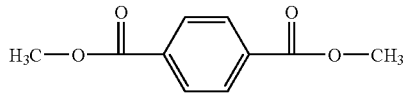

M1-5

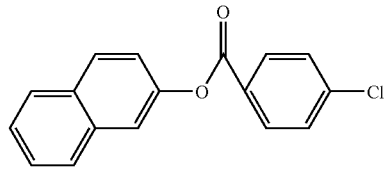

M1-6

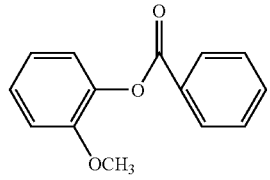

-continued

M1-7

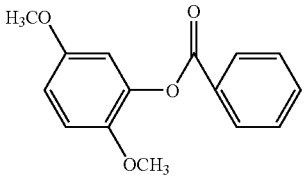

M1-8

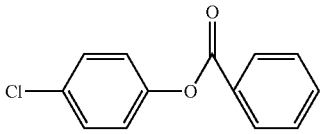

M1-9

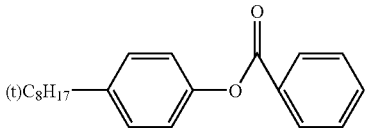

M1-10

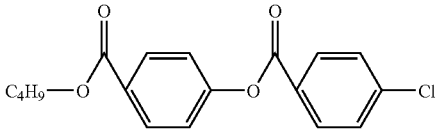

M1-11

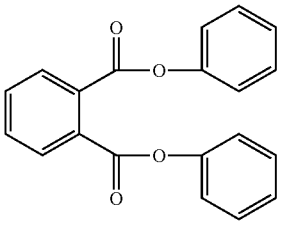

M1-12

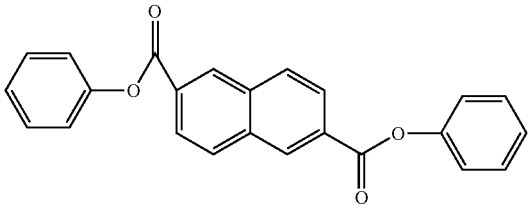

M1-13

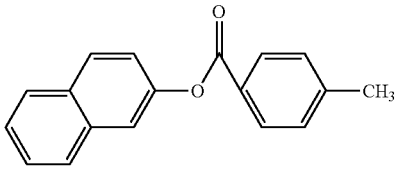

M1-14

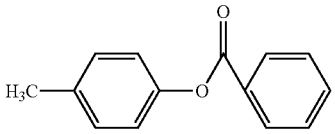

M1-15

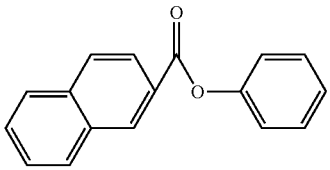

-continued

M1-16

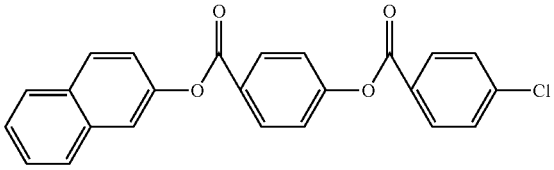

M1-17

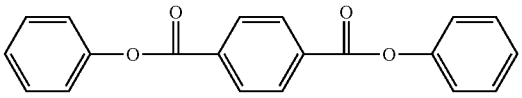

The compound represented by formula (M2), which can be used in the present invnetion as a preferable melting-point lowering agent, is described below.

$R^{21}$—X—$R^{22}$ Formula (M2)

In formula (M2), $R^{21}$ and $R^{22}$ each independently represent one selected from an aromatic group and a heterocyclic group, and X represents a linking group other than a sulfonyl group and a carboxyl group.

The "aromatic group" in formula (M2) has the same meaning as the "aromatic group" in formula (M1) mentioned before. Also, the "heterocyclic group" has the same meaning as the "heterocyclic group" in formula (M1) mentioned before.

With respect to the substituent which each group mentioned above may have, they are the same as the "substituent which each group may have" of formula (M1) mentioned before.

Formula (M2) does not include formula (M1). As a linking group represented by X, a divalent linking group is preferably used, but in case of trivalent or more charged linking group, it may have another substituent selected from a hydrogen atom, an aliphatic group, an aromatic group, and a heterocyclic group, independently apart from $R^{21}$ and $R^{22}$. As specific examples of a linking group, —C(═O)—, —OC(═O)O—, —SO—, a substituted or unsubstituted methylene chain having 1 to 3 carbon atoms, —C(═O)—C(═O)—, —C(OH)—C(═O)—, —S—, —O— and the ones shown below can be described.

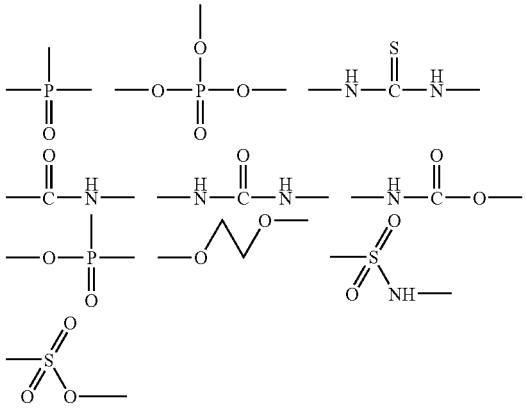

$R^{21}$ in formula (M2) is preferably an aromatic group, and the substituent of a substituted aryl group is more preferably a substituted or unsubstituted alkyl group, a substituted or unsubstituted aryl group, a substituted or unsubstituted aralkyl group, an acyl group, a sulfonyl group, an alkoxycarbonyl group, an alkoxy group, a substituted or unsubstituted carbamoyl group, or a halogen atom. Among them, a substituted or unsubstituted alkyl group, a substituted or unsubstituted aryl group, a sulfonyl group, an alkoxy group, and a halogen atom are more preferable, and a substituted or unsubstituted alkyl group, a sulfonyl group, and a halogen atom are most preferable.

$R^{22}$ in formula (M2) is preferably an aromatic group. When $R^{22}$ is an aromatic group, the substituent of a substituted aryl group is more preferably a substituted or unsubstituted alkyl group, a substituted or unsubstituted aryl group, a substituted or unsubstituted aralkyl group, an acyl group, a sulfonyl group, an alkoxycarbonyl group, an alkoxy group, a substituted or unsubstituted carbamoyl group, or a halogen atom. Among them, a substituted or unsubstituted alkyl group, a substituted or unsubstituted aryl group, a sulfonyl group, an alkoxy group, a halogen atom are more preferable, and a substituted or unsubstituted alkyl group, a sulfonyl group, and a halogen atom are most preferable.

When $R^{21}$ and $R^{22}$ are an aliphatic group, an aralkyl group is preferable.

Further, the substituents of $R^{21}$ and $R^{22}$ may bind each other to form a ring with X.

Specific examples (M2-1 to M2-16) of the compound represented by formula (M2) are shown below, but the invention is not limited to these.

M2-1

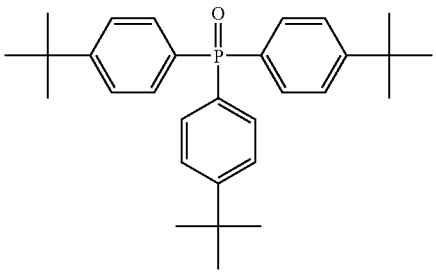

M2-2

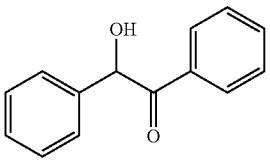

M2-3

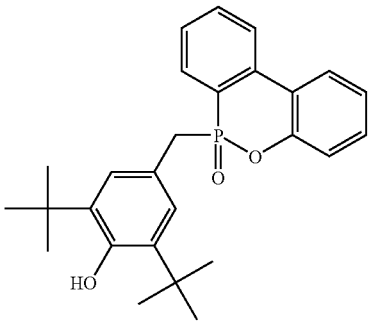

-continued

M2-4

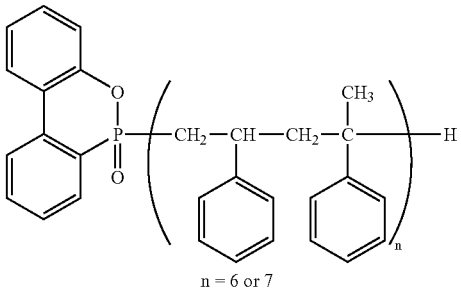

M2-5

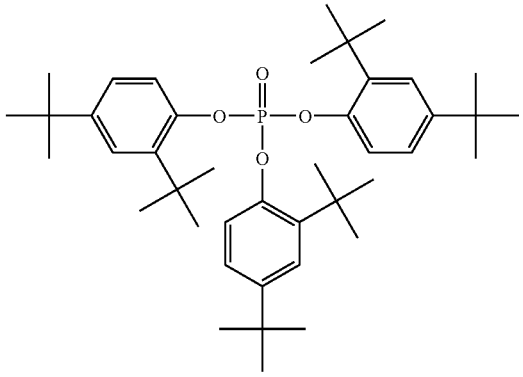

M2-6

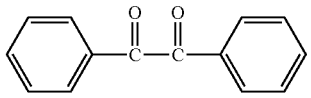

M2-7

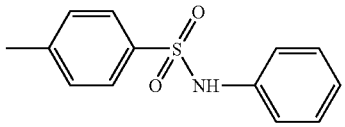

M2-8

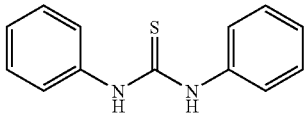

M2-9

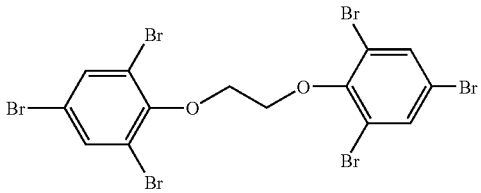

M2-10

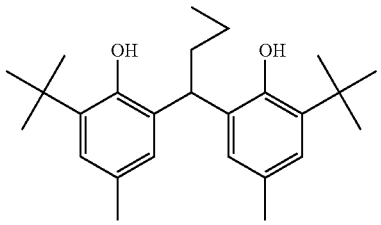

-continued

M2-11

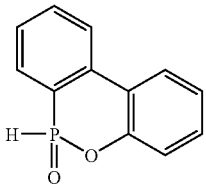

M2-12

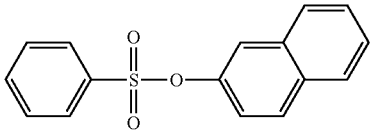

M2-13

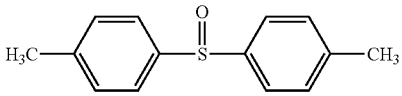

M2-14

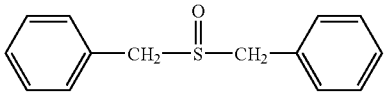

M2-15

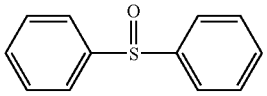

M2-16

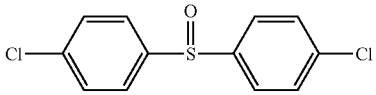

The compound represented by formula (M3), which can be used in the present invention as a preferable melting-point lowering aggent, is explained below.

Formula (M3)

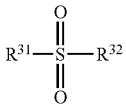

In formula (M3), $R^{31}$ and $R^{32}$ each independently represent one selected from an aromatic group and a heterocyclic group. However, the compound represented by formula (M3) does not have a caboxyl group or a salt of a caboxyl group as a substituent.

The "aromatic group" in formula (M3) has the same meaning as the "aromatic group" of formula (M1) mentioned before. Also, the "heterocyclic group" has the same meaning as the "heterocyclic group" of formula (M1) mentioned before.

With respect to the substituent which each group mentioned above may have, they are same as the "substituent which each group may have" of formula (M1) mentioned before.

$R^{31}$ in formula (M3) is preferably an aromatic group, and the substituent of a substituted aryl group is more preferably a substituted or unsubstituted alkyl group, a substituted or unsubstituted aryl group, a substituted or unsubstituted aralkyl group, an acyl group, a sulfonyl group, an alkoxycarbonyl group, an alkoxy group, a substituted or unsubstituted carbamoyl group, or a halogen atom. Among them, a substituted or unsubstituted alkyl group, a substituted or unsubstituted aryl group, a sulfonyl group, an alkoxy group, and a halogen atom are more preferable, and a substituted or unsubstituted alkyl group, a sulfonyl group, and a halogen atom are most preferable.

$R^{32}$ in formula (M3) is preferably an aromatic group. When $R^{32}$ is an aromatic group, the substituent of a substituted aryl group is preferably a substituted or unsubstituted alkyl group, a substituted or unsubstituted aryl group, a substituted or unsubstituted aralkyl group, an acyl group, a sulfonyl group, an alkoxycarbonyl group, an alkoxy group, a substituted or unsubstituted carbamoyl group, or a halogen atom. Among the, a substituted or unsubstituted alkyl group, a substituted or unsubstituted aryl group, a sulfonyl group, an alkoxy group, a halogen atom are more preferable, and a substituted or unsubstituted alkyl group, a sulfonyl group, and a halogen atom are most preferable.

Specific examples (M3-1 to M3-14) of the compound represented by formula (M3) are shown below, but the invention is not limited to these.

M3-1

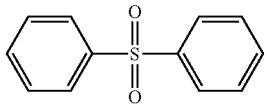

M3-2

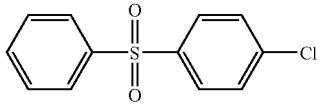

M3-3

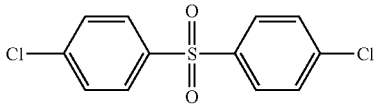

M3-4

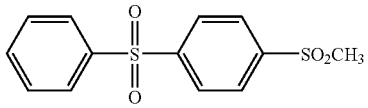

M3-5

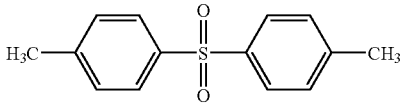

M3-6

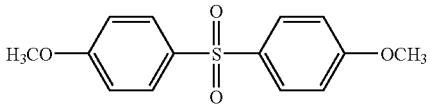

M3-7

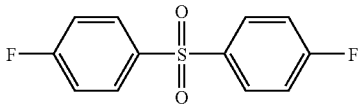

M3-8

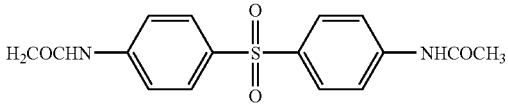

M3-9

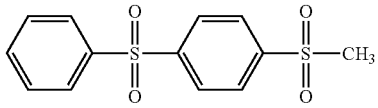

-continued

M3-10

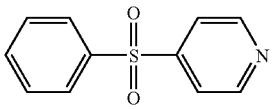

M3-11

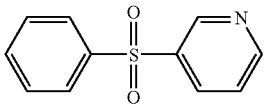

M3-12

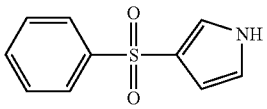

M3-13

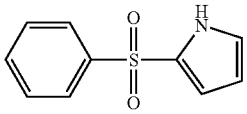

M3-14

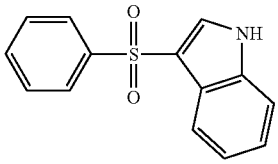

The melting point of the compound represented by formulae (M1) to (M3) is preferably the same or higher than that of a base precursor, more preferably, from 70° C. to 400° C., and further preferably, from 100° C. to 300° C.

In the invention, the total addition amount of the compound represented by formulae (M1) to (M3) is preferably 20 mass part to 200 mass part with respect to 100 mass part of the base precursor.

Further, because the compound represented by formulae (M1) to (M3) remains in a background of the image after decoloring the dye, it is preferred that the compound does not have a maximum absorption in a range from 400 nm to 700 nm and does not give substantially an unfavorable absorption in the photothermographic material. Also, as for absorption of 400 nm or less, it is preferable that the compound does not give substantially an unfavorable absorption.

By decoloring the dye in such a manner, the optical density after thermal development can be lowered to 0.1 or lower. Two or more types of thermal bleaching dyes may be used in combination in a photothermographic material. Similarly, two or more types of base precursors may be used in combination.

In a thermal decolorization by a bleaching dye and a base precursor, it is preferable from the viewpoint of thermal decoloring efficiency to comprise the substance capable of lowering the melting point by at least 3° C. when mixed with the base precursor (e.g., diphenylsulfone, 4-chlorophenyl (phenyl)sulfone, 2-naphthylbenzoate and the like) as disclosed in JP-A No. 11-352626.

3) Back layer

Back layers usable in the invention are described in paragraph Nos. 0128 to 0130 of JP-A No. 11-65021. In the present invention, a back layer may be an antihalation layer. To the back layer, various additives can be added as well as the antihalation dye described above.

In the invention, coloring matters having maximum absorption in the wavelength range from 300 nm to 450 nm may be added in order to improve color tone of developed silver images and a deterioration of the images during aging. Such coloring matters are described in JP-A Nos. 62-210458, 63-104046, 63-103235, 63-208846, 63-306436, 63-314535, 01-61745, 2001-100363, and the like.

Such coloring matters are generally added in the range from 0.1 mg/m$^2$ to 1 g/m$^2$.

Further, matting agents, lubricants, hardners, and surfactants and the like, which are described below, can be used.

The photothermographic material of the invention is preferably a so-called one-side photosensitive material, which comprises at least one layer of image forming layer containing silver halide emulsion on one side of the support, and a back layer on the other side.

(Non-photosensitive Organic Silver Salt)

1) Composition

The organic silver salt which can be used in the present invention is relatively stable to light but serves as to supply silver ions and forms silver images when heated to 80° C. or higher under the presence of an exposed photosensitive silver halide and a reducing agent. The organic silver salt may be any organic material containing a source capable of supplying silver ions that are reducible by a reducing agent. Such non-photosensitive organic silver salt is disclosed, for example, in JP-A No. 10-62899 (paragraph Nos. 0048 to 0049), EP-A No. 0803764A1 (page 18, line 24 to page 19, line 37), EP-A No. 0962812A1, JP-A Nos. 11-349591, 2000-7683, and 2000-72711, and the like. A silver salt of organic acid, particularly, a silver salt of long chained aliphatic carboxylic acid (having 10 to 30 carbon atoms, and preferably having 15 to 28 carbon atoms) is preferable. Preferred examples of the silver salt of fatty acid can include, for example, silver lignocerate, silver behenate, silver arachidinate, silver stearate, silver oleate, silver laurate, silver capronate, silver myristate, silver palmitate, silver erucate and mixtures thereof. In the invention, among these silver salts of fatty acid, it is preferred to use a silver salt of fatty acid with a silver behenate content of 50 mol % or more, more preferably, 85 mol % or more, and further preferably, 95 mol % or more. Further, it is preferred to use a silver salt of fatty acid with a silver erucate content of 2 mol % or less, more preferably, 1 mol % or less, and further preferably, 0.1 mol % or less.

It is preferred that the content of silver stearate is 1 mol % or less. When the content of silver stearate is 1 mol % or less, a silver salt of organic acid having low Dmin, high sensitivity and excellent image storability can be obtained. The above-mentioned content of silver stearate is preferably 0.5 mol % or less, and particularly preferably, silver stearate is not substantially contained.

Further, in the case where the silver salt of organic acid includes silver arachidinate, it is preferred that the content of silver arachidinate is 6 mol % or less in order to obtain a silver salt of organic acid having low Dmin and excellent image storability. The content of silver arachidinate is more preferably 3 mol % or less.

2) Shape

There is no particular restriction on the shape of the organic silver salt usable in the invention and it may needle-like, bar-like, tabular or flaky shape. In the invention, a flaky shaped organic silver salt is preferred. Short needle-like, rectangular, cuboidal or potato-like indefinite shaped particle with the major axis to minor axis ratio being 5 or less is also used preferably. Such organic silver particle has a feature less suffering from fogging during thermal development compared with long needle-like particles with the major axis to minor axis length ratio of more than 5. Particularly, a particle with the major axis to minor axis ratio of 3 or less is preferred since it can improve the mechanical stability of the coating film. In the present specification, the flaky shaped organic silver salt is defined as described below. When an organic acid silver salt is observed under an electron microscope, calculation is made while approximating the shape of an organic acid silver salt particle to a rectangular body and assuming each side of the rectangular body as a, b, c from the shorter side (c may be identical with b) and determining x based on numerical values a, b for the shorter side as below.

$$x=b/a$$

As described above, x is determined for the particles by the number of about 200 and those capable of satisfying the relation: x (average)≧1.5 as an average value x is defined as a flaky shape. The relation is preferably: 30≧x (average)≧1.5 and, more preferably, 15 ≧x (average)≧1.5. By the way, needle-like is expressed as 1≧x (average)≧1.5.

In the flaky shaped particle, a can be regarded as a thickness of a tabular particle having a main plate with b and c being as the sides. a in average is preferably 0.01 μm to 0.3 μm and, more preferably, 0.1 μm to 0.23 μm. c/b in average is preferably 1 to 9, more preferably 1 to 6, further preferably 1 to 4 and, most preferably 1 to 3.

By controlling the equivalent spherical diameter to 0.05 μm to 1 μm, it causes less agglomeration in the photothermographic material and image storability is improved. The equivalent spherical diameter is preferably 0.1 μm to 1 μm. In the invention, an equivalent spherical diameter can be measured by a method of photographing a sample directly by using an electron microscope and then image processing the negative images.

In the flaky shaped particle, the equivalent spherical diameter of the particle/a is defined as an aspect ratio. The aspect ratio of the flaky particle is, preferably, 1.1 to 30 and, more preferably, 1.1 to 15 with a viewpoint of causing less agglomeration in the photothermographic material and improving the image storability.

As the particle size distribution of the organic silver salt, monodispersion is preferred. In the monodispersion, the percentage for the value obtained by dividing the standard deviation for the length of minor axis and major axis by the minor axis and the major axis respectively is, preferably, 100% or less, more preferably, 80% or less and, further preferably, 50% or less. The shape of the organic silver salt can be measured by determining dispersion of an organic silver salt as transmission type electron microscopic images. Another method of measuring the monodispersion is a method of determining of the standard deviation of the volume weighted mean diameter of the organic silver salt in which the percentage for the value defined by the volume weight mean diameter (variation coefficient), is preferably, 100% or less, more preferably, 80% or less and, further preferably, 50% or less. The monodispersion can be determined from particle size (volume weighted mean diameter) obtained, for example, by a measuring method of irradiating a laser beam to organic silver salts dispersed in a liquid, and determining a self correlation function of the fluctuation of scattered light to the change of time.

3) Preparation

Methods known in the art may be applied to the method for producing the organic silver salt used in the invention and to the dispersing method thereof. For example, reference can be made to JP-A No. 10-62899, EP-A Nos. 0803763A1 and 0962812A1, JP-A Nos. 11-349591, 2000-7683, 2000-72711, 2001-163889, 2001-163890, 2001-163827, 2001-33907, 2001-188313, 2001-83652, 2002-6442, 2002-31870, 2002-107868, and the like.

When a photosensitive silver salt is present together during dispersion of the organic silver salt, fog increases and sensitivity becomes remarkably lower, so that it is more preferred that the photosensitive silver salt is not substantially contained during dispersion. In the invention, the amount of the photosensitive silver salt to be disposed in the aqueous dispersion, is preferably, 1 mol % or less, more preferably, 0.1 mol % or less per 1 mol of the organic acid silver salt in the solution and, further preferably, positive addition of the photosensitive silver salt is not conducted.

In the invention, the photosensitive material can be prepared by mixing an aqueous dispersion of an organic silver salt and an aqueous dispersion of a photosensitive silver salt and the mixing ratio between the organic silver salt and the photosensitive silver salt can be selected depending on the purpose. The ratio of the photosensitive silver salt to the organic silver salt is, preferably, in a range from 1 mol % to 30 mol %, more preferably, from 2 mol % to 20 mol % and, particularly preferably, 3 mol % to 15 mol %. A method of mix two or more kinds of aqueous dispersions of organic silver salts and two or more kinds of aqueous dispersions of photosensitive silver salts upon mixing is used preferably for controlling the photographic properties.

4) Addition Amount

While an organic silver salt in the invention can be used in a desired amount, a total amount of coated silver including silver halide is preferably in a range from 0.1 g/m$^2$ to 3.0 g/m$^2$, more preferably from 0.5 g/m$^2$ to 2.0 g/m$^2$, and further preferably from 0.8 g/m$^2$ to 1.7 g/m$^2$. Particularly, in order to improve image storability, the total amount of coated silver is preferably 1.5 mg/m$^2$ or less, and more preferably 1.3 mg/m$^2$ or less. When a preferable reducing agent in the invention is used, it is possible to obtain a sufficient image density by even such a low amount of silver.

(Reducing Agent for Non-photosensitive Organic Silver Salt)

The photothermographic material of the invention contains a reducing agent for the organic silver salt. The reducing agent may be any substance (preferably, organic substance) capable of reducing silver ions into metallic silver. Examples of the reducing agent are described in JP-A No. 11-65021 (column Nos. 0043 to 0045) and EP-A No. 0803764A1 (page 7, line 34 to page 18, line 12).

In the invention, a so-called hindered phenolic reducing agent or a bisphenol reducing agent having a substituent at the ortho-position to the phenolic hydroxy group is preferred. Particularly, the compound represented by the following formula (R) is preferred.

Formula (R)

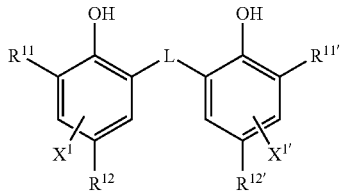

In formula (R), $R^{11}$ and $R^{11'}$ each independently represent an alkyl group having 1 to 20 carbon atoms. $R^{12}$ and $R^{12'}$ each independently represent one selected from a hydrogen atom and a substituent capable of substituting for a hydrogen atom on a benzene ring. L represents one selected from an —S— group and a —$CHR^{13}$— group. $R^{13}$ represents one selected from a hydrogen atom and an alkyl group having 1 to 20 carbon atoms. $X^1$ and $X^{1'}$ each independently represent one selected from a hydrogen atom and a group capable of substituting for a hydrogen atom on a benzene ring.

Formula (R) is explained in detail.

1) $R^{11}$ and $R^{11'}$ $R^{11}$ and $R^{11'}$ each independently represent a substituted or unsubstituted alkyl group having 1 to 20 carbon atoms. The substituent for the alkyl group has no particular restriction and can include, preferably, an aryl group, a hydroxy group, an alkoxy group, an aryloxy group, an alkylthio group, an arylthio group, an acylamino group, a sulfoneamide group, a sulfonyl group, a phosphoryl group, an acyl group, a carbamoyl group, an ester group, an ureido group, an urethane group, and a halogen atom.

2) $R^{12}$ and $R^{12'}$, $X^1$ and $X^{1'}$ $R^{12}$ and $R^{12'}$ each independently represent one of a hydrogen atom and a group capable of substituting for a hydorgen atom on a benzene ring. $X^1$ and $X^{1'}$ each independently represent one of a hydrogen atom and a group capable of substituting for a hydorgen atom on a benzene ring. Each of the groups capable of substituting for a hydrogen atom on the benzene ring can include, preferably, an alkyl group, an aryl group, a halogen atom, an alkoxy group, and an acylamino group.

3) L

L represents one of a —S— group and a —$CHR^{13}$— group. $R^{13}$ represents one of a hydrogen atom and an alkyl group having 1 to 20 carbon atoms in which the alkyl group may have a substituent. Specific examples of the unsubstituted alkyl group for $R^{13}$ can include, for example, a methyl group, an ethyl group, a propyl group, a butyl group, a heptyl group, an undecyl group, an isopropyl group, a 1-ethylpentyl group, a 2,4,4-trimethylpentyl group, a cyclohexyl group, a 2,4-dimetyl-3-cyclohexenyl group, a 3,5-dimethyl-3-cyclohexenyl group, and the like. Examples of the substituent for the alkyl group can include, similar to substituent of $R^{11}$, a halogen atom, an alkoxy group, an alkylthio group, an aryloxy group, an arylthio group, an acylamino group, a sulfoneamide group, a sulfonyl group, a phosphoryl group, an oxycarbonyl group, a carbamoyl group, a sulfamoyl group, and the like.

4) Preferred Subsituents $R^{11}$ and $R^{11'}$ are, preferably, a primary, secondary or tertiary alkyl group having 1 to 15 carbon atoms and can include, specifically, a methyl group, an isopropyl group, a t-butyl group, a t-amyl group, a t-octyl group, a cyclohexyl group, a cyclopentyl group, a 1-methylcyclohexyl group, a 1-methylcyclopropyl group and the like. $R^{11}$ and $R^{11'}$ each represent, more preferably, an alkyl group having 1 to 8 carbon atoms and, among them, a methyl group, a t-butyl group, a t-amyl group, and a 1-methylcyclohexyl group are further preferred and, and a methyl group and a t-butyl group being most preferred.

$R^{12}$ and $R^{12'}$ are, preferably, an alkyl group having 1 to 20 carbon atoms and can include, specifically, a methyl group, an ethyl group, a propyl group, a butyl group, an isopropyl group, a t-butyl group, a t-amyl group, a cyclohexyl group, a 1-methylcyclohexyl group, a benzyl group, a methoxymethyl group, a methoxyethyl group and the like. More preferred are a methyl group, an ethyl group, a propyl group, an isopropyl group, and a t-butyl group, and particularly preferred are a methyl group and an ethyl group.

$X^1$ and $X^{1'}$ are, preferably, a hydrogen atom, a halogen atom, or an alkyl group, and more preferably, a hydrogen atom.

L is preferably a —$CHR^{13}$— group.

$R^{13}$ is, preferably, a hydrogen atom or an alkyl group having 1 to 15 carbon atoms. The alkyl group is preferably a chain or a cyclic alkyl group. And, a group which has a C=C bond in these alkyl group is also preferably used. Preferable examples of the alkyl group can include a methyl group, an ethyl group, a propyl group, an isopropyl group, a 2,4,4-trimethylpentyl group, a cyclohexyl group, a 2,4-dimethyl-3-cyclohexenyl group, a 3,5-dimetyl-3-cyclohexenyl group and the like. Particularly preferable $R^{13}$ is a hydrogen atom, a methyl group, an ethyl group, a propyl group, an isopropyl group, or a 2,4-dimethyl-3-cyclohexenyl group.

In the case where $R^{11}$ and $R^{11'}$ are a tertiary alkyl group and $R^{12}$ and $R^{12'}$ are a methyl group, $R^{13}$ preferably is a primary or secondary alkyl group having 1 to 8 carbon atoms (a methyl group, an ethyl group, a propyl group, an isopropyl group, a 2,4-dimethyl-3-cyclohexenyl group, or the like).

In the case where $R^{11}$ and $R^{11'}$ are tertiary alkyl group and $R^{12}$ and $R^{12'}$ are an alkyl group other than a methyl group, $R^{13}$ preferably is a hydrogen atom.

In the case where $R^{11}$ and $R^{11'}$ are not a tertiary alkyl group, $R^{13}$ preferably is a hydrogen atom or a secondary alkyl group, and particularly preferably a secondary alkyl group. As the secondary alkyl group for $R^{13}$, an isopropyl group and a 2,4-dimethyl-3-cyclohexenyl group are preferred.

The reducing agent described above shows different thermal developing performances, color tones of developed silver images, or the like depending on the combination of $R^{11}$, $R^{11'}$, $R^{12}$, $R^{12'}$, and $R^{13}$. Since these performances can be controlled by using two or more kinds of reducing agents at various mixing ratios, it is preferred to use two or more kinds of reducing agents in combination depending on the purpose.

Specific examples of the reducing agents of the invention including the compounds represented by formula (R) according to the invention are shown below, but the invention is not restricted to them.

R-1

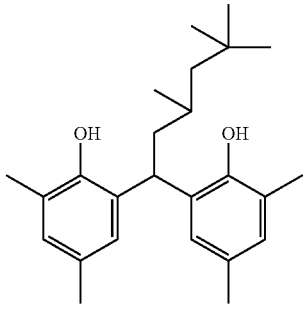

R-2

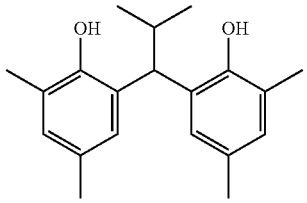

-continued
R-3
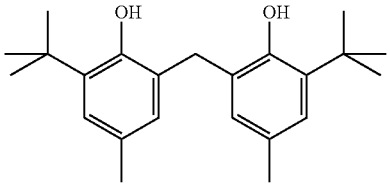
R-4
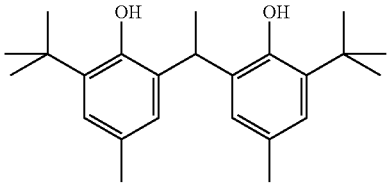
R-5
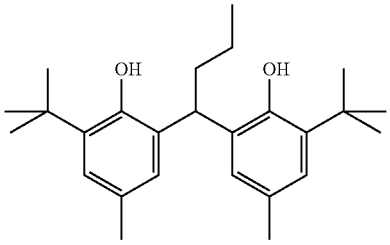
R-6
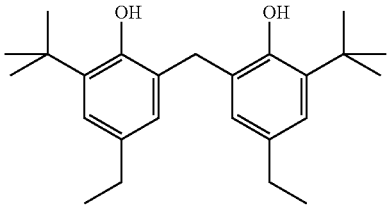
R-7
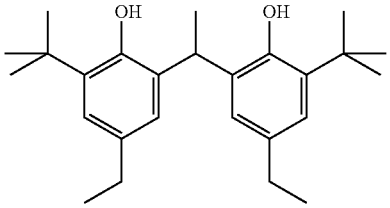
R-8
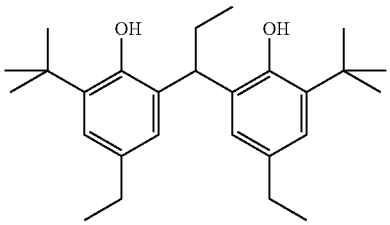
R-9
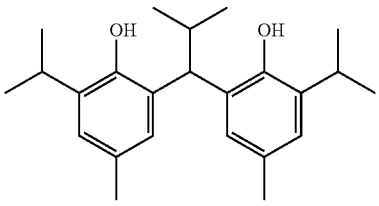
-continued
R-10
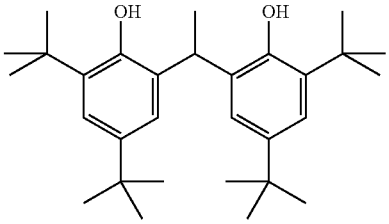
R-11
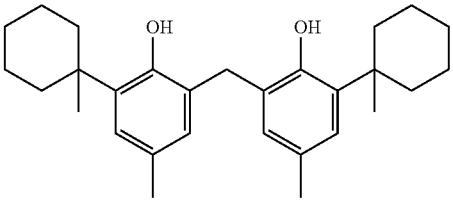
R-12
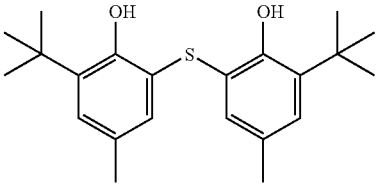
R-13
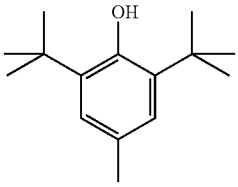
R-14
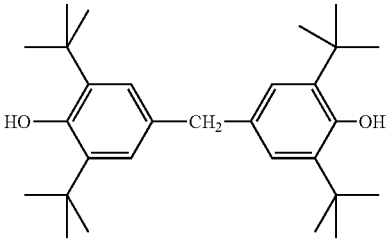
R-15
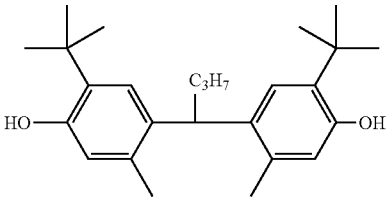
R-16
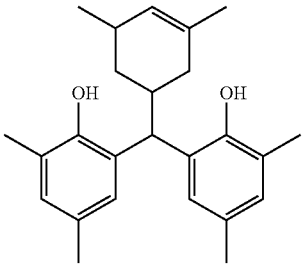

-continued

R-17

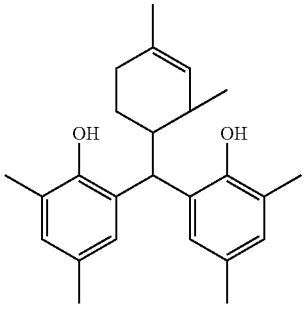

R-18

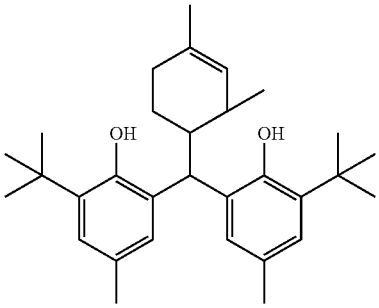

As preferred reducing agents of the invention other than those above, there can be mentioned compounds disclosed in JP-A Nos. 2001-188314, 2001-209145, 2001-350235, and 2002-156727, and EP No. 1278101A2.

In the invention, the addition amount of the reducing agent is, preferably, from 0.1 g/m$^2$ to 3.0 g/m$^2$, more preferably, 0.2 g/m$^2$ to 2.0 g/m$^2$ and, further preferably 0.3 g/m$^2$ to 1.0 g/m$^2$. It is, preferably, contained in a range of 5 mol % to 50 mol %, more preferably, 8 mol % to 30 mol % and, further preferably, 10 mol % to 20 mol % per 1 mol of silver in the surface having the image forming layer. The reducing agent of the invention is preferably contained in the image forming layer.

In the invention, the reducing agent may be incorporated into photothermographic material by being added into the coating solution, such as in the form of solution, emulsion dispersion, solid fine particle dispersion, and the like.

As a well known emulsion dispersing method, there can be mentioned a method comprising dissolving the reducing agent using an oil such as dibutyl phthalate, tricresyl phosphate, glyceryl triacetate, diethyl phthalate, or the like, as well as an auxiliary solvent such as ethyl acetate, cyclohexanone, and the like; from which an emulsion dispersion is mechanically produced.

As solid fine particle dispersing method, there can be mentioned a method comprising dispersing the powder of the reducing agent in a proper medium such as water, by means of ball mill, colloid mill, vibrating ball mill, sand mill, jet mill, roller mill, or ultrasonics, thereby obtaining solid dispersion. In this case, there can also be used a protective colloid (such as polyvinyl alcohol), or a surfactant (for instance, an anionic surfactant such as sodium triisopropylnaphthalenesulfonate (a mixture of compounds having the isopropyl groups in different substitution sites)). In the mills enumerated above, generally used as the dispersion media are beads made of zirconia and the like, and Zr and the like eluting from the beads may be incorporated in the dispersion. Although depending on the dispersing conditions, the amount of Zr and the like generally incorporated in the dispersion is in the range from 1 ppm to 1000 ppm. It is practically acceptable so long as Zr is incorporated in an amount of 0.5 mg or less per 1 g of silver.

Preferably, an antiseptic (for instance, sodium benzoisothiazolinone salt) is added in the water dispersion.

In the invention, furthermore, the reducing agent is preferably used as a solid particle dispersion, and the reducing agent is added in the form of fine particles having mean particle size from 0.01 μm to 10 μm, and more preferably, from 0.05 μm to 5 μm, and further preferably, from 0.1 μm to 2 μm. In the invention, other solid dispersions are preferably used with this particle size range.

(Photosensitive Silver Halide)

1) Halogen Composition

For the photosensitive silver halide used in the invention, there is no particular restriction on the halogen composition and silver chloride, silver bromochloride, silver bromide, silver iodobromide, silver iodochlorobromide and silver iodide can be used. Among them, silver bromide, silver iodobromide and silver iodide are preferred. The distribution of the halogen composition in a grain may be uniform or the halogen composition may be changed stepwise, or it may be changed continuously. Further, a silver halide grain having a core/shell structure can be used preferably. Preferred structure is a twofold to fivefold structure and, more preferably, core/shell grain having a twofold to fourfold structure can be used. Further, a technique of localizing silver bromide or silver iodide to the surface of a silver chloride, silver bromide or silver chlorobromide grains can also be used preferably.

2) Method of Grain Formation

The method of forming photosensitive silver halide is well-known in the relevant art and, for example, methods described in Research Disclosure No. 10729, June 1978 and U.S. Pat. No. 3,700,458 can be used. Specifically, a method of preparing a photosensitive silver halide by adding a silver-supplying compound and a halogen-supplying compound in a gelatin or other polymer solution and then mixing them with an organic silver salt is used. Further, a method described in JP-A No. 11-119374 (paragraph Nos. 0217 to 0224) and methods described in JP-A Nos. 11-352627 and 2000-347335 are also preferred.

3) Grain Size

The grain size of the photosensitive silver halide is preferably small with an aim of suppressing clouding after image formation and, specifically, it is 0.20 μm or less, more preferably, 0.01 μm to 0.15 μm and, further preferably, 0.02 μm to 0.12 μm. The grain size as used herein means an average diameter of a circle converted such that it has a same area as a projected area of the silver halide grain (projected area of a main plane in a case of a tabular grain).

4) Grain Shape

The shape of the silver halide grain can include, for example, cubic, octahedral, tabular, spherical, rod-like or potato-like shape. The cubic grain is particularly preferred in the invention. A silver halide grain rounded at corners can also be used preferably. The surface indices (Miller indices) of the outer surface of a photosensitive silver halide grain is not particularly restricted, and it is preferable that the ratio occupied by the [100] face is rich, because of showing high spectral sensitization efficiency when a spectral sensitizing dye is adsorbed. The ratio is preferably 50% or more, more preferably 65% or more, and further preferably 80% or more. The ratio of the [100] face, Miller indices, can be determined by a method described in T. Tani; J. Imaging Sci., vol. 29, page 165, (1985) utilizing adsorption dependency of the [111] face and [100] face in adsorption of a sensitizing dye.

5) Heavy Metal

The photosensitive silver halide grain of the invention can contain metals or complexes of metals belonging to groups 3 to 13 of the periodic table (showing groups 1 to 18). Preferred are metals or complexes of metals belonging to groups 6 to 10. The metal or the center metal of the metal complex from groups 6 to 10 of the periodic table is preferably ferrum, rhodium, ruthenium or iridium. The metal complex may be used alone, or two or more kinds of complexes comprising identical or different species of metals may be used together. A preferred content is in a range from $1\times10^{-9}$ mol to $1\times10^{-3}$ mol per 1 mol of silver. The heavy metals, metal complexes and the adding method thereof are described in JP-A No. 7-225449, in paragraph Nos. 0018 to 0024 of JP-A No. 11-65021 and in paragraph Nos. 0227 to 0240 of JP-A No. 11-119374.

In the present invention, a silver halide grain having a hexacyano metal complex is present on the outermost surface of the grain is preferred. The hexacyano metal complex includes, for example, $[Fe(CN)_6]^{4-}$; $[Fe(CN)_6]^{3-}$, $[Ru(CN)_6]^{4-}$, $[Os(CN)_6]^{4-}$, $[Co(CN)_6]^{3-}$, $[Rh(CN)_6]^{3-}$, $[Ir(CN)_6]^{3-}$, $[Cr(CN)_6]^{3-}$, and $[Re(CN)_6]^{3-}$. In the invention, hexacyano Fe complex is preferred.

Since the hexacyano complex exists in ionic form in an aqueous solution, paired cation is not important and alkali metal ion such as sodium ion, potassium ion, rubidium ion, cesium ion and lithium ion, ammonium ion, alkyl ammonium ion (for example, tetramethyl ammonium ion, tetraethyl ammonium ion, tetrapropyl ammonium ion, and tetra (n-butyl) ammonium ion), which are easily misible with water and suitable to precipitation operation of a silver halide emulsion are preferably used.

The hexacyano metal complex can be added while being mixed with water, as well as a mixed solvent of water and an appropriate organic solvent miscible with water (for example, alcohols, ethers, glycols, ketones, esters and amides) or gelatin.

The addition amount of the hexacyano metal complex is preferably from $1\times10^{-5}$ mol to $1\times10^{-2}$ mol and, more preferably, from $1\times10^{-4}$ mol to $1\times10^{-3}$ per 1 mol of silver in each case.

In order to allow the hexacyano metal complex to be present on the outermost surface of a silver halide grain, the hexacyano metal complex is directly added in any stage of: after completion of addition of an aqueous solution of silver nitrate used for grain formation, before completion of emulsion formation step prior to a chemical sensitization step, of conducting chalcogen sensitization such as sulfur sensitization, selenium sensitization and tellurium sensitization or noble metal sensitization such as gold sensitization, during washing step, during dispersion step and before chemical sensitization step. In order not to grow the fine silver halide grain, the hexacyano metal complex is rapidly added preferably after the grain is formed, and it is preferably added before completion of the emulsion formation step.

Addition of the hexacyano complex may be started after addition of 96% by weight of an entire amount of silver nitrate to be added for grain formation, more preferably started after addition of 98% by weight and, particularly preferably, started after addition of 99% by weight.

When any of the hexacyano metal complex is added after addition of an aqueous silver nitrate just before completion of grain formation, it can be adsorbed to the outermost surface of the silver halide grain and most of them form an insoluble salt with silver ions on the surface of the grain. Since the hexacyano iron (II) silver salt is a less soluble salt than AgI, re-dissolution with fine grains can be prevented and fine silver halide grains with smaller grain size can be prepared.

Metal atoms that can be contained in the silver halide grain used in the invention (for example, $[Fe(CN)_6]^{4-}$), desalting method of a silver halide emulsion and chemical sensitizing method are described in paragraph Nos. 0046 to 0050 of JP-A No. 11-84574, in paragraph Nos. 0025 to 0031 of JP-A No. 11-65021, and paragraph Nos. 0242 to 0250 of JP-A No. 11-119374.

6) Gelatin

As the gelatin contained the photosensitive silver halide emulsion used in the invention, various kinds of gelatins can be used. It is necessary to maintain an excellent dispersion state of a photosensitive silver halide emulsion in an organic silver salt containing coating solution, and gelatin having a molecular weight of 10,000 to 1,000,000 is preferably used. And phthalated gelatin is also preferably used. These gelatins may be used at grain formation step or at the time of dispersion after desalting treatment and it is preferably used at grain formation step.

7) Sensitizing Dye

As the sensitizing dye applicable in the invention, those capable of spectrally sensitizing silver halide grains in a desired wavelength region upon adsorption to silver halide grains having spectral sensitivity suitable to spectral characteristic of an exposure light source can be selected advantageously. The sensitizing dyes and the adding method are disclosed, for example, JP-A No. 11-65021 (paragraph Nos. 0103 to 0109), as a compound represented by the formula (II) in JP-A No. 10-186572, dyes represented by the formula (I) in JP-A No. 11-119374 (paragraph No. 0106), dyes described in U.S. Pat. Nos. 5,510,236 and 3,871,887 (Example 5), dyes disclosed in JP-A Nos. 2-96131 and 59-48753, as well as in page 19, line 38 to page 20, line 35 of EP-A No. 0803764A1, and in JP-A Nos. 2001-272747, 2001-290238 and 2002-23306. The sensitizing dyes described above may be used alone or two or more of them may be used in combination. In the invention, sensitizing dye can be added preferably after desalting step and before coating step, and more preferably after desalting step and before the completion of chemical ripening.

In the invention, the sensitizing dye may be added at any amount according to the property of sensitivity and fogging, but it is preferably added from $10^{-6}$ mol to 1 mol, and more preferably from $10^{-4}$ mol to $10^{-1}$ mol, per 1 mol of silver halide in the image forming layer.

The photothermographic material of the invention may also contain super sensitizers in order to improve spectral sensitizing effect. The super sensitizers usable in the invention can include those compounds described in EP-A No. 587338, U.S. Pat. Nos. 3,877,943 and 4,873,184 and JP-A Nos. 5-341432, 11-109547, and 10-111543.

8) Chemical Sensitization

The photosensitive silver halide grain in the invention is preferably chemically sensitized by sulfur sensitizing method, selenium sensitizing method or tellurium sensitizing method. As the compound used preferably for sulfur sensitizing method, selenium sensitizing method and tellurium sensitizing method, known compounds, for example, compounds described in JP-A No. 7-128768 can be used. Particularly, tellurium sensitization is preferred in the invention and compounds described in the literature cited in paragraph No. 0030 in JP-A No. 11-65021 and compounds shown by formulae (II), (III), and (IV) in JP-A No. 5-313284 are more preferred.

The photosensitive silver halide grain in the invention is preferably chemically sensitized by gold sensitizing method alone or in combination with the chalcogen sensitization described above. As the gold sensitizer, those having a pxidation number of gold of either +1 or +3 are preferred and those gold compounds used usually as the gold sensitizer are preferred. As typical examples, chloroauric acid, bromoauric acid, potassium chloroaurate, potassium bromoaurate, auric trichloride, potassium auric thiocyanate, potassium iodoaurate, tetracyanoauric acid, ammonium aurothiocyanate and pyridyl trichloro gold are preferred. Further, gold sensitizers described in U.S. Pat. No. 5,858,637 and JP-A No. 2002-278016 are also used preferably.

In the invention, chemical sensitization can be applied at any time so long as it is after grain formation and before coating and it can be applied, after desalting, (1) before spectral sensitization, (2) simultaneously with spectral sensitization, (3) after spectral sensitization and (4) just before coating.

The amount of sulfur, selenium and tellurium sensitizer used in the invention may vary depending on the silver halide grain used, the chemical ripening condition and the like and it is used by about $10^{-8}$ mol to $10^{-2}$ mol, preferably, $10^{-7}$ mol to $10^{-3}$ mol per 1 mol of silver halide.

The addition amount of the gold sensitizer may vary depending on various conditions and it is generally about $10^{-7}$ mol to $10^{-3}$ mol and, more preferably, $10^{-6}$ mol to $5\times10^{-4}$ mol per 1 mol of silver halide.

There is no particular restriction on the condition for the chemical sensitization in the invention and, appropriately, pH is 5 to 8, pAg is 6 to 11 and temperature is at 40° C. to 95° C.

In the silver halide emulsion used in the invention, a thiosulfonic acid compound may be added by the method shown in EP-A No. 293917.

A reductive compound is used preferably for the photosensitive silver halide grain in the invention. As the specific compound for the reduction sensitization, ascorbic acid or thiourea dioxide is preferred, as well as use of stannous chloride, aminoimino methane sulfonic acid, hydrazine derivatives, borane compounds, silane compounds and polyamine compounds are preferred. The reduction sensitizer may be added at any stage in the photosensitive emulsion production process from crystal growth to the preparation step just before coating. Further, it is preferred to apply reduction sensitization by ripening while keeping pH to 7 or higher or pAg to 8.3 or lower for the emulsion, and it is also preferred to apply reduction sensitization by introducing a single addition portion of silver ions during grain formation.

9) Compound that can be One-electron-oxidized to Provide a One-electron Oxidation Product which Releases One or More Electrons The photothermographic material of the invention preferably contains a compound that can be one-electron-oxidized to provide a one-electron oxidation product which releases one or more electrons. The said compound can be used alone or in combination with various chemical sensitizers described above to increase the sensitivity of silver halide.

As the compound that can be one-electron-oxidized to provide a one-electron oxidation product which releases one or more electrons is a compound selected from the following Groups 1 and 2.

(Group 1) A compound that can be one-electron-oxidized to provide a one-electron oxidation product which further releases one or more electrons, due to being subjected to a subsequent bond cleavage reaction;

(Group 2) a compound that can be one-electron-oxidized to provide a one-electron oxidation product, which further releases one or more electrons after being subjected to a subsequent bond formation.

The compound of Group 1 will be explained below.

In the compound of Group 1, as for a compound that can be one-electron-oxidized to provide a one-electron oxidation product which further releases one electron, due to being subjected to a subsequent bond cleavage reaction, specific examples include examples of compound referred to as "one photon two electrons sensitizer" or "deprotonating electron-donating sensitizer" described in JP-A No. 9-211769 (Compound PMT-1 to S-37 in Tables E and F, pages 28 to 32); JP-A No. 9-211774; JP-A No. 11-95355 (Compound INV 1 to 36); JP-W No. 2001-500996 (Compound 1 to 74, 80 to 87, and 92 to 122); U.S. Pat. Nos. 5,747,235 and 5,747,236; EP No. 786692 A1 (Compound INV 1 to 35); EP No. 893732 A1; U.S. Pat. Nos. 6,054,260 and 5,994,051; etc. Preferred ranges of these compounds are the same as the preferred ranges described in the quoted specifications.

In the compound of Group 1, as for a compound that can be one-electron-oxidized to provide a one-electron oxidation product which further releases one or more electrons, due to being subjected to a subsequent bond cleavage reaction, specific examples include the compounds represented by formula (1) (same as formula (1) described in JP-A No. 2003-114487), formula (2) (same as formula (2) described in JP-A No. 2003-114487), formula (3) (same as formula (1) described in JP-A No. 2003-114488), formula (4) (same as formula (2) described in JP-A No. 2003-114488), formula (5) (same as formula (3) described in JP-A No. 2003-114488), formula (6) (same as formula (1) described in JP-A No. 2003-75950), formula (7) (same as formula (2) described in JP-A No. 2003-75950), and formula (8), and the compound represented by formula (9) among the compounds which can undergo the chemical reaction represented by reaction formula (1). And the preferable range of these compounds is the same as the preferable range described in the quoted specification.

Formula (1)

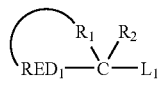

Formula (2)

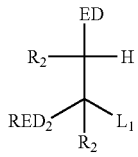

Formula (3)

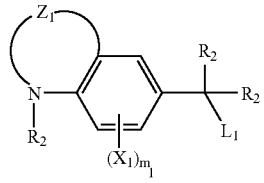

-continued

Formula (4)

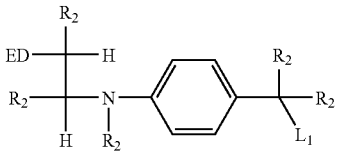

Formula (5)

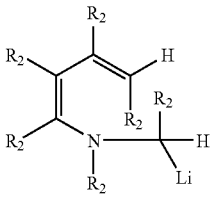

Formula (6)

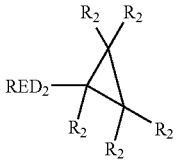

Formula (7)

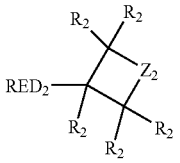

Formula (8)

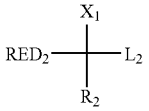

Reaction formula (1)

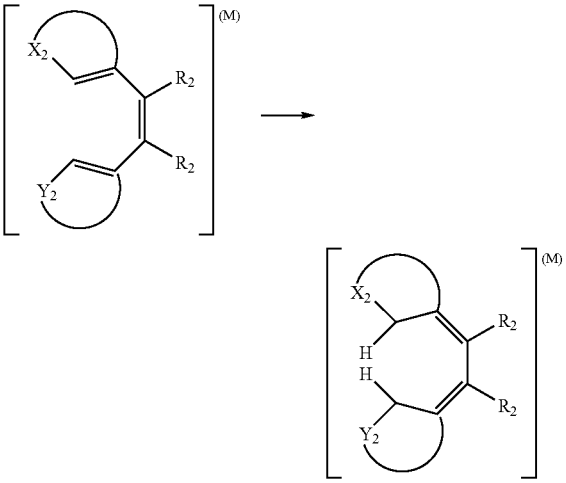

Formula (9)

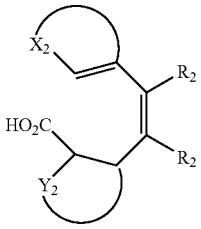

In the formulae, $RED_1$ and $RED_2$ represent a reducible group. $R_1$ represents a nonmetallic atomic group forming a cyclic structure equivalent to a tetrahydro derivative or an octahydro derivative of a 5 or 6 membered aromatic ring (including a hetero aromatic ring) with a carbon atom (C) and $RED_1$. $R_2$ represents a hydrogen atom or a substituent. In the case where plural $R_2$ exist in a same molecule, these may be identical or different from each other. $L_1$ represents a leaving group. ED represents an electron-donating group. $Z_1$ represents an atomic group capable to form a 6 membered ring with a nitrogen atom and two carbon atoms of a benzene ring. $X_1$ represents a substituent, and $m_1$ represents an integer of 0 to 3. $Z_2$ represents one selected from —$CR_{11}R_{12}$—, —$NR_{13}$—, or —O—. $R_{11}$ and $R_{12}$ each independently represent a hydrogen atom or a substituent. $R_{13}$ represents one selected from a hydrogen atom, an alkyl group, an aryl group, and a heterocyclic group. $X_1$ represents one selected from an alkoxy group, an aryloxy group, a heterocyclic oxy group, an alkylthio group, an arylthio group, a heterocyclic thio group, an alkylamino group, an arylamino group, and a heterocyclic amino group. $L_2$ represents a carboxyl group or a salt thereof, or a hydrogen atom. $X_2$ represents a group to form a 5 membered heterocycle with C═C. M represents one selected from a radical, a radical cation, and a cation.

Next, the compound of Group 2 is explained.

In the compound of Group 2, as for a compound that can be one-electron-oxidized to provide a one-electron oxidation product which further releases one or more electrons, after being subjected to a subsequent bond cleavage reaction, specific examples can include the compound represented by formula (10) (same as formula (1) described in JP-A No. 2003-140287), and the compound represented by formula (10) which can undergo the chemical reaction represented by reaction formula (1). The preferable range of these compounds is the same as the preferable range described in the quoted specification.

Formula (10)

$$X—L_2—Y$$

Reaction formula (1)

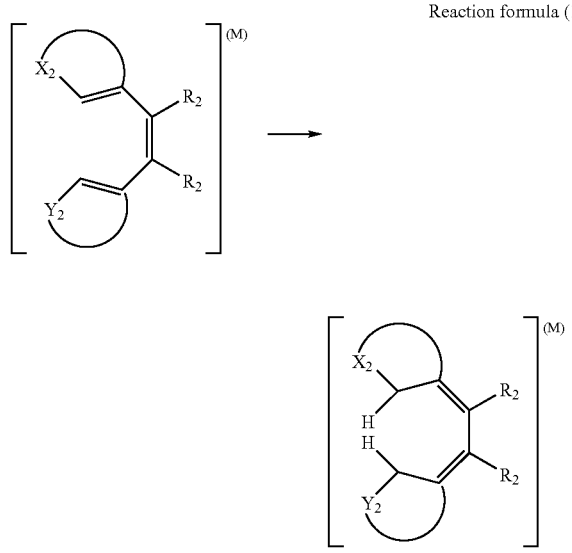

-continued

Formula (11)

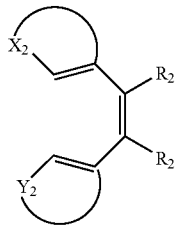

In the formulae described above, X represents a reducible group which can be one-electron-oxidized. Y represents a reactive group containing a carbon-carbon double bond part, a carbon-carbon triple bond part, an aromatic group part or benzo-condensed nonaromatic heterocyclic group which can react with one-electron-oxidized product formed by one-electron-oxidation of X to form a new bond. $L_2$ represents a linking group to link X and Y. $R_2$ represents a hydrogen atom or a substituent. In the case where plural $R_2$ exist in a same molecule, these may be identical or different from each other. $X_2$ represents a group to form a 5 membered heterocycle with C═C. $Y_2$ represents a group to form a 5 or 6 membered aryl group or heterocyclic group with C═C. M represents one selected from a radical, a radical cation, and a cation.

The compounds of Groups 1 and 2 preferably are "the compound having an adsorptive group to silver halide in a molecule" or "the compound having a partial structure of a spectral sensitizing dye in a molecule". The representative adsorptive group to silver halide is the group described in JP-A No. 2003-156823, page 16 right, line 1 to page 17 right, line 12. A partial structure of a spectral sensitizing dye is the structure described in JP-A No. 2003-156823, page 17 right, line 34 to page 18 right, line 6.

As the compound of Groups 1 and 2, "the compound having at least one adsorptive group to silver halide in a molecule" is more preferred, and "the compound having two or more adsorptive groups to silver halide in a molecule" is further preferred. In the case where two or more adsorptive groups exist in a single molecule, those adsorptive groups may be identical or different with each other.

As preferable adsorptive group, a nitrogen containing heterocyclic group substituted by a mercapto group (e.g., a 2-mercaptothiazole group, a 3-mercapto-1,2,4-triazole group, a 5-mercaptotetrazole group, a 2-mercapto-1,3,4-oxadiazole group, a 2-mercaptobenzoxazole group, a 2-mercaptobenzothiazole group, a 1,5-dimethyl-1,2,4-triazolium-3-thiolate group and the like) or a nitrogen containing heterocyclic group having —NH— group as a partial structure of heterocycle capable to form a silver imidate (>NAg) (e.g., a benzotriazole group, a benzimidazole group, an indazole group and the like) are described. A 5-mercaptotetrazole group, a 3-mercapto-1, 2,4-triazole group and a benzotriazole group are particularly preferable and a 3-mercapto-1,2,4-triazole group and a 5-mercaptotetrazole group are most preferable.

As an adsorptive group, the group which has two or more mercapto groups as a partial structure in a molecule is also particularly preferable. Herein, a mercapto group (—SH) may become a thione group in the case where it can tautomerize. As preferred examples of adsorptive group having two or more mercapto groups as a partial structure (dimercapto-substituted nitrogen containing heterocyclic group and the like), a 2,4-dimercaptopyrimidine group, a 2,4-dimercaptotriazine group and a 3,5-dimercapto-1,2,4-triazole group are described.

Further, a quaternary salt structure of nitrogen or phosphorus is also preferably used as an adsorptive group. As typical quaternary salt structure of nitrogen, an ammonio group (a trialkylammonio group, a dialkylarylammonio group, a dialkylheteroarylammonio group, an alkyldiarylammonio group, an alkyldiheteroarylammonio group and the like) and a nitrogen containing heterocyclic group containing quaternary nitrogen atom are described. As a quaternary salt structure of phosphorus, a phosphonio group (a trialkylphosphonio group, a dialkylarylphosphonio group, a dialkylheteroarylphosphonio group, an alkyldiarylphosphonio group, an alkyldiheteroarylphosphonio group, a triarylphosphonio group, a triheteroarylphosphonio group and the like) are described. A quaternary salt structure of nitrogen is more preferably used and a 5 or 6 membered aromatic heterocyclic group containing a quaternary nitrogen atom is further preferably used. Particularly preferably, a pyrydinio group, a quinolinio group and an isoquinolinio group are used. These nitrogen containing heterocyclic groups containing a quaternary nitrogen atom may have any substituent.

As examples of counter anion of quaternary salt, halogen ion, carboxylate ion, sulfonate ion, sulfate ion, perchlorate ion, carbonate ion, nitrate ion, $BF_4^-$, $PF_6^-$, $Ph_4^-$ and the like are described. In the case where the group having negative charge at carboxylate group and the like exists in a molecule, an inner salt may be formed with it. As a counter ion outside of a molecule, chloro ion, bromo ion and methanesulfonate ion are particularly preferable.

The preferred structure of the compound represented by Group 1 and 2 compound having a quaternary salt of nitrogen or phosphorus as an adsorptive group is represented by formula (X).

$$(P\text{-}Q_1\text{-})_i\text{-}R(\text{-}Q_2\text{-}S)_j \qquad \text{Formula (X)}$$

In formula (X), P and R each independently represent a quaternary salt structure of nitrogen or phosphorus, which is not a partial structure of a spectral sensitizing dye. $Q_1$ and $Q_2$ each independently represent a linking group and typically represent a single bond, an alkylene group, an arylene group, a heterocyclic group, —O—, —S—, —$NR_N$, —C(═O)—, —$SO_2$—, —SO—, —P(═O)— and the which consists of combination of these groups. Herein, $R_N$ represents one selected from a hydrogen atom, an alkyl group, an aryl group, and a heterocyclic group. S represents a residue which is obtained by removing one atom from the compound represented by Group 1 or 2. i and j are an integer of one or more and are selected in a range of i+j=2 to 6. The case where i is 1 to 3 and j is 1 to 2 is preferable, the case where i is 1 or 2 and j is 1 is more preferable, and the case where i is 1 and j is 1 is particularly preferable. The compound represented by formula (X) preferably has 10 to 100 carbon atoms in total, more preferably 10 to 70 carbon atoms, further preferably 11 to 60 carbon atoms, and particularly preferably 12 to 50 carbon atoms in total.

The compounds of Groups 1 and 2 may be used at any time during preparation of the photosensitive silver halide emulsion and production of the photothermographic material. For example, the compound may be used in a photosensitive silver halide grain formation step, in a desalting step, in a chemical sensitization step, and before coating, etc. The compound may be added in several times, during these steps. The compound is preferably added, after the photosensitive silver halide grain formation step and before the desalting step; in the chemical sensitization step (just before the chemical sensitization to immediately after the chemical sensitization); or before coating. The compound is more preferably added, just before the chemical sensitization step to before mixing with the non-photosensitive organic silver salt.

It is preferred that the compound of Groups 1 and 2 used in the invention is dissolved in water, a water-soluble solvent such as methanol and ethanol, or a mixed solvent thereof, to be added. In the case where the compound is dissolved in water and solubility of the compound is increased by increasing or decreasing a pH value of the solvent, the pH value may be increased or decreased to dissolve and add the compound.

The compound of Groups 1 and 2 used in the invention is preferably used to the image forming layer comprising the photosensitive silver halide and the non-photosensitive organic silver salt. The compound may be added to a surface protective layer, or an intermediate layer, as well as the image forming layer comprising the photosensitive silver halide and the non-photosensitive organic silver salt, to be diffused to the image forming layer in the coating step. The compound may be added before or after addition of a sensitizing dye. Each compound is contained in the image forming layer preferably in an amount of $1\times10^{-9}$ mol to $5\times10^{-1}$ mol, more preferably $1\times10^{-8}$ mol to $5\times10^{-2}$ mol, per 1 mol of silver halide.

10) Compound having Adsorptive Group and Reducible Group

The photothermographic material of the present invention preferably comprises a compound having an adsorptive group and a reducible group in a molecule. It is preferred that the compound having an adsorptive group and a reducible group used in the invention is represented by the following formula (I).

A-(W)n-B Formula (I)

In formula (I), A represents a group capable of adsorption to a silver halide (hereafter, it is called an adsorptive group), W represents a divalent linking group, n represents 0 or 1, and B represents a reducible group.

In formula (I), the adsorptive group represented by A is a group to adsorb directly to a silver halide or a group to promote adsorption to a silver halide. As typical examples, a mercapto group (or a salt thereof), a thione group (—C(═S)—), a nitrogen atom, a heterocyclic group containing at least one atom selected from a nitrogen atom, a sulfur atom, a selenium atom and a tellurium atom, a sulfide group, a disulfide group, a cationic group, an ethynyl group and the like are described.

The mercapto group as an adsorptive group means a mercapto group (and a salt thereof) itself and simultaneously more preferably represents a heterocyclic group or an aryl group or an alkyl group substituted by at least one mercapto group (or a salt thereof). Herein, as the heterocyclic group, a monocyclic or a condensed aromatic or nonaromatic heterocyclic group having at least a 5 to 7 membered ring, e.g., an imidazole ring group, a thiazole ring group, an oxazole ring group, a benzimidazole ring group, a benzothiazole ring group, a benzoxazole ring group, a triazole ring group, a thiadiazole ring group, an oxadiazole ring group, a tetrazole ring group, a purine ring group, a pyridine ring group, a quinoline ring group, an isoquinoline ring group, a pyrimidine ring group, a triazine ring group and the like are described. A heterocyclic group having a quaternary nitrogen atom may also be adopted, wherein a mercapto group as a substituent may dissociate to form a mesoion. As a counter ion, whereby a mercapto group forms a salt thereof, a cation such as an alkali metal, an alkali earth metal, a heavy metal and the like ($Li^+$, $Na^+$, $K^+$, $Mg^{2+}$, $Ag^+$, $Zn^{2+}$ and the like), an ammonium ion, a heterocyclic group comprising a quaternary nitrogen atom, a phosphonium ion and the like are described.

Further, the mercapto group as an adsorptive group may become a thione group by a tautomerization.

The thione group as an adsorptive group may also contain a chain or a cyclic thioamide group, a thioureido group, a thiouretane group or a dithiocarbamic acid ester group.

The heterocyclic group containing at least one atom selected from a nitrogen atom, a sulfur atom, a selenium atom and a tellurium atom represents a nitrogen atom containing heterocyclic group having —NH— group, as a partial structure of heterocycle, capable to form a silver iminate (>NAg) or a heterocyclic group, having —S— group, —Se— group, —Te— group or ═N— group as a partial structure of heterocycle, and capable to coordinate to a silver ion by a chelate bonding. As the former examples, a benzotriazole group, a triazole group, an indazole group, a pyrazole group, a tetrazole group, a benzimidazole group, a purine group and the like are described. As the latter examples, a thiophene group, a thiazole group, a benzoxazole group, a thiadiazole group, an oxadiazole group, a triazine group, a selenoazole group, a benzoselenazole group, a tellurazole group, a benzotellurazole group and the like are described.

The sulfide group or disulfide group as an adsorptive group contains all groups having "—S—" or "—S—S—" as a partial structure.

The cationic group as an adsorptive group means the group containing a quaternary nitrogen atom, such as an amrnonio group or a nitrogen containing heterocyclic group including a quaternary nitrogen atom. As examples of the heterocyclic group containing a quaternary nitrogen atom, a pyridinio group, a quinolinio group, an isoquinolinio group, an imidazolio group and the like are described.

The ethynyl group as an adsorptive group means —C≡CH group and the said hydrogen atom may be substituted.

The adsorptive group described above may have any substituent.

Further, as typical examples of an adsorptive group, the compounds described in pages 4 to 7 in the specification of JP-A No. 11-95355 are described.

As an adsorptive group represented by A in formula (I), a heterocyclic group substituted by a mercapto group (e.g., a 2-mercaptothiadiazole group, a 2-mercapto-5-aminothiadiazole group, a 3-mercapto-1,2,4-triazole group, a 5-mercaptotetrazole group, a 2-mercapto-1,3,4-oxadiazole group, a 2-mercaptobenzimidazole group, a 1,5-dimethyl-1,2,4-triazorium-3-thiolate group, a 2,4-dimercaptopyrimidine group, a 2,4- dimercaptotriazine group, a 3,5-dimercapto-1,2,4-triazole group, a 2,5-dimercapto-1,3-thiazole group and the like) or a nitrogen atom containing heterocyclic group having a —NH— group capable to form an imino-silver (>NAg) as a partial structure of heterocycle (e.g., a benzotriazole group, a benzimidazole group, an indazole group and the like) is preferable, and more preferable as an adsorptive group is a 2-mercaptobenzimidazole group or a 3,5-dimercapto-1,2,4-triazole group.

In formula (I), W represents a divalent linking group. The said linking group may be any divalent linking group, as far as it does not give a bad effect toward photographic properties. For example, a divalent linking group, which includes a carbon atom, a hydrogen atom, an oxygen atom a nitrogen atom and a sulfur atom, can be used. As typical examples, an alkylene group having 1 to 20 carbon atoms (e.g., a methylene group, an ethylene group, a trimethylene group, a tetramethylene group, a hexamethylene group and the like), an alkenylene group having 2 to 20 carbon atoms, an alkynylene group having 2 to 20 carbon atoms, an arylene group having 6 to 20 carbon atoms (e.g., a phenylene group, a nephthylene group and the like), —$CONR_1$—, —$SO_2NR_2$—, —O—, —S—, —$NR_3$—, —$NR_4CO$—, —$NR_5SO_2$—, —$NR_6CONR_7$—, —COO—, —OCO— and the combination of these linking groups are described. Herein, $R_1$ represents a hydrogen atom, an alkyl group, a heterocyclic group, or an aryl group.

The linking group represented by W may have any substituent.

In formula (I), a reducible group represented by B represents the group capable to reduce a silver ion. As the examples, a formyl group, an amino group, a triple bond group such as an acetylene group, a propargyl group and the like, a mercapto group, hydroxylamines, hydroxamic acids, hydroxyureas, hydroxyurethanes, hydroxysemicarbazides, reductones (reductone derivatives are contained), anilines, phenols (chroman-6-ols, 2,3-dihydrobenzofuran-5-ols, aminophenols, sulfonamidophenols and polyphenols such as hydroquinones, catechols, resorcinols, benzenetriols, bisphenols are contained), aclhydrazines, carbamoylhydrazides and a residue which is obtained by removing one hydrogen atom from 3-pyrazolidones and the like can be described. They may have any substituent.

The oxidation potential of a reducible group represented by B in formula (I), can be measured by using the measuring method described in Akira Fujishima, "DENKIKAGAKU SOKUTEIHO", pages 150 to 208, GIHODO SHUPPAN and The Chemical Society of Japan, "ZIKKEN KAGAKUKOZA", 4th ed., vol. 9, pages 282 to 344, MARUZEN. For example, the method of rotating disc voltammetry can be used; namely the sample is dissolved in the solution (methanol: pH 6.5 Britton-Robinson buffer=10%:90% (% by volume)) and after bubbling with nitrogen gas during 10 minutes the voltamograph can be measured under the condition of 1000 rotations/minute, the sweep rate 20 mV/second, at 25° C. by using a rotating disc electrode (RDE) made by glassy carbon as a working electrode, a platinum electrode as a counter electrode and a saturated calomel electrode as a reference electrode. The half wave potential (E1/2) can be calculated by that obtained voltamograph.

When a reducible group represented by B in the present invention is measured by the method described above, an oxidation potential is preferably in a range of about −0.3 V to about 1.0 V, more preferably about −0.1 V to about 0.8 V, and particularly preferably about 0 V to about 0.7 V.

In formula (1), a reducible group represented by B preferably is hydroxylamines, hydroxamic acids, hydroxyureas, hydroxysemicarbazides, reductones, phenols, acylhydrazines, carbamoylhydrazides, or a residue which is obtained by removing one hydrogen atom from 3-pyrazolidones and the like.

The compound of formula (1) in the present invention may have the ballasted group or polymer chain in it generally used in the non-moving photographic additives as a coupler. And as a polymer, for example, the polymer described in JP-A No. 1-100530 can be described.

The compound of formula (I) in the present invention may be bis or tris type of compound. The molecular weight of the compound represented by formula (I) in the present invention is preferably 100 to 10,000 and more preferably 120 to 1,000 and particularly preferably 150 to 500.

The examples of the compound represented by formula (I) in the present invention are shown below, but the present invention is not limited in these.

(1)

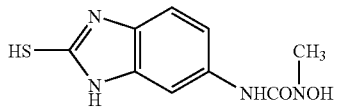

(2)

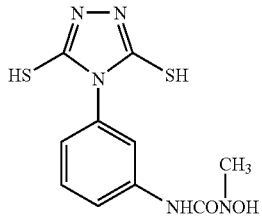

(3)

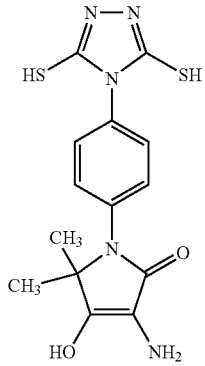

(4)

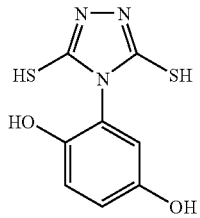

(5)

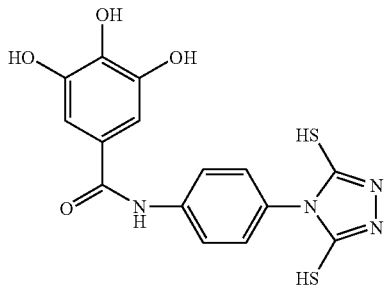

-continued (6)

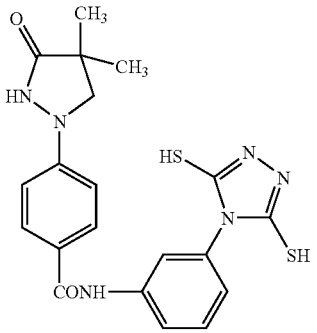

(7)

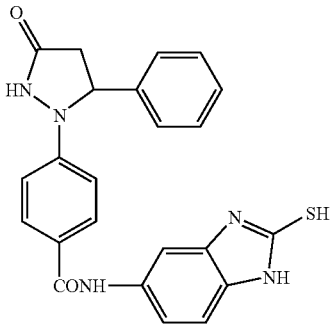

(8)

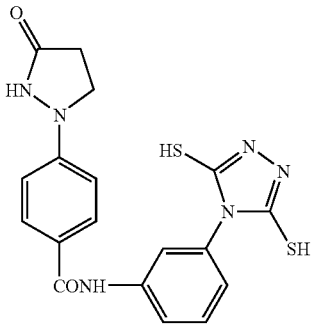

(9)

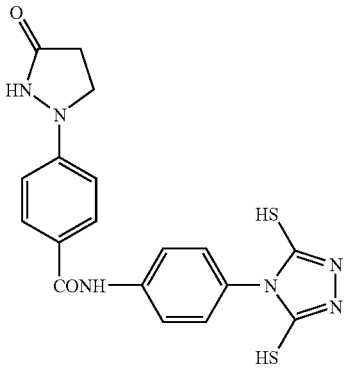

(10)

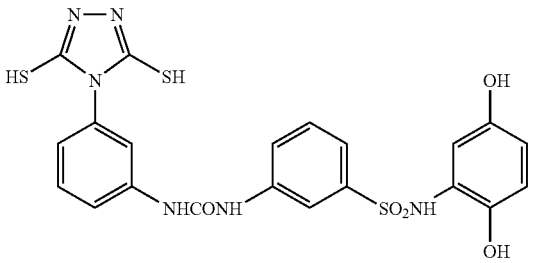

-continued (11)

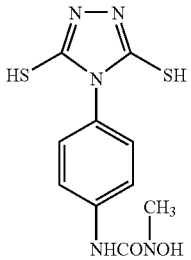

(12)

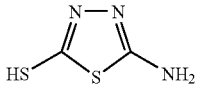

(13)

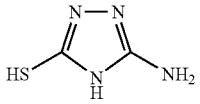

Further, example compounds 1 to 30 and 1"-1 to 1"-77 shown in EP-A No. 1308776A2, pages 73 to 87 are also described as preferable examples of the compound having an adsorptive group and a reducible group according to the invention.

These compounds can be easily synthesized by the known method. The compound of formula (I) in the present invention can be used alone, but it is preferred to use two or more kinds of the compounds in combination. When two or more kinds of the compounds are used in combination, those may be added to the same layer or the different layers, whereby adding methods may be different from each other.

The compound represented by formula (I) in the present invention preferably is added to a image forming layer and more preferably is to be added at an emulsion preparing process. In the case, wherein these compounds are added at an emulsion preparing process, these compounds may be added at any step in the process. For example, the silver halide grain forming step, the step before starting of desalting step, the desalting step, the step before starting of chemical ripening, the chemical ripening step, the step before preparing a final emulsion and the like are described. Also, the addition can be performed in plural times during the process. It is preferred to be added in an image forming layer, but also to be diffused at a coating step from a protective layer or an intermediate layer adjacent to the image forming layer, wherein these compounds are added in the protective layer or the intermediate layer in combination with their addition to the image forming layer.

The preferred addition amount is largely depend on the adding method described above or the kind of the compound, but generally $1\times10^{-6}$ mol to 1 mol per 1 mol of photosensitive silver halide, preferably $1\times10^{-5}$ mol to $5\times10^{-1}$ mol, and more preferably $1\times10^{-4}$ mol to $1\times10^{-1}$ mol.

The compound represented by formula (I) in the present invention can be added by dissolving in water or water-soluble solvent such as methanol, ethanol and the like or a mixed solution thereof. At this time, pH may be arranged suitably by an acid or an alkaline and a surfactant can be coexisted. Further, these compounds may be added as an emulsified dispersion by dissolving them in an organic solvent having a high boiling point and also may be added as a solid dispersion.

11) Combined Use of a Plurality of Silver Halides

The photosensitive silver halide emulsion in the photothermographic material used in the invention may be used alone, or two or more kinds of them (for example, those of different average particle sizes, different halogen compositions, of different crystal habits and of different conditions for chemical sensitization) may be used together. Gradation can be controlled by using plural kinds of photosensitive silver halide of different sensitivity. The relevant techniques can include those described, for example, in JP-A Nos. 57-119341, 53-106125, 47-3929, 48-55730, 46-5187, 50-73627, and 57-150841. It is preferred to provide a sensitivity difference of 0.2 or more in terms of log E between each of the emulsions.

12) Coating Amount

The addition amount of the photosensitive silver halide, when expressed by the amount of coated silver per 1 $m^2$ of the photothermographic material, is preferably from 0.03 $g/m^2$ to 0.6 $g/m^2$, more preferably, from 0.05 $g/m^2$ to 0.4 $g/m^2$ and, further preferably, from 0.07 $g/m^2$ to 0.3 $g/m^2$. The photosensitive silver halide is used in the range from 0.01 mol to 0.5 mol, preferably, from 0.02 mol to 0.3 mol, and further preferably from 0.03 mol to 0.2 mol, per 1 mol of the organic silver salt.

13) Mixing Silver Halide and Organic Silver Salt

The method of mixing the silver halide and the organic silver salt can include a method of mixing a separately prepared photosensitive silver halide and an organic silver salt by a high speed stirrer, ball mill, sand mill, colloid mill, vibration mill, or homogenizer, or a method of mixing a photosensitive silver halide completed for preparation at any timing in the preparation of an organic silver salt and preparing the organic silver salt. The effect of the invention can be obtained preferably by any of the methods described above. Further, a method of mixing two or more kinds of aqueous dispersions of organic silver salts and two or more kinds of aqueous dispersions of photosensitive silver salts upon mixing is used preferably for controlling the photographic properties.

14) Mixing Silver Halide into Coating Solution

In the invention, the time of adding silver halide to the coating solution for the image forming layer is preferably in the range from 180 minutes before to just prior to the coating, more preferably, 60 minutes before to 10 seconds before coating. But there is no restriction for mixing method and mixing condition as far as the effect of the invention appears sufficient. As an embodiment of a mixing method, there is a method of mixing in the tank controlling the average residence time to be desired. The average residence time herein is calculated from addition flux and the amount of solution transferred to the coater. And another embodiment of mixing method is a method using a static mixer, which is described in 8th edition of "Ekitai Kongo Gijutu" by N. Harnby and M. F. Edwards, translated by Koji Takahashi (Nikkan Kogyo Shinbunsha, 1989).

(Development Accelerator)

In the photothermographic material of the invention, sulfoneamide phenolic compounds described in the specification of JP-A No. 2000-267222, and represented by formula (A) described in the specification of JP-A No. 2000-330234; hindered phenolic compounds represented by formula (II) described in JP-A No. 2001-92075; hydrazine compounds described in the specification of JP-A No. 10-62895, represented by formula (I) described in the specification of JP-A No. 11-15116, represented by formula (D) described in the specification of JP-A No. 2002-156727, and represented by formula (1) described in the specification of JP-A No. 2002-278017; and phenolic or naphthalic compounds represented by formula (2) described in the specification of JP-A No. 2001-264929 are used preferably as a development accelerator. The development accelerator described above is used in a range from 0.1 mol % to 20 mol %, preferably, in a range from 0.5 mol % to 10 mol % and, more preferably, in a range from 1 mol % to 5 mol % with respect to the reducing agent. The introducing methods to the photothermographic material can include, the same methods as those for the reducing agent and, it is particularly preferred to add as a solid dispersion or an emulsion dispersion. In a case of adding as an emulsion dispersion, it is preferred to add as an emulsion dispersion dispersed by using a high boiling solvent which is solid at a normal temperature and an auxiliary solvent at a low boiling point, or to add as a so-called oilless emulsion dispersion not using the high boiling solvent.

In the present invention, it is more preferred to use as a development accelerator, hydrazine compounds represented by formula (D) described in the specification of JP-A No. 2002-156727, and phenolic or naphtholic compounds represented by formula (2) described in the specification of JP-A No. 2001-264929.

Particularly preferred development accelerators of the invention are compounds represented by the following formulae (A-1) and (A-2).

$$Q_1\text{-NHNH-}Q_2 \qquad \text{Formula (A-1)}$$

(wherein, $Q_1$ represents an aromatic group or a heterocyclic group which bonds to —NHNH-$Q_2$ at a carbon atom, and $Q_2$ represents one selected from a carbamoyl group, an acyl group, an alkoxycarbonyl group, an aryloxycarbonyl group, a sulfonyl group, and a sulfamoyl group).

In formula (A-1), the aromatic group or the heterocyclic group represented by $Q_1$ is, preferably, 5 to 7 membered unsaturated ring. Preferred examples include benzene ring, pyridine ring, pyrazine ring, pyrimidine ring, pyridazine ring, 1,2,4-triazine ring, 1,3,5-triazine ring, pyrrole ring, imidazole ring, pyrazole ring, 1,2,3-triazole ring, 1,2,4-triazole ring, tetrazole ring, 1,3,4-thiadiazole ring, 1,2,4-thiadiazole ring, 1,2,5-thiadiazole ring, 1,3,4-oxadiazole ring, 1,2,4-oxadiazole ring, 1,2,5-oxadiazole ring, thiazole ring, oxazole ring, isothiazole ring, isooxazole ring, and thiophene ring. Condensed rings in which the rings described above are condensed to each other are also preferred.

The rings described above may have substituents and in a case where they have two or more substituents, the substituents may be identical or different from each other. Examples of the substituents can include a halogen atom, an alkyl group, an aryl group, a carboamide group, an alkylsulfoneamide group, an arylsulfonamide group, an alkoxy group, an aryloxy group, an alkylthio group, an arylthio group, a carbamoyl group, a sulfamoyl group, a cyano group, an alkylsulfonyl group, an arylsulfonyl group, an alkoxycarbonyl group, an aryloxycarbonyl group and an acyl group. In the case where the substituents are groups capable of substitution, they may have further substituents and examples of preferred substituents can include a halogen atom, an alkyl group, an aryl group, a carbonamide group, an alkylsulfoneamide group, an arylsulfoneamide group, an alkoxy group, an aryloxy group, an alkylthio group, an arylthio group, an acyl group, an alkoxycarbonyl group, an aryloxycarbonyl group, a carbamoyl group, a cyano group, a sulfamoyl group, an alkylsulfonyl group, an arylsulfonyl group and an acyloxy group.

The carbamoyl group represented by $Q_2$ is a carbamoyl group preferably having 1 to 50 carbon atoms and, more preferably, having 6 to 40 carbon atoms, and examples can include unsubstituted carbamoyl, methyl carbamoyl, N-ethylcarbamoyl, N-propylcarbamoyl, N-sec-butylcarbamoyl, N-octylcarbamoyl, N-cyclohexylcarbamoyl, N-tert-butylcarbamoyl, N-dodecylcarbamoyl, N-(3-dodecyloxypropyl) carbamoyl, N-octadecylcarbamoyl, N-{3-(2,4-tert-pentylphenoxy) propyl} carbamoyl, N-(2-hexyldecyl) carbamoyl, N-phenylcarbamoyl, N-(4-dodecyloxyphenyl) carbamoyl, N-(2-chloro-5-dodecyloxycarbonylphenyl)carbamoyl, N-naphthylcarbaoyl, N-3-pyridylcarbamoyl and N-benzylcarbamoyl.

The acyl group represented by $Q_2$ is an acyl group, preferably having 1 to 50 carbon atoms and, more preferably 6 to 40 carbon atoms and can include, for example, formyl, acetyl, 2-methylpropanoyl, cyclohexylcarbonyl, octanoyl, 2-hexyldecanoyl, dodecanoyl, chloroacetyl, trifluoroacetyl, benzoyl, 4-dodecyloxybenzoyl, and 2-hydroxymethylbenzoyl. The alkoxycarbonyl group represented by $Q_2$ is an alkoxycarbonyl group, preferably, of 2 to 50 carbon atom and, more preferably, of 6 to 40 carbon atoms and can include, for example, methoxycarbonyl, ethoxycarbonyl, isobutyloxycarbonyl, cyclohexyloxycarbonyl, dodecyloxycarbonyl and benzyloxycarbonyl.

The aryloxy carbonyl group represented by $Q_2$ is an aryloxycarbonyl group, preferably, having 7 to 50 carbon atoms and, more preferably, having 7 to 40 carbon atoms and can include, for example, phenoxycarbonyl, 4-octyloxyphenoxycarbonyl, 2-hydroxymethylphenoxycarbonyl, and 4-dodecyloxyphenoxycarbonyl. The sulfonyl group represented by $Q_2$ is a sulfonyl group, preferably having 1 to 50 carbon atoms and, more preferably, having 6 to 40 carbon atoms and can include, for example, methylsulfonyl, butylsulfonyl, octylsulfonyl, 2-hexadecylsulfonyl, 3-dodecyloxypropylsulfonyl, 2-octyloxy-5-tert-octylphenyl sulfonyl, and 4-dodecyloxyphenyl sulfonyl.

The sulfamoyl group represented by $Q_2$ is a sulfamoyl group, preferably having 0 to 50 carbon atoms, more preferably, 6 to 40 carbon atoms and can include, for example, unsubstituted sulfamoyl, N-ethylsulfamoyl group, N-(2-ethylhexyl)sulfamoyl, N-decylsulfamoyl, N-hexadecylsulfamoyl, N-{3-(2-ethylhexyloxy)propyl}sulfamoyl, N-(2-chloro-5-dodecyloxycarbonylphenyl)sulfamoyl, and N-(2-tetradecyloxyphenyl)sulfamoyl. The group represented by $Q_2$ may further have a group mentioned as the example of the substituent of 5 to 7-membered unsaturated ring represented by $Q_2$ at the position capable of substitution. In a case where the group has two or more substituents, such substituents may be identical or different from each other.

Then, preferred range for the compounds represented by formula (A-1) is to be described. 5 or 6 membered unsaturated ring is preferred for $Q_1$, and benzene ring, pyrimidine ring, 1,2,3-triazole ring, 1,2,4-triazole ring, tetrazole ring, 1,3,4-thiadiazole ring, 1,2,4-thiadiazole ring, 1,3,4-oxadiazole ring, 1,2,4-oxadiazole ring, thioazole ring, oxazole ring, isothiazole ring, isooxazole ring and a ring in which the ring described above is condensed with a benzene ring or unsaturated hetero ring are further preferred. Further, $Q_2$ is preferably a carbamoyl group and, particularly, a carbamoyl group having a hydrogen atom on the nitrogen atom is particularly preferred.

Formula (A-2)

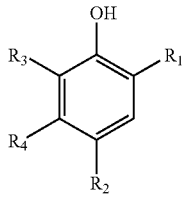

In formula (A-2), $R_1$ represents one selected from an alkyl group, an acyl group, an acylamino group, a sulfoneamide group, an alkoxycarbonyl group, and a carbamoyl group. $R_2$ represents one selected from a hydrogen atom, a halogen atom, an alkyl group, an alkoxy group, an aryloxy group, an alkylthio group, an arylthio group, an acyloxy group, and a carbonate ester group. $R_3$ and $R_4$ each independently represent a group capable of substituting for a hydrpgen atom on a benzene ring which is mentioned as the example of the substituent for formula (A-1). $R_3$ and $R_4$ may link together to form a condensed ring.

$R_1$ is, preferably, an alkyl group having 1 to 20 carbon atoms (for example, a methyl group, an ethyl group, an isopropyl group, a butyl group, a tert-octyl group, a cyclohexyl group, or the like), an acylamino group (for example, an acetylamino group, a benzoylamino group, a methylureido group, a 4-cyanophenylureido group, or the like), or a carbamoyl group (for example, a n-butylcarbamoyl group, an N,N-diethylcarbamoyl group, a phenylcarbamoyl group, a 2-chlorophenylcarbamoyl group, a 2,4-dichlorophenylcarbamoyl group, or the like). An acylamino group (including an ureido group and an urethane group) is more preferred. $R_2$ is, preferably, a halogen atom (more preferably, a chlorine atom or a bromine atom), an alkoxy group (for example, a methoxy group, a butoxy group, an n-hexyloxy group, an n-decyloxy group, a cyclohexyloxy group, a benzyloxy group, or the like), or an aryloxy group (for example, a phenoxy group, a naphthoxy group, or the like).

$R_3$ is preferably a hydrogen atom, a halogen atom, or an alkyl group having 1 to 20 carbon atoms, and most preferably a halogen atom. $R_4$ is preferably a hydrogen atom, an alkyl group, or an acylamino group, and more preferably an alkyl group or an acylamino group. Examples of the preferred substituent thereof are identical with those for $R_1$. In the case where $R_4$ is an acylamino group, $R_4$ may preferably link with $R_3$ to form a carbostyryl ring.

In the case where $R_3$ and $R_4$ in formula (A-2) link together to form a condensed ring, a naphthalene ring is particularly preferred as the condensed ring. The same substituent as the example of the substituent referred to for formula (A-1) may bond to the naphthalene ring. In the case where formula (A-2) is a naphtholic compound, $R_1$ is preferably a carbamoyl group. Among them, benzoyl group is particularly preferred. $R_2$ is preferably an alkoxy group or an aryloxy group and, particularly preferably an alkoxy group.

Preferred specific examples for the development accelerator of the invention are to be described below. The invention is not restricted to them.

A-1

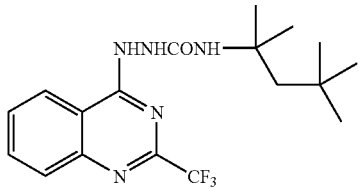

A-2

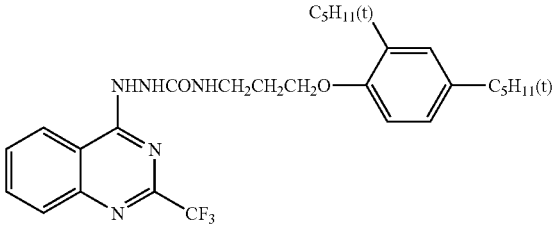

A-3

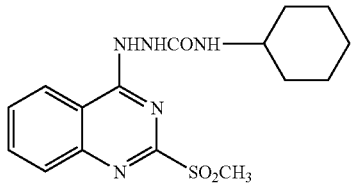

A-4

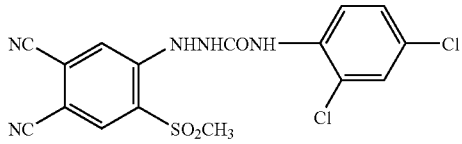

A-5

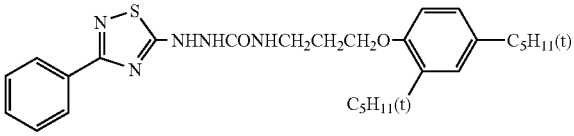

A-6

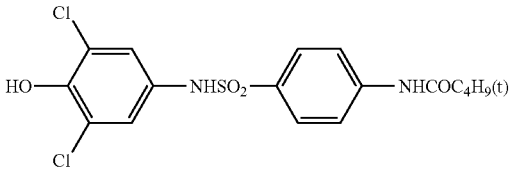

A-7

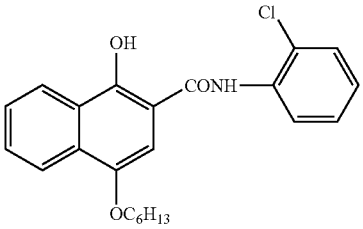

-continued

A-8

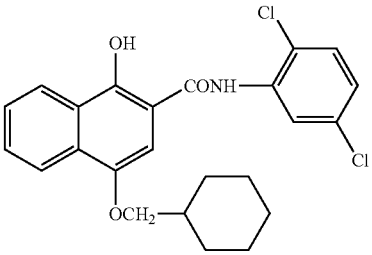

A-9

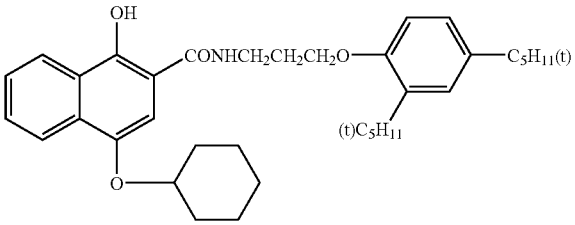

A-10

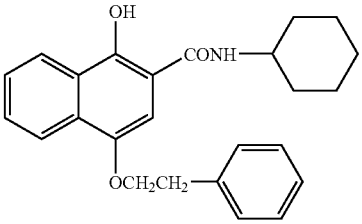

A-11

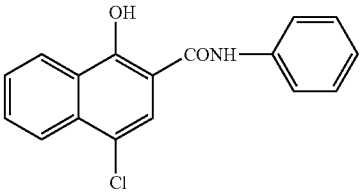

A-12

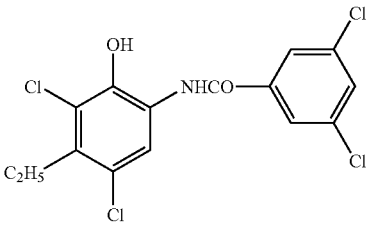

(Hydrogen Bonding Compound)

In the invention, in the case where the reducing agent has an aromatic hydroxy group (—OH) or an amino group (—NHR, R represents each one of a hydrogen atom and an alkyl group), particularly in the case where the reducing agent is a bisphenol described above, it is preferred to use in combination, a non-reducing compound having a group capable of reacting with these groups of the reducing agent, and that is also capable of forming a hydrogen bond therewith.

As a group forming a hydrogen bond with a hydroxyl group or an amino group, there can be mentioned a phosphoryl group, a sulfoxido group, a sulfonyl group, a carbonyl group, an amido group, an ester group, an urethane group, an ureido group, a tertiary amino group, a nitrogen-containing aromatic group, and the like. Particularly preferred among them is a phosphoryl group, a sulfoxido group, an amido group (not having >N—H moiety but being blocked in the form of >N—Ra (where, Ra represents a substituent other than H)), an urethane group (not having >N13 H moiety but being blocked in the form of >N—Ra (where, Ra represents a substituent other than H)), and an ureido group (not having >N—H moiety but being blocked in the form of >N—Ra (where, Ra represents a substituent other than H)).

In the invention, particularly preferable as the hydrogen bonding compound is the compound expressed by formula (D) shown below.

Formula (D)

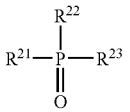

In formula (D), $R^{21}$ to $R^{23}$ each independently represent one selected from an alkyl group, an aryl group, an alkoxy group, an aryloxy group, an amino group, and a heterocyclic group, which may be substituted or unsubstituted.

In the case where $R^{21}$ to $R^{23}$ contain a substituent, examples of the substituent include a halogen atom, an alkyl group, an aryl group, an alkoxy group, an amino group, an acyl group, an acylamino group, an alkylthio group, an arylthio group, a sulfonamido group, an acyloxy group, an oxycarbonyl group, a carbamoyl group, a sulfamoyl group, a sulfonyl group, a phosphoryl group, and the like, in which preferred as the substituents are an alkyl group or an aryl group, e.g., a methyl group, an ethyl group, an isopropyl group, a t-butyl group, a t-octyl group, a phenyl group, a 4-alkoxyphenyl group, a 4-acyloxyphenyl group, and the like.

Specific examples of an alkyl group expressed by $R^{21}$ to $R^{23}$ include a methyl group, an ethyl group, a butyl group, an octyl group, a dodecyl group, an isopropyl group, a t-butyl group, a t-amyl group, a t-octyl group, a cyclohexyl group, a 1-methylcyclohexyl group, a benzyl group, a phenetyl group, a 2-phenoxypropyl group, and the like.

As an aryl group, there can be mentioned a phenyl group, a cresyl group, a xylyl group, a naphthyl group, a 4-t-butylphenyl group, a 4-t-octylphenyl group, a 4-anisidyl group, a 3,5-dichlorophenyl group, and the like.

As an alkoxyl group, there can be mentioned a methoxy group, an ethoxy group, a butoxy group, an octyloxy group, a 2-ethylhexyloxy group, a 3,5,5-trimethylhexyloxy group, a dodecyloxy group, a cyclohexyloxy group, a 4-methylcyclohexyloxy group, a benzyloxy group, and the like.

As an aryloxy group, there can be mentioned a phenoxy group, a cresyloxy group, an isopropylphenoxy group, a 4-t-butylphenoxy group, a naphthoxy group, a biphenyloxy group, and the like.

As an amino group, there can be mentioned are a dimethylamino group, a diethylamino group, a dibutylamino group, a dioctylamino group, an N-methyl-N-hexylamino group, a dicyclohexylamino group, a diphenylamino group, an N-nethyl-N-phenylamino, and the like.

Preferred as $R^{21}$ to $R^{23}$ is an alkyl group, an aryl group, an alkoxy group, or an aryloxy group. Concerning the effect of the invention, it is preferred that at least one or more of $R^{21}$ to $R^{23}$ are an alkyl group or an aryl group, and more preferably, two or more of them are an alkyl group or an aryl group. From the viewpoint of low cost availability, it is preferred that $R^{21}$ to $R^{23}$ are of the same group.

Specific examples of hydrogen bonding compounds represented by formula (D) of the invention and others are shown below, but it should be understood that the invention is not limited thereto.

D-1

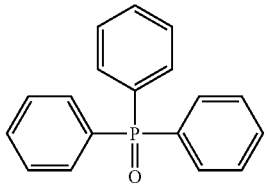

D-2

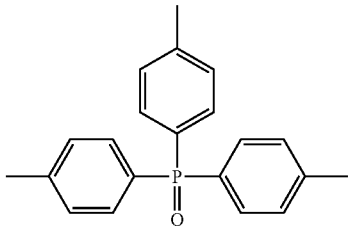

D-3

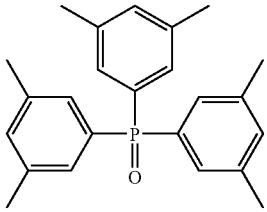

D-4

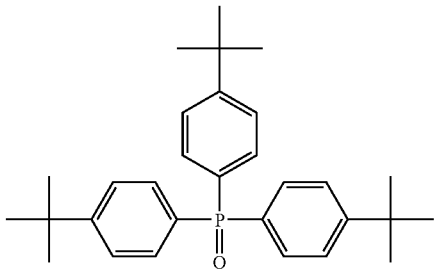

D-5

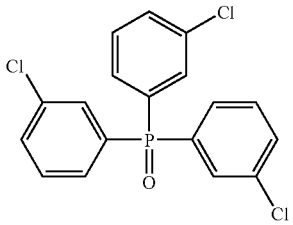

D-6

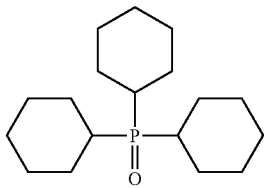

-continued

D-7

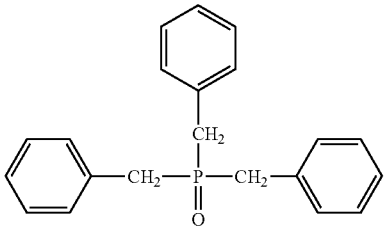

D-8

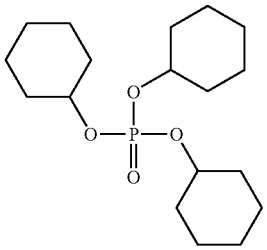

D-9

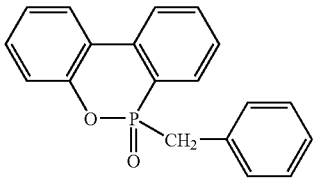

D-10

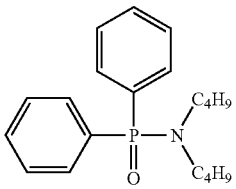

D-11

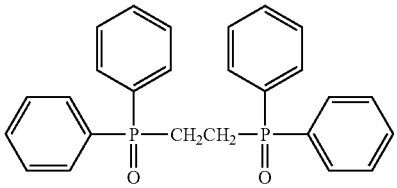

D-12

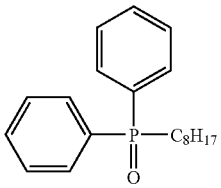

D-13

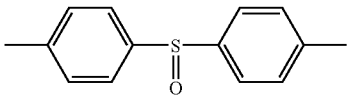

D-14

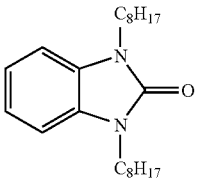

-continued

D-15

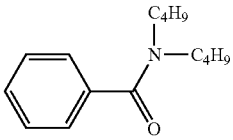

Specific examples of hydrogen bonding compounds other than those enumerated above can be found in those described in EP No. 1096310 and in JP-A Nos. 2002-156727 and 2002-318431.

The compound expressed by formula (D) used in the invention can be used in the photothermographic material by being incorporated into the coating solution in the form of solution, emulsion dispersion, or solid fine particle dispersion similar to the case of reducing agent, however, it is preferred to be used in the form of solid dispersion. In the solution, the compound expressed by formula (D) forms a hydrogen-bonded complex with a compound having a phenolic hydroxyl group or an amino group, and can be isolated as a complex in crystalline state depending on the combination of the reducing agent and the compound expressed by formula (D).

It is particularly preferred to use the crystal powder thus isolated in the form of solid fine particle dispersion, because it provides stable performance. Further, it is also preferred to use a method of leading to form complex during dispersion by mixing the reducing agent and the compound expressed by formula (D) in the form of powders and dispersing them with a proper dispersion agent using sand grinder mill or the like.

The compound expressed by formula (D) is preferably used in a range from 1 mol % to 200 mol %, more preferably from 10 mol % to 150 mol %, and further preferably, from 20 mol % to 100 mol %, with respect to the reducing agent.

(Binder)

Any kind of hydrophobic polymer may be used as the hydrophobic binder for the image forming layer in the photothermographic material. Suitable as the binder are those that are transparent or translucent, and that are generally colorless, such as natural resin or polymer and their copolymers; synthetic resin or polymer and their copolymer; or media forming a film; for example, included are gelatin, rubber, poly(vinyl alcohol), hydroxyethyl cellulose, cellulose acetate, cellulose acetate butyrate, poly(vinyl pyrrolidone), casein, starch, poly(acrylic acid), poly(methylmethacrylic acid), poly(vinyl chloride), poly(methacrylic acid), styrene-maleic anhydride copolymers, styrene-acrylonitrile copolymers, styrene-butadiene copolymers, poly(vinyl acetal) (e.g., poly(vinyl formal) and poly(vinyl butyral)), polyester, polyurethane, phenoxy resin, poly(vinylidene chloride), polyepoxide, polycarbonate, poly(vinyl acetate), polyolefin, cellulose esters, and polyamide. A binder may be used with water, an organic solvent or emulsion to form a coating solution.

In the invention, the glass transition temperature (Tg) of the binder which can be used in combination for the image forming layer is in a range from 0° C. to 80° C., preferably from 10° C. to 70° C. and, more preferably from 15° C. to 60° C.

In the specification, Tg is calculated according to the following equation.

$$1/Tg=\Sigma(Xi/Tgi)$$

Where, the polymer is obtained by copolymerization of n monomer compounds (from i=1 to i=n); Xi represents the mass fraction of the ith monomer (ΣXi=1), and Tgi is the glass transition temperature (absolute temperature) of the homopolymer obtained with the ith monomer. The symbol Σ stands for the summation from i=1 to i=n. Values for the glass transition temperature (Tgi) of the homopolymers derived from each of the monomers were obtained from J. Brandrup and E. H. Immergut, Polymer Handbook (3rd Edition) (Wiley-Interscience, 1989).

The binder may be of two or more kinds of polymers, when necessary. And, the polymer having Tg of 20° C. or more and the polymer having Tg of less than 20° C. can be used in combination. In the case where two or more kinds of polymers differing in Tg may be blended for use, it is preferred that the weight-average Tg is in the range mentioned above.

In the invention, it is preferred that the image forming layer is formed by first applying a coating solution containing 30% by weight or more of water in the solvent and by then drying.

In the case where the image forming layer is formed by first applying a coating solution containing 30% by weight or more of water in the solvent and by then drying, furthermore, in the case where the binder of the image forming layer is soluble or dispersible in an aqueous solvent (water solvent), and particularly in the case where a polymer latex having an equilibrium water content of 2% by weight or lower under 25° C. and 60% RH is used, the performance can be ameliorated. Most preferred embodiment is such prepared to yield an ion conductivity of 2.5 mS/cm or lower, and as such a preparing method, there can be mentioned a refining treatment using a separation function membrane after synthesizing the polymer.

The aqueous solvent in which the polymer is soluble or dispersible, as referred herein, signifies water or water containing mixed therein 70% by weight or less of a water-admixing organic solvent. As water-admixing organic solvents, there can be mentioned, for example, alcohols such as methyl alcohol, ethyl alcohol, propyl alcohol, and the like; cellosolves such as methyl cellosolve, ethyl cellosolve, butyl cellosolve, and the like; ethyl acetate, dimethylformamide, and the like.

The term aqueous solvent is also used in the case the polymer is not thermodynamically dissolved, but is present in a so-called dispersed state.

The term "equilibrium water content under 25° C. and 60% RH" as referred herein can be expressed as follows:

Equilibrium water content under 25° C. and 60% RH=[(W1−W0]×100 (% by weight)

wherein, W1 is the weight of the polymer in moisture-controlled equilibrium under the atmosphere of 25° C. and 60% RH, and W0 is the absolutely dried weight at 25° C. of the polymer.

For the definition and the method of measurement for water content, reference can be made to Polymer Engineering Series 14, "Testing methods for polymeric materials" (The Society of Polymer Science, Japan, published by Chijin Shokan).

The equilibrium water content under 25° C. and 60% RH is preferably 2% by weight or lower, but is more preferably, 0.01% by weight to 1.5% by weight, and is most preferably, 0.02% by weight to 1% by weight.

The binders used in the invention are, particularly preferably, polymers capable of being dispersed in aqueous solvent. Examples of dispersed states may include a latex, in which water-insoluble fine particles of hydrophobic polymer are dispersed, or such in which polymer molecules are dispersed in molecular states or by forming micelles, but preferred are latex-dispersed particles. The average particle size of the dispersed particles is in the range from 1 nm to 50,000 nm, and preferably from 5 nm to 1,000 nm. There is no particular limitation concerning particle size distribution of the dispersed particles, and may be widely distributed or may exhibit a monodisperse particle size distribution. From the viewpoint of controlling the physical properties of the coating solution, preferred mode of usage includes mixing two or more types of particles each having monodisperse particle distribution.

In the invention, preferred embodiment of the polymers capable of being dispersed in aqueous solvent includes hydrophobic polymers such as acrylic polymers, polyester, rubber (e.g., SBR resin), polyurethane, poly(vinyl chloride), poly(vinyl acetate), poly(vinylidene chloride), polyolefin, and the like. As the polymers above, usable are straight chain polymers, branched polymers, or crosslinked polymers; also usable are the so-called homopolymers in which one kind of monomer is polymerized, or copolymers in which two or more kinds of monomers are polymerized. In the case of a copolymer, it may be a random copolymer or a block copolymer. The molecular weight of these polymers is, in number average molecular weight, in a range from 5,000 to 1,000,000, preferably from 10,000 to 200,000. Those having too small molecular weight exhibit insufficient mechanical strength on forming the image forming layer, and those having too large molecular weight are also not preferred because the filming properties result poor. Further, a polymer latex having crosslinking property is particularly preferably used.

<Specific Examples of Latex>

Specific examples of preferred polymer latex are given below, which are expressed by the starting monomers with % by weight given in parenthesis. The molecular weight is given in number average molecular weight. In the case polyfunctional monomer is used, the concept of molecular weight is not applicable because they build a crosslinked structure. Hence, they are denoted as "crosslinking", and the molecular weight is omitted. Tg represents glass transition temperature.

P-1; Latex of -MMA(70)-EA(27)-MAA(3)-(molecular weight 37000, Tg 61° C.)

P-2; Latex of -MMA(70)-2EHA(20)-St(5)-AA(5)-(molecular weight 40000, Tg 59° C.)

P-3; Latex of -St(50)-Bu(47)-MAA(3)-(crosslinking, Tg −17° C.)

P-4; Latex of -St(68)-Bu(29)-AA(3)-(crosslinking, Tg 17° C.)

P-5; Latex of -St(71)-Bu(26)-AA(3)-(crosslinking, Tg 24° C.)

P-6; Latex of -St(70)-Bu(27)-IA(3)-(crosslinking)

P-7; Latex of -St(75)-Bu(24)-AA(1)-(crosslinking, Tg 29° C.)

P-8; Latex of -St(60)-Bu(35)-DVB(3)-MAA(2)-(crosslinking)

P-9; Latex of -St(70)-Bu(25)-DVB(2)-AA(3)-(crosslinking)

P-10; Latex of -VC(50)-MMA(20)-EA(20)-AN(5)-AA(5)-(molecular weight 80000)

P-11; Latex of -VDC(85)-MMA(5)-EA(5)-MAA(5)-(molecular weight 67000)

P-12; Latex of -Et(90)-MAA(10)-(molecular weight 12000)

P-13; Latex of -St(70)-2EHA(27)-AA(3)-(molecular weight 130000, Tg 43° C.)

P-14; Latex of -MMA(63)-EA(35)-AA(2)-(molecular weight 33000, Tg 47° C.)

P-15; Latex of -St(70.5)-Bu(26.5)-AA(3)-(crosslinking, Tg 23° C.)

P-16; Latex of -St(69.5)-Bu(27.5)-AA(3)-(crosslinking, Tg 20.5° C.)

In the structures above, abbreviations represent monomers as follows. MMA: methyl metacrylate, EA: ethyl acrylate, MAA: methacrylic acid, 2EHA: 2-ethylhexyl acrylate, St: styrene, Bu: butadiene, AA: acrylic acid, DVB: divinylbenzene, VC: vinyl chloride, AN: acrylonitrile, VDC: vinylidene chloride, Et: ethylene, IA: itaconic acid.

The polymer latexes above are commercially available, and polymers below are usable. As examples of acrylic polymers, there can be mentioned Cevian A4635, 4718, and 4601 (all manufactured by Daicel Chemical Industries, Ltd.), Nipol Lx811, 814, 821, 820, and 857 (all manufactured by Nippon Zeon Co., Ltd.), and the like; as examples of polyester, there can be mentioned FINETEX ES650, 611, 675, and 850 (all manufactured by Dainippon Ink and Chemicals, Inc.), WD-size and WMS (all manufactured by Eastman Chemical Co.), and the like; as examples of polyurethane, there can be mentioned HYDRAN AP10, 20, 30, and 40 (all manufactured by Dainippon Ink and Chemicals, Inc.), and the like; as examples of rubber, there can be mentioned LACSTAR 7310K, 3307B, 4700H, and 7132C (all manufactured by Dainippon Ink and Chemicals, Inc.), Nipol Lx416, 410, 438C, and 2507 (all manufactured by Nippon Zeon Co., Ltd.), and the like; as examples of poly(vinyl chloride), there can be mentioned G351 and G576 (all manufactured by Nippon Zeon Co., Ltd.), and the like; as examples of poly(vinylidene chloride), there can be mentioned L502 and L513 (all manufactured by Asahi Chemical Industry Co., Ltd.), and the like; as examples of polyolefin, there can be mentioned Chemipearl S120 and SA100 (all manufactured by Mitsui Petrochemical Industries, Ltd.), and the like.

The polymer latex above may be used alone, or may be used by blending two or more kinds depending on needs.

<Preferable Latex>

Particularly preferable as the polymer latex for use in the invention is that of styrene-butadiene copolymer. The weight ratio of monomer unit for styrene to that of butadiene constituting the styrene-butadiene copolymer is preferably in the range of from 40:60 to 95:5. Further, the monomer unit of styrene and that of butadiene preferably account for 60% by weight to 99% by weight with respect to the copolymer. Further, the polymer latex of the invention preferably contains acrylic acid or methacrylic acid in a range from 1% by weight to 6% by weight with respect to the sum of styrene and butadiene, and more preferably from 2% by weight to 5% by weight.

The polymer latex of the invention preferably contains acrylic acid. Preferable range of molecular weight is similar to that described above.

As the latex of styrene-butadiene copolymer preferably used in the invention, there can be mentioned P-3 to P-8 and P-15, or commercially available LACSTAR-3307B, 7132C, Nipol Lx416, and the like.

In the image forming layer of the photothermographic material according to the invention, if necessary, there can be added hydrophilic polymers such as gelatin, polyvinyl alcohol, methyl cellulose, hydroxypropyl cellulose, carboxymethyl cellulose, and the like. These hydrophilic polymers are added at an amount of 30% by weight or less, and preferably 20% by weight or less, with respect to the total weight of the binder incorporated in the image forming layer.

According to the invention, the layer containing organic silver salt (image forming layer) is preferably formed by using polymer latex for the binder. According to the amount of the binder for the image forming layer, the weight ratio for total binder to organic silver salt (total binder/organic silver salt) is in a range of from 1/10 to 10/1, preferably from 1/3 to 5/1, and more preferably from 1/1 to 3/1.

The image forming layer is, in general, a photosensitive layer containing a photosensitive silver halide, i.e., the photosensitive silver salt; in such a case, the weight ratio for total binder to silver halide (total binder/silver halide) is in the range of from 400 to 5, more preferably, from 200 to 10.

The total amount of binder in the image formiing layer of the invention is preferably in the range from 0.2 $g/m^2$ to 30 $g/m^2$, more preferably from 1 $g/m^2$ to 15 $g/m^2$, and further preferably from 2 $g/m^2$ to 10 $g/m^2$. As for the image forming layer of the invention, there may be added a crosslinking agent for crosslinking, or a surfactant and the like to improve coating properties.

(Preferable Solvent for Coating Solution)

In the invention, a solvent of a coating solution for the image forming layer (wherein a solvent and water are collectively described as a solvent for simplicity) is preferably an aqueous solvent containing water at 30% by weight or more. Examples of solvents other than water may include any of water-miscible organic solvents such as methyl alcohol, ethyl alcohol, isopropyl alcohol, methyl cellosolve, ethyl cellosolve, dimethylformamide and ethyl acetate. The water content in a solvent is more preferably 50% by weight or more, and still more preferably 70% by weight or more. Concrete examples of a preferable solvent composition, in addition to water=100, are compositions in which methyl alcohol is contained at ratios of water/methyl alcohol=90/10 and 70/30, in which dimethylformamide is further contained at a ratio of water/methyl alcohol/dimethylformamide=80/15/5, in which ethyl cellosolve is further contained at a ratio of water/methyl alcohol/ethyl cellosolve=85/10/5, and in which isopropyl alcohol is further contained at a ratio of water/methyl alcohol/isopropyl alcohol=85/10/5 (wherein the numerals presented above are values in % by weight).

(Antifoggant)

1) Organic Polyhalogen Compound

Preferable organic polyhalogen compound that can be used in the invention is explained specifically below. In the invention, preferred organic polyhalogen compounds are the compounds expressed by the following formula (H).

$$Q\text{-}Y)n\text{-}C(Z_1)(Z_2)X \qquad \text{Formula (H)}$$

In formula (H), Q represents one selected from an alkyl group, an aryl group, and a heterocyclic group; Y represents a divalent linking group; n represents 0 or 1; $Z_1$ and $Z_2$ each represent a halogen atom; and X represents one of a hydrogen atom and an electron-attracting group.

In formula (H), Q is preferably an alkyl group having 1 to 6 carbon atoms, an aryl group having 6 to 12 carbon atoms, or a heterocyclic group comprising at least one nitrogen atom (pyridine, quinoline or the like).

In the case where Q is an aryl group in formula (H), Q preferably is a phenyl group substituted by an electron-attracting group whose Hammett substituent constant σp yields a positive value. For the details of Hammett substituent constant, reference can be made to Journal of Medicinal Chemistry, vol. 16, No. 11 (1973), pp. 1207 to 1216, and the like. As such electron-attracting groups, examples include, halogen atoms, an alkyl group substituted by an electron-attracting group, an aryl group substituted by an electron-attracting group, a heterocyclic group, an alkyl sulfonyl group, an aryl sulfonyl group, an acyl group, an alkoxycarbonyl group, a carbamoyl group, sulfamoyl group and the like. Preferable as the electron-attracting group is a halogen atom, a carbamoyl group, or an arylsulfonyl group, and particularly preferred among them is a carbamoyl group.

X preferably is an electron-attracting group. As the electron-attracting group, preferable are a halogen atom, an aliphatic aryl sulfonyl group, a heterocyclic sulfonyl group, an aliphatic aryl acyl group, a heterocyclic acyl group, an aliphatic aryl oxycarbonyl group, a heterocyclic oxycarbonyl group, a carbamoyl group, and a sulfamoyl group; more preferable are a halogen atom and a carbamoyl group; and particularly preferable is a bromine atom.

$Z_1$ and $Z_2$ each are preferably a bromine atom or an iodine atom, and more preferably, a bromine atom.

Y preferably represents —C(═O)—, —So—, —$SO_2$—, —C(═O)N(R)—, or —$SO_2$N(R)—; more preferably, —C(═O)—, —$SO_2$—, or —C(═O)N(R)—; and particularly preferably, —$SO_2$— or —C(═O)N(R)—. Herein, R represents one selected from a hydrogen atom, an aryl group, and an alkyl group, preferably a hydrogen atom or an alkyl group, and particularly preferably a hydrogen atom.

n represents 0 or 1, and preferably represents 1.

In formula (H), in the case where Q is an alkyl group, Y is preferably —C(═O)N(R)—. And, in the case where Q is an aryl group or a heterocyclic group, Y is preferably —$SO_2$—.

In formula (H), the form where the residues, that are obtained by removing a hydrogen atom from the compound, bind each other (generally called as bis type, tris type, or tetrakis type) is also preferably used.

In formula (H), the form having a substituent of a dissociative group (for example, a COOH group or a salt thereof, a $SO_3H$ group or a salt thereof, a $PO_3H$ group or a salt thereof, and the like), a group containing a quaternary nitrogen atom (for example, an ammonium group, a pyridinium group, and the like), a polyethyleneoxy group, a hydroxy group, or the like is also preferable.

Specific examples of the compound expressed by formula (H) of the invention are shown below.

H-1

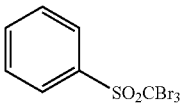

H-2

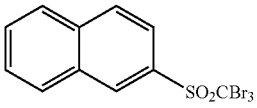

H-3

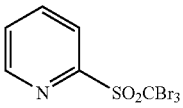

H-4

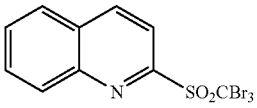

-continued

H-5

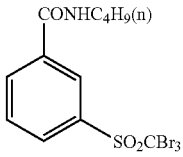

H-6

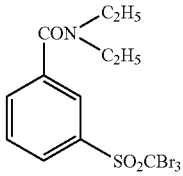

H-7

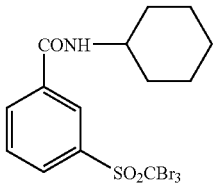

H-8

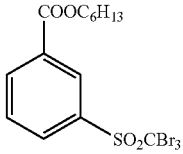

H-9

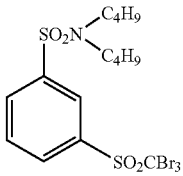

H-10

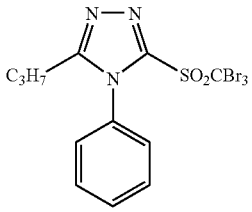

H-11

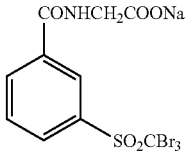

H-12

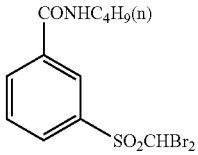

H-13

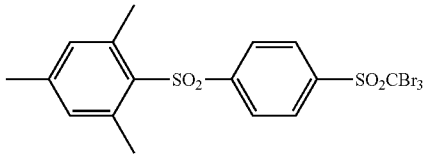

-continued

H-14

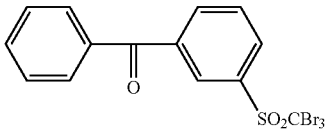

H-15

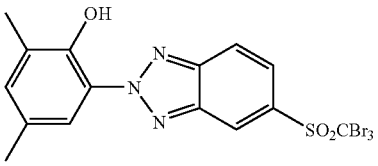

H-16

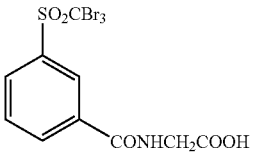

H-17

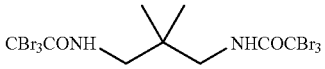

H-18

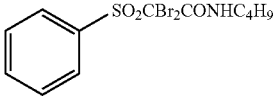

H-19

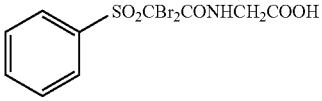

As preferred organic polyhalogen compounds of the invention other than those above, there can be mentioned compounds disclosed in U.S. Pat. Nos. 3,874,946, 4,756,999, 5,340,712, 5,369,000, 5,464,737, and 6,506,548, JP-A Nos. 50-137126, 50-89020, 50-119624, 59-57234, 7-2781, 7-5621, 9-160164, 9-244177, 9-244178, 9-160167, 9-319022, 9-258367, 9-265150, 9-319022, 10-197988, 10-197989, 11-242304, 2000-2963, 2000-112070, 2000-284410, 2000-284412, 2001-33911, 2001-31644, 2001-312027, and 2003-50441. Particularly, compounds disclosed in JP-A Nos. 7-2781, 2001-33911 and 20001-312027 are preferable.

The compounds expressed by formula (H) of the invention are preferably used in an amount from $10^{-4}$ mol to 1 mol, more preferably, $10^{-3}$ mol to 0.5 mol, and further preferably, $1\times10^{-2}$ mol to 0.2 mol, per 1 mol of non-photosensitive silver salt incorporated in the image forming layer.

In the invention, usable methods for incorporating the antifoggant into the photothermographic material are those described above in the method for incorporating the reducing agent, and similarly, for the organic polyhalogen compound, it is preferably added in the form of a solid fine particle dispersion.

2) Other Antifoggants

As other antifoggants, there can be mentioned a mercury (II) salt described in paragraph number 0113 of JP-A No. 11-65021, benzoic acids described in paragraph number 0114 of the same literature, a salicylic acid derivative described in JP-A No. 2000-206642, a formaline scavenger compound expressed by formula (S) in JP-A No. 2000-221634, a triazine compound related to claim 9 of JP-A No. 11-352624, a compound expressed by general formula (III), 4-hydroxy-6-methyl-1,3,3a, 7-tetrazaindene and the like, as described in JP-A No. 6-11791.

The photothermographic material of the invention may further contain an azolium salt in order to prevent fogging. As azolium salts, there can be mentioned a compound expressed by formula (XI) as described in JP-A No. 59-193447, a compound described in JP-B No. 55-12581, and a compound expressed by formula (II) in JP-A No. 60-153039. The azolium salt may be added to any part of the photothermographic material, but as the addition layer, preferred is to select a layer on the side having thereon the image forming layer, and more preferred is to select the image forming layer. The azolium salt may be added at any time of the process of preparing the coating solution; in the case where the azolium salt is added into the layer containing the organic silver salt, any time of the process may be selected, from the preparation of the organic silver salt to the preparation of the coating solution, but preferred is to add the salt after preparing the organic silver salt and just before the coating. As the method for adding the azolium salt, any method using a powder, a solution, a fine-particle dispersion, and the like, may be used. Furthermore, it may be added as a solution having mixed therein other additives such as sensitizing agents, reducing agents, toners, and the like.

In the invention, the azolium salt may be added at any amount, but preferably, it is added in a range from $1\times10^{-6}$ mol to 2 mol, and more preferably, from $1\times10^{-3}$ mol to 0.5 mol per 1 mol of silver.

(Other Additives)

1) Mercapto Compounds, Disulfides and Thiones

In the invention, mercapto compounds, disulfide compounds, and thione compounds may be added in order to control the development by suppressing or enhancing development, to improve spectral sensitizing efficiency, and to improve storage properties before and after development. Descriptions can be found in paragraph Nos. 0067 to 0069 of JP-A No. 10-62899, a compound expressed by formula (1) of JP-A No. 10-186572 and specific examples thereof shown in paragraph Nos. 0033 to 0052, in lines 36 to 56 in page 20 of EP-A No. 0803764A1. Among them, mercapto-substituted heterocyclic aromatic compounds, which are described in JP-A Nos. 9-297367, 9-304875, 2001-100358, 2002-303954, 2002-303951 and the like, are particularly preferred.

2) Toner

In the photothermographic material of the present invention, the addition of a toner is preferred. The description of the toner can be found in JP-A No. 10-62899 (paragraph Nos. 0054 to 0055), EP-A No. 0803764A1 (page 21, lines 23 to 48), and JP-A Nos. 2000-356317 and 2000-187298. Preferred are phthalazinones (phthalazinone, phthalazinone derivatives and metal salts thereof, e.g., 4-(1-naphthyl) phthalazinone,6-chlorophthalazinone, 5,7-dimethoxyphthalazinone and 2,3-dihydro-1,4-phthalazinedione); combinations of phthalazinones and phthalic acids(e.g., phthalic acid, 4-methylphthalic acid, 4-nitrophthalic acid, diammonium phthalate, sodium phthalate, potassium phthalate and tetrachlorophthalic anhydride); phthalazines(phthalazine, phthalazine derivatives and metal salts thereof, e.g., 4-(1-naphthyl)phthalazine, 6-isopropylphthalazine, 6-ter-butylphthalazine, 6-chlorophthalazine, 5,7-dimethoxyphthalazine and 2,3-dihydrophthalazine); combinations of phthalazines and phthalic acids. Particularly preferred is a combination of phthalazines and phthalic acids. Among them, particularly preferable are the combination of 6-isopropylphthalazine and phthalic acid, and the combination of 6-isopropylphthalazine and 4-methylphthalic acid.

3) Plasticizer and Lubricant

Plasticizers and lubricants usable in the photothermographic material of the invention are described in paragraph No. 0117 of JP-A No. 11-65021. Lubricants are described in paragraph Nos. 0061 to 0064 of JP-A No. 11-84573.

4) Dyes and Pigments

From the viewpoint of improving color tone, of preventing the generation of interference fringes and of preventing irradiation on laser exposure, various types of dyes and pigments (for instance, C.I. Pigment Blue 60, C.I. Pigment Blue 64, and C.I. Pigment Blue 15:6) may be used in combination with the aforementioned phthalocyanine compound in the image forming layer of the invention. Detailed description can be found in WO No. 98/36322, JP-A Nos. 10-268465 and 11-338098, and the like. 5) Nucleator As for the photothermographic material of the invention, it is preferred to add a nucleator into the image forming layer. Details on the nucleators, method of their addition and addition amount can be found in paragraph No. 0118, paragraph Nos. 0136 to 0193 of JP-A No. 11-223898, as compounds expressed by formulae (H), (1) to (3), (A), and (B) in JP-A No. 2000-284399; as for a nucleation accelerator, description can be found in paragraph No. 0102 of JP-A No. 11-65021, and in paragraph Nos. 0194 to 0195 of JP-A No. 11-223898.

In the case of using formic acid or formates as a strong fogging agent, it is preferably incorporated into the side having thereon the image forming layer containing photosensitive silver halide, at an amount of 5 mmol or less, and preferably, 1 mmol or less per 1 mol of silver.

In the case of using a nuleator in the photothermographic material of the invention, it is preferred to use an acid resulting from hydration of diphosphorus pentaoxide, or a salt thereof in combination. Acids resulting from the hydration of diphosphorus pentaoxide or salts thereof include metaphosphoric acid (salt), pyrophosphoric acid (salt), orthophosphoric acid (salt), triphosphoric acid (salt), tetraphosphoric acid (salt), hexametaphosphoric acid (salt), and the like. Particularly preferred acids obtainable by the hydration of diphosphorus pentaoxide or salts thereof include orthophosphoric acid (salt) and hexametaphosphoric acid (salt). Specifically mentioned as the salts are sodium orthophosphate, sodium dihydrogen orthophosphate, sodium hexametaphosphate, ammonium hexametaphosphate, and the like.

The addition amount of the acid obtained by hydration of diphoshorus pentaoxide or the salt thereof (i.e., the coating amount per 1 $m^2$ of the photothermographic material) may be set as desired depending on sensitivity and fogging, but preferred is an amount of from 0.1 $mg/m^2$ to 500 $mg/m^2$, and more preferably, from 0.5 $mg/m^2$ to 100 $mg/m^2$.

(Preparation of Coating Solution and Coating)

The temperature for preparing the coating solution for the image forming layer of the invention is preferably from 30° C. to 65° C., more preferably, from 35° C. or more to less than 60° C., and further preferably, from 35° C. to 55° C. Furthermore, the temperature of the coating solution for the image forming layer immediately after adding the polymer latex is preferably maintained in the temperature range of from 30° C. to 65° C.

(Layer Constitution and other Constituting Components)

The image forming layer of the invention is constructed on a support by one or more layers. In the case of constituting the layer by a single layer, it comprises an organic silver salt, a photosensitive silver halide, a reducing agent, and a binder, which may further comprise additional materials as desired if necessary, such as a toner, a film-forming promoting agent, and other auxiliary agents. In the case of constituting the image forming layer from two or more layers, the first image forming layer (in general, a layer placed adjacent to the support) contains an organic silver salt and a photosensitive silver halide, and some of the other components must be incorporated in the second image forming layer or in both of the layers.

The photothermographic material according to the invention may have a non-photosensitive layer in addition to the image forming layer. The non-photosensitive layers can be classified depending on the layer arrangement into (a) a surface protective layer provided on the image forming layer (on the side farther from the support), (b) an intermediate layer provided among plural image forming layers or between the image forming layer and the protective layer, (c) an undercoat layer provided between the image forming layer and the support, and (d) a back layer which is provided to the side opposite to the image forming layer.

Furthermore, a layer that functions as an optical filter may be provided as (a) or (b) above. An antihalation layer may be provided as (c) or (d) to the photosensitive material.

1) Surface Protective Layer

The photothermographic material of the invention may further comprise a surface protective layer with an object to prevent adhesion of the image forming layer. The surface protective layer may be a single layer, or plural layers.

Description on the surface protective layer may be found in paragraph Nos. 0119 to 0120 of JP-A No. 11-65021 and in JP-A No. 2000-171936.

Preferred as the binder of the surface protective layer of the invention is gelatin, but polyvinyl alcohol (PVA) may be used preferably instead, or in combination. As gelatin, there can be used an inert gelatin (e.g., Nitta gelatin 750), a phthalated gelatin (e.g., Nitta gelatin 801), and the like. Usable as PVA are those described in paragraph Nos. 0009 to 0020 of JP-A No. 2000-171936, and preferred are the completely saponified product PVA-105 and the partially saponified PVA-205 and PVA-335, as well as modified polyvinyl alcohol MP-203 (trade name of products from Kuraray Ltd.). The amount of coated polyvinyl alcohol (per 1 $m^2$ of support) in the surface protective layer (per one layer) is preferably in the range from 0.3 $g/m^2$ to 4.0 $g/m^2$, and more preferably, from 0.3 $g/m^2$ to 2.0 $g/m^2$.

The total amount of the coated binder (including water-soluble polymer and latex polymer) (per 1 $m^2$ of support) in the surface protective layer (per one layer) is preferably in a range from 0.3 $g/m^2$ to 5.0 $g/m^2$, and more preferably, from 0.3 $g/m^2$ to 2.0 $g/m^2$.

2) Matting Agent

A matting agent may be preferably added to the photothermographic material of the invention in order to improve transportability. Description on the matting agent can be found in paragraphs Nos. 0126 to 0127 of JP-A No. 11-65021. The addition amount of the matting agent is preferably in a range from 1 $mg/m^2$ to 400 $mg/m^2$, and more preferably, from 5 $mg/m^2$ to 300 $mg/m^2$, with respect to the coating amount per 1 $m^2$ of the photothermographic material.

There is no particular restriction on the shape of the matting agent usable in the invention and it may fixed form or non-fixed form. Preferred is to use those having fixed form and globular shape. Mean particle size is preferably in a range of from 0.5 μm to 10 μm, more preferably, from 1.0 μm to 8.0 μm, and further preferably, from 2.0 μm to 6.0 μm. Furthermore, the particle size distribution of the matting agent is preferably set as such that the variation coefficient may become 50% or lower, more preferably, 40% or lower, and further preferably, 30% or lower. The variation coefficient, herein, is defined by (the standard deviation of particle diameter)/(mean diameter of the particle)×100. Furthermore, it is preferred to use by blending two types of matting agents having low variation coefficient and the ratio of their mean particle sizes is more than 3.

The matt degree on the image forming layer surface is not restricted as far as star-dust trouble occurs, but the matt degree of 30 seconds to 2000 seconds is preferred, particularly preferred, 40 seconds to 1500 seconds as Beck's smoothness. Beck's smoothness can be calculated easily, by seeing Japan Industrial Standared (JIS) P8119 "The method of testing Beck's smoothness for papers and sheets using Beck's test apparatus", or TAPPI standard method T479.

The matt degree of the back layer in the invention is preferably in a range of 1200 seconds or less and 10 seconds or more; more preferably, 800 seconds or less and 20 seconds or more; and further preferably, 500 seconds or less and 40 seconds or more when expressed by Beck's smoothness.

In the present invention, a matting agent is preferably contained in an outermost layer, in a layer which can be function as an outermost layer, or in a layer nearer to outer surface, and also preferably is contained in a layer which can function as so-called protective layer.

3) Polymer Latex

A polymer latex is preferably used in the surface protective layer and the back layer of the present invention. As such polymer latex, descriptions can be found in "Gosei Jushi Emulsion (Synthetic resin emulsion)" (Taira Okuda and Hiroshi Inagaki, Eds., published by Kobunshi Kankokai (1978)), "Gosei Latex no Oyo (Application of synthetic latex)" (Takaaki Sugimura, Yasuo Kataoka, Soichi Suzuki, and Keiji Kasahara, Eds., published by Kobunshi Kankokai (1993)), and "Gosei Latex no Kagaku (Chemistry of synthetic latex)" (Soichi Muroi, published by Kobunshi Kankokai (1970)). More specifically, there can be mentioned a latex of methyl methacrylate (33.5% by weight)/ethyl acrylate (50% by weight)/methacrylic acid (16.5% by weight) copolymer, a latex of methyl methacrylate (47.5% by weight)/butadiene (47.5% by weight)/itaconic acid (5% by weight) copolymer, a latex of ethyl acrylate/methacrylic acid copolymer, a latex of methyl methacrylate (58.9% by weight)/2-ethylhexyl methacrylate (25.4% by weight)/styrene (8.6% by weight)/2-hydroethyl methacrylate (5.1% by weight)/acrylic acid (2.0% by weight) copolymer, a latex of methyl methacrylate (64.0% by weight)/styrene (9.0% by weight)/butyl acrylate (20.0% by weight)/2-hydroxyethyl methacrylate (5.0% by weight)/acrylic acid (2.0% by weight) copolymer, and the like.

Furthermore, as the binder for the surface protective layer, there can be applied the technology described in paragraph Nos. 0021 to 0025 of the specification of JP-A No. 2000-267226, and the technology described in paragraph Nos. 0023 to 0041 of the specification of JP-A No. 2000-19678. The polymer latex in the surface protective layer preferably is contained in an amount of 10% by weight to 90% by weight, particularly preferably, of 20% by weight to 80% by weight of the total weight of binder.

4) Surface pH

The surface pH of the photothermographic material according to the invention preferably yields a pH of 7.0 or lower, and more preferably, 6.6 or lower, before a thermal developing process. Although there is no particular restriction concerning the lower limit, the lower limit of pH value is about 3, and the most preferred surface pH range is from 4 to 6.2. From the viewpoint of reducing the surface pH, it is preferred to use an organic acid such as phthalic acid derivative or a nonvolatile acid such as sulfuric acid, or a volatile base such as ammonia for the adjustment of the surface pH. In particular, ammonia can be used favorably for the achievement of low surface pH, because it can easily vaporize to remove it before the coating step or before applying thermal development.

It is also preferred to use a nonvolatile base such as sodium hydroxide, potassium hydroxide, lithium hydroxide, and the like, in combination with ammonia. The method of measuring surface pH value is described in paragraph No. 0123 of the specification of JP-A No. 2000-284399.

5) Hardener

A hardener may be used in each of image forming layer, protective layer, back layer, and the like. As examples of the hardener, descriptions of various methods can be found in pages 77 to 87 of T. H. James, "THE THEORY OF THE PHOTOGRAPHIC PROCESS, FOURTH EDITION" (Macmillan Publishing Co., Inc., 1977). Preferably used are, in addition to chromium alum, sodium salt of 2,4-dichloro-6-hydroxy-s-triazine, N,N-ethylene bis(vinylsulfonacetamide), and N,N-propylene bis(vinylsulfonacetamide), polyvalent metal ions described in page 78 of the above literature and the like, polyisocyanates described in U.S. Pat. No. 4,281,060, JP-A No. 6-208193 and the like, epoxy compounds of U.S. Pat. No. 4,791,042 and the like, and vinyl sulfone compounds of JP-A No. 62-89048 and the like.

The hardener is added as a solution, and the solution is added to the coating solution for forming the protective layer 180 minutes before coating to just before coating, and preferably 60 minutes before to 10 seconds before coating. However, so long as the effect of the invention is sufficiently exhibited, there is no particular restriction concerning the mixing method and the conditions of mixing. As specific mixing methods, there can be mentioned a method of mixing in the tank, in which the average stay time calculated from the flow rate of addition and the feed rate to the coater is controlled to yield a desired time, or a method using static mixer as described in Chapter 8 of N. Harnby, M. F. Edwards, A. W. Nienow (translated by Koji Takahashi) "Liquid Mixing Technology" (Nikkan Kogyo Shinbunsha, 1989), and the like.

6) Surfactant

As for the surfactant, the solvent, the support, antistatic agent and the electrically conductive layer, and the method for obtaining color images applicable in the invention, there can be mentioned those disclosed in paragraph Nos. 0132, 0133, 0134, 0135, and 0136, respectively, of JP-A No. 11-65021.

In the invention, it is preferred to use a fluorocarbon surfacant. Specific examples of fluorocarbon surfacants can be found in those described in JP-A Nos. 10-197985, 2000-19680, and 2000-214554. Polymer fluorocarbon surfacants described in JP-A 9-281636 can be also used preferably. For the photothermographic material in the invention, the fluorocarbon surfacants described in JP-A Nos. 2002-82411, 2003-57780, and 2001-264110 are preferably used. Especially, the usage of the fluorocarbon surfacants described in JP-A Nos. 2003-57780 and 2001-264110 in an aqueous coating solution is preferred viewed from the standpoint of capacity in static control, stability of the coating surface state and sliding facility. The fluorocarbon surfactant described in JP-A No. 2001-264110 is mostly preferred because of high capacity in static control and that it needs small amount to use.

According to the invention, the fluorocarbon surfactant can be used on either side of image forming layer surface side or back layer surface side, but is preferred to use on the both sides. Further, it is particularly preferred to use in combination with electrically conductive layer including metal oxides described below. In this case the amount of the fluorocarbon surfactant on the side of the electrically conductive layer can be reduced or removed.

The addition amount of the fluorocarbon surfactant is preferably in a range of from 0.1 $mg/m^2$ to 100 $mg/m^2$ on each surface side of image forming layer and back layer, more preferably from 0.3 $mg/m^2$ to 30 $mg/m^2$, and further preferably from 1 $mg/m^2$ to 10 $mg/m^2$. Especially, the fluorocarbon surfactant described in JP-A No. 2001-264110 is effective, and used preferably in a range of from 0.01 $mg/m^2$ to 10 $mg/m^2$, and more preferably from 0.1 $mg/m^2$ to 5 $mg/m^2$.

7) Antistatic Agent

The photothermographic material of the invention preferably contains an electrically conductive layer including metal oxides or electrically conductive polymers. The antistatic layer may serve as an undercoat layer, or a back surface protective layer, and the like, but can also be placed specially. As an electrically conductive material of the antistatic layer, metal oxides having enhanced electric conductivity by the method of introducing oxygen defects or different types of metallic atoms into the metal oxides are preferably for use. Examples of metal oxides are preferably selected from ZnO, $TiO_2$ and $SnO_2$. As the combination of different types of atoms, preferred are ZnO combined with Al, In; $SnO_2$ with Sb, Nb, P, halogen atoms, and the like; $TiO_2$ with Nb, Ta, and the like;

Particularly preferred for use is $SnO_2$ combined with Sb. The addition amount of different types of atoms is preferably in a range of from 0.01 mol% to 30 mol%, and more preferably, in a range of from 0.1 mol % to 10 mol %. The shape of the metal oxides can include, for example, spherical, needle-like, or plate-like shape. The needle-like particles, with the rate of (the major axis)/(the minor axis) is more than 2.0, and more preferably, 3.0 to 50, is preferred viewed from the standpoint of the electric conductivity effect. The metal oxides is used preferably in a range from 1 $mg/m^2$ to 1000 $mg/m^2$, more preferably from 10 $mg/m^2$ to 500 $mg/m^2$, and further preferably from 20 $mg/m^2$ to 200 $mg/m^2$.

The antistatic layer can be laid on either side of the image forming layer surface side or the back layer surface side, it is preferred to set between the support and the back layer.

Examples of the antistatic layer in the invention include described in JP-A Nos. 11-65021, 56-143430, 56-143431, 58-62646, and 56-120519, and in paragraph Nos. 0040 to 0051 of JP-A No. 11-84573, U.S. Pat. No. 5,575,957, and in paragraph Nos. 0078 to 0084 of JP-A No. 11-223898.

8) Support

As the transparent support, favorably used is polyester, particularly, polyethylene terephthalate, which is subjected to heat treatment in the temperature range of from 130° C. to 185° C. in order to relax the internal strain caused by biaxial stretching and remaining inside the film, and to remove strain ascribed to heat shrinkage generated during thermal development. In the case of a photothermographic material for medical use, the transparent support may be colored with a blue dye (for instance, dye-1 described in the example of JP-A No. 8-240877), or may be uncolored. As to the support, it is preferred to apply undercoating technology, such as water-soluble polyester described in JP-A No. 11-84574, a styrene-butadiene copolymer described in JP-A No. 10-186565, a vinylidene chloride copolymer described in JP-A No. 2000-39684 and in paragraph Nos. 0063 to 0080 of Japanese Patent Application No. 11-106881, and the like. The moisture content of the support is preferably 0.5% by weight or less when coating for image forming layer and back layer is conducted on the support.

9) Other Additives

Furthermore, antioxidant, stabilizing agent, plasticizer, UV absorbent, or a coating aid may be added to the photothermographic material. Each of the additives is added to either of the image forming layer or the non-photosensitive layer. Reference can be made to WO No. 98/36322, EP-A No. 803764A1, JP-A Nos. 10-186567 and 10-18568, and the like.

10) Coating Method

The photothermographic material of the invention may be coated by any method. More specifically, various types of coating operations including extrusion coating, slide coating, curtain coating, immersion coating, knife coating, flow coating, or an extrusion coating using the type of hopper described in U.S. Pat. No. 2,681,294 are used. Preferably used is extrusion coating or slide coating described in pages 399 to 536 of Stephen F. Kistler and Petert M. Shweizer, "LIQUID FILM COATING" (Chapman & Hall, 1997), and most preferably used is slide coating. Example of the shape of the slide coater for use in slide coating is shown in FIG. 11b.1, page 427, of the same literature. If desired, two or more layers can be coated simultaneously by the method described in pages 399 to 536 of the same literature, or by the method described in U.S. Pat. No. 2,761,791 and British Patent No. 837095. Particularly preferred in the invention is the method described in JP-A Nos. 2001-194748, 2002-153808, 2002-153803, and 2002-182333.

The coating solution for the layer containing organic silver salt in the invention is preferably a so-called thixotropic fluid. For the details of this technology, reference can be made to JP-A No. 11-52509. Viscosity of the coating solution for the layer containing organic silver salt in the invention at a shear velocity of $0.1S^{-1}$ is preferably from 400 mpa·s to 100,000 mpa·s, and more preferably, from 500 mPa·s to 20,000 mpa·s. At a shear velocity of $1000S^{-1}$, the viscosity is preferably from 1 mpa·s to 200 mpa·s, and more preferably, from 5 mpa·s to 80 mPa·s.

In the case of mixing two types of liquids on preparing the coating solution of the invention, known in-line mixer and in-plant mixer can be used favorably. Preferred in-line mixer of the invention is described in JP-A No. 2002-85948, and the in-plant mixer is described in JP-A No. 2002-90940.

The coating solution of the invention is preferably subjected to defoaming treatment to maintain the coated surface in a fine state. Preferred defoaming treatment method in the invention is described in JP-A No. 2002-66431.

In the case of applying the coating solution of the invention to the support, it is preferred to perform diselectrification in order to prevent the adhesion of dust, particulates, and the like due to charge up. Preferred example of the method of diselectrification for use in the invention is described in JP-A No. 2002-143747.

Since a non-setting coating solution is used for the image forming layer in the invention, it is important to precisely control the drying wind and the drying temperature. Preferred drying method for use in the invention is described in detail in JP-A Nos. 2001-194749 and 2002-139814.

In order to improve the film-forming properties in the photothermographic material of the invention, it is preferred to apply a heat treatment immediately after coating and drying. The temperature of the heat treatment is preferably in a range of from 60° C. to 100° C. at the film surface, and time period for heating is preferably in a range of from 1 second to 60 seconds. More preferably, heating is performed in a temperature range of from 70° C. to 90° C. at the film surface, and the time period for heating is from 2 seconds to 10 seconds. A preferred method of heat treatment for the invention is described in JP-A No. 2002-107872.

Furthermore, the producing methods described in JP-A Nos. 2002-156728 and 2002-182333 are favorably used in the invention in order to stably and continuously produce the photothermographic material of the invention.

The photothermographic material is preferably of mono-sheet type (i.e., a type which can form image on the photothermographic material without using other sheets such as an image-receiving material).

11) Wrapping Material

In order to suppress fluctuation from occurring on the photographic property during a preservation of the invention before thermal development, or in order to improve curling or winding tendencies when the photothermographic material is manufactured in a roll state, it is preferred that a wrapping material having low oxygen transmittance and/or vapor transmittance is used. Preferably, oxygen transmittance is 50 $mL \cdot atm^{-1}m^{-2}day^{-1}$ or lower at 25° C., more preferably, 10 $mL \cdot atm^{-1}m^{-2}day^{-1}$ or lower, and further preferably, 1.0 $mL \cdot atm^{-1}m^{-2}day^{-1}$ or lower. Preferably, vapor transmittance is 10 $g \cdot atm^{-1}m^{-2}day^{-1}$ or lower, more preferably, 5 $g \cdot atm^{-1}m^{-2}day^{-1}$ or lower, and further preferably, 1 $g \cdot atm^{-1}m^{-2}day^{-1}$ or lower.

As specific examples of a wrapping material having low oxygen transmittance and/or vapor transmittance, reference can be made to, for instance, the wrapping material described in JP-A Nos. 8-254793 and 2000-206653.

12) Other Applicable Techniques

Techniques which can be used for the photothermographic material of the invention also include those in EP-A No. 803764A1, EP-A No. 883022A1, WO No. 98/36322, JP-A Nos. 56-62648, 58-62644, JP-A Nos. 09-43766, 09-281637, 09-297367, 09-304869, 09-311405, 09-329865, 10-10669, 10-62899, 10-69023, 10-186568, 10-90823, 10-171063, 10-186565, 10-186567, 10-186569 to 10-186572, 10-197974, 10-197982, 10-197983, 10-197985 to 10-197987, 10-207001, 10-207004, 10-221807, 10-282601, 10-288823, 10-288824, 10-307365, 10-312038, 10-339934, 11-7100, 11-15105, 11-24200, 11-24201, 11-30832, 11-84574, 11-65021, 11-109547, 11-125880, 11-129629, 11-133536 to 11-133539, 11-133542, 11-133543, 11-223898, 11-352627, 11-305377, 11-305378, 11-305384, 11-305380, 11-316435, 11-327076, 11-338096, 11-338098, 11-338099, 11-343420, JP-A Nos. 2000-187298, 2000-10229, 2000-47345, 2000-206642, 2000-98530, 2000-98531, 2000-112059, 2000-112060, 2000-112104, 2000-112064 and 2000-171936.

(Image Forming Method)

1) Exposure

As Laser beam according to the invention, He—Ne laser of red through infrared emission, red laser diode, or $Ar^+$, He—Ne, He—Cd laser of blue through green emission, blue laser diode are used. Preferred laser is red to infrared laser diode and the peak wavelength of laser beam is 600 nm to 900 nm, preferably 620 nm to 850 nm. In recent years, development has been made particularly on a light source module with an SHG (a second harmonic generator) and a laser diode integrated into a single piece whereby a laser output apparatus in a short wavelength region has come into the limelight. A blue laser diode enables high definition image recording and makes it possible to obtain an increase in recording density and a stable output over a long lifetime, which results in expectation of an expanded demand in the future. The peak wavelength of blue laser beam is 300 nm to 500 nm, preferably 400 nm to 500 nm.

Laser beam which oscillates in a longitudinal multiple modulation by a method such as high frequency superposition is also preferably employed.

2) Thermal Development

Although any method may be used for this thermal development process, development of the photothermographic material of the invention is usually performed by elevating the temperature of the photothermographic material exposed imagewise. The temperature for development is preferably 80° C. to 250° C., more preferably 100° C. to 140° C., and further preferably 110° C. to 130° C. Time period for development is preferably 1 second to 60 seconds, more preferably 3 seconds to 30 seconds, and further preferably 5 seconds to 25 seconds.

As for the process for thermal development, either drum type heaters or plate type heaters may be used. However, plate type heater processes are more preferred. Preferable process for thermal development by a plate type heater is a process described in JP-A No. 11-133572, which discloses a thermal developing device in which a visible image is obtained by bringing a photothermographic material with a formed latent image into contact with a heating means at a thermal development region, wherein the heating means comprises a plate heater, and plurality of pressing rollers are oppositely provided along one surface of the plate heater, the thermal developing device is characterized in that thermal development is performed by passing the photothermographic material between the pressing rollers and the plate heater. It is preferred that the plate heater is divided into 2 to 6 portions, with the leading end having the lower temperature by 1° C. to 10° C. For example, 4 sets of plate heaters which can be independently subjected to the temperature control are used, and are controlled so that they respectively become 112° C., 119° C., 121° C., and 120° C. Such a process is also described in JP-A NO. 54-30032, which allows for excluding moisture and organic solvents included in the photothermographic material out of the system, and also allows for suppressing the change of shapes of the support of the photothermographic material upon rapid heating the photothermographic material.

It is preferable that the heater is more stably controlled, and top part of one sheet of the photothermographic material is exposed and thermal development of the exposed portion is started before exposure of the end part of the sheet has completed, for downsizing the thermal developing apparatus and for shortening the time period for thermal development.

Preferred imager capable of rapid processing for use in the invention is described in, for example, JP-A Nos. 2002-289804 and 2002-287668.

3)System

Examples of a medical laser imager equipped with a light exposing portion and a thermal developing portion include Fuji Medical Dry Laser Imager FM-DP L and DRYPIX 7000. In connection with FM-DP L, description is found in Fuji Medical Review No. 8, pages 39 to 55. It goes without mentioning that those techniques may be applied as the laser imager for the photothermographic material of the invention. In addition, the present photothermographic material can be also applied as a photothermographic material for the laser imager used in "AD network" which was proposed by Fuji Film Medical Co., Ltd. as a network system accommodated to DICOM standard.

(Application of the Invention)

The image forming method in which the photothermographic material of the invention is used is preferably employed as image forming methods for photothermographic materials for use in medical imaging, photothermographic materials for use in industrial photographs, photothermographic materials for use in graphic arts, as well as for COM, through forming black and white images by silver imaging.

EXAMPLES

The present invention is specifically explained by way of Examples below, which should not be construed as limiting the invention thereto.

Example 1

Preparation of PET Support (1) Film Manufacturing

PET having IV (intrinsic viscosity) of 0.66 (measured in phenol/tetrachloroethane=6/4 (weight ratio) at 25° C.) was obtained according to a conventional manner using terephthalic acid and ethylene glycol. The product was pelletized, dried at 130° C. for 4 hours, melted at 300° C. Thereafter, the mixture was extruded from a T-die and rapidly cooled to form a non-tentered film.

The film was stretched along the longitudinal direction by 3.3 times using rollers of different peripheral speeds, and then stretched along the transverse direction by 4.5 times using a tenter machine. The temperatures used for these operations were 110° C. and 130° C., respectively. Then, the film was subjected to thermal fixation at 240° C. for 20 seconds, and relaxed by 4% along the transverse direction at the same temperature. Thereafter, the chucking part was slit off, and both edges of the film were knurled. Then the film was rolled up at the tension of 4 kg/cm$^2$ to obtain a roll having the thickness of 175 μm.

(2) Surface Corona Discharge Treatment

Both surfaces of the support were treated at room temperature at 20 m/minute using Solid State Corona Discharge Treatment Machine Model 6KVA manufactured by Piller GmbH. It was proven that treatment of 0.375 kV·A·minute/m$^2$ was executed, judging from the readings of current and voltage on that occasion. The frequency upon this treatment was 9.6 kHz, and the gap clearance between the electrode and dielectric roll was 1.6 mm.

(3) Undercoating

| 1) Preparation of Coating Solution for Undercoat Layer | |
|---|---|
| **Formula (1) (for undercoat layer on the image forming layer side)** | |
| Pesresin A-520 manufactured by Takamatsu Oil & Fat Co., Ltd. (30% by weight solution) | 59 g |
| Polyethyleneglycol monononylphenylether (average ethylene oxide number = 8.5) 10% by weight solution | 5.4 g |
| MP-1000 manufactured by Soken Chemical & Engineering Co., Ltd. (polymer fine particle, mean particle diameter of 0.4 μm) | 0.91 g |
| Distilled water | 935 mL |
| **Formula (2) (for first layer on the back surface)** | |
| Styrene-butadiene copolymer latex (solid content of 40% by weight, styrene/butadiene weight ratio = 68/32) | 158 g |
| Sodium salt of 2,4-dichloro-6-hydroxy-S-triazine (8% by weight aqueous solution) | 20 g |
| 1% by weight aqueous solution of sodium laurylbenzenesulfonate | 10 mL |
| Distilled water | 854 mL |
| **Formula (3) (for second layer on the back surface)** | |
| $SnO_2$/SbO (9/1 weight ratio, mean particle diameter of 0.038 μm, 17% by weight dispersion) | 84 g |
| Gelatin (10% by weight aqueous solution) | 89.2 g |
| METOLOSE TC-5 manufactured by Shin-Etsu Chemical Co., Ltd. (2% by weight aqueous solution) | 8.6 g |
| MP-1000 manufactured by Soken Chemical & Engineering Co., Ltd | 0.01 g |
| 1% by weight aqueous solution of sodium dodecylbenzenesulfonate | 10 mL |
| NaOH (1% by weight) | 6 mL |
| Proxel (manufactured by Imperial Chemical Industries PLC) | 1 mL |
| Distilled water | 805 mL |

2) Undercoating

Both surfaces of the biaxially tentered polyethylene terephthalate support having the thickness of 175 μm were subjected to the corona discharge treatment as described above. Thereafter, the aforementioned formula (1) of the coating solution for the undercoat was coated on one surface (image forming layer side) with a wire bar so that the amount of wet coating became 6.6 mL/m$^2$ (per one side), and dried at 180° C. for 5 minutes. Then, the aforementioned formula (2) of the coating solution for the undercoat was coated on the reverse face (back surface) with a wire bar so that the amount of wet coating became 5.7 mL/m$^2$, and dried at 180° C. for 5 minutes. Furthermore, the aforementioned formula (3) of the coating solution for the undercoat was coated on the reverse face (back surface) with a wire bar so that the amount of wet coating became 7.7 mL/m$^2$, and dried at 180° C. for 6 minutes. Thus, an undercoated support was produced.

(Back Layer)

1) Preparations of Coating Solution for Back Layer

<Preparation of Dispersion of Solid Fine Particles (a) of Base Precursor>

To base precursor-1 in an amount of 2.5 kg, and 300 g of a surfactant (trade name: DEMOL N, manufactured by Kao Corporation), 800 g of diphenyl sulfone and 1.0 g of benzoisothiazolinone sodium salt, was added distilled water to give the total amount of 8.0 kg and mixed. The mixed liquid was subjected to beads dispersion using a horizontal sand mill (UVM-2: manufactured by AIMEX Co., Ltd.). Process for dispersion included feeding the mixed liquid to UVM-2 packed with zirconia beads having a mean particle diameter of 0.5 mm with a diaphragm pump, followed by the dispersion at the inner pressure of 50 hPa or higher until desired mean particle diameter could be achieved.

The dispersion was continued until the ratio of the optical density at 450 nm and the optical density at 650 nm for the spectral absorption of the dispersion ($D_{450}$/ $D_{650}$) became 3.0 upon spectral absorption measurement. Thus resulting dispersion was diluted with distilled water so that the concentration of the base precursor became 25% by weight, and filtrated (with a polypropylene filter having a mean fine pore diameter of 3 μm) for eliminating dust to put into practical use.

<Preparation of Dispersion of Solid Fine Particle of Dye>

Cyanine dye-1 in an amount of 6.0 kg, and 3.0 kg of sodium p-dodecylbenzenesulfonate, 0.6 kg of DEMOL SNB (a surfactant manufactured by Kao Corporation), and 0.15 kg of a defoaming agent (trade name: SURFYNOL 104E, manufactured by Nissin Chemical Industry Co., Ltd.) were mixed with distilled water to give the total liquid amount of 60 kg. The mixed liquid was subjected to dispersion with 0.5 mm zirconia beads using a horizontal sand mill (UVM-2: manufactured by AIMEX Co., Ltd.).

The dispersion was dispersed until the ratio of the optical density at 650 nm and the optical density at 750 nm for the spectral absorption of the dispersion ($D_{650}$/$D_{750}$) became 5.0 or more upon spectral absorption measurement. Thus resulting dispersion was diluted with distilled water so that the concentration of the cyanine dye became 6% by weight, and filtrated with a filter (mean fine pore diameter: 1 μm) for eliminating dust to put into practical use.

<Preparation of Coating Solution for Antihalation Layer>

A vessel was kept at 40° C., and thereto were added 40 g of gelatin, 20 g of monodispersed polymethyl methacrylate fine particles (mean particle size of 8 μm, standard deviation of particle diameter of 0.4), 0.1 g of benzoisothiazolinone and 490 mL of water to allow gelatin to be dissolved. Additionally, 2.3 mL of a 1 mol/L aqueous sodium hydroxide solution, 40 g of the aforementioned dispersion of the solid fine particle of the dye, 90 g of the aforementioned dispersion of the solid fine particles (a) of the base precursor, 12 mL of a 3% by weight aqueous solution of sodium polystyrenesulfonate, and 180 g of a 10% by weight solution of SBR latex were admixed. Just prior to the coating, 80 mL of a 4% by weight aqueous solution of N,N-ethylenebis (vinylsulfone acetamide) was admixed to give a coating solution for the antihalation layer.

<Preparation of Coating Solution for Back Surface Protective Layer>

A vessel was kept at 40° C., and thereto were added 40 g of gelatin, 35 mg of benzoisothiazolinone and 840 mL of water to allow gelatin to be dissolved. Additionally, 5.8 mL of a 1 mol/L aqueous sodium hydroxide solution, 5 g of a 10% by weight emulsion of liquid paraffin, 5 g of a 10% by weight emulsion of trimethylolpropane triisostearate, 10 mL of a 5% by weight aqueous solution of di(2-ethylhexyl) sodium sulfosuccinate, 20 mL of a 3% by weight aqueous solution of sodium polystyrenesulfonate, 2.4 mL of a 2% by weight solution of a fluorocarbon surfactant (F-1), 2.4 mL of a 2% by weight solution of another fluorocarbon surfactant (F-2), and 32 g of a 19% by weight solution of methyl methacrylate/styrene/butyl acrylate/hydroxyethyl methacrylate/acrylic acid copolymer (weight ratio of the copolymerization of 57/8/28/5/2) latex were admixed. Just prior to the coating, 25 mL of a 4% by weight aqueous solution of N,N-ethylenebis(vinylsulfone acetamide) was admixed to give a coating solution for the back surface protective layer.

2) Coating of Back Layer

The back surface side of the undercoated support as described above was subjected to simultaneous double coating so that the coating solution for the antihalation layer gave the amount of coated gelatin of 0.52 g/m$^2$, and so that the coating solution for the back surface protective layer gave the amount of coated gelatin of 1.7 g/m$^2$, followed by drying to produce a back layer.

Base precursor-1

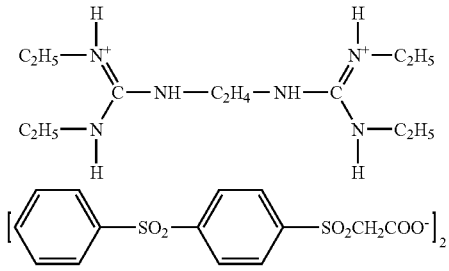

Cyanine dye-1

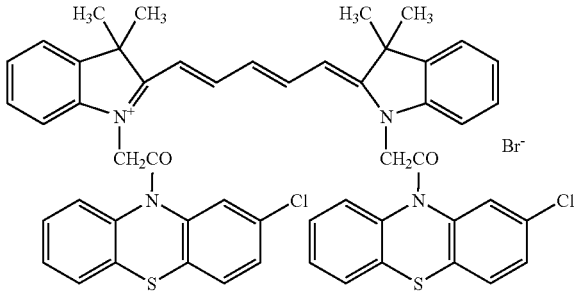

(Image Forming Layer, Intermediate Layer, and Surface Protective Layer)

1. Preparation of Materials for Coating

1) Silver Halide Emulsion

<<Preparation of Silver Halide Emulsion-1>>

To 1421 mL of distilled water was added 3.1 mL of a 1% by weight potassium bromide solution. Further, a liquid added with 3.5 mL of 0.5 mol/L sulfuric acid and 31.7 g of phthalated gelatin was kept at 30° C. while stirring in a stainless steel reaction vessel, and thereto were added total amount of: solution A prepared through diluting 22.22 g of silver nitrate by adding distilled water to give the volume of 95.4 mL; and solution B prepared through diluting 15.3 g of potassium bromide and 0.8 g of potassium iodide with distilled water to give the volume of 97.4 mL, over 45 seconds at a constant flow rate. Thereafter, 10 mL of a 3.5% by weight aqueous solution of hydrogen peroxide was added thereto, and 10.8 mL of a 10% by weight aqueous solution of benzimidazole was further added. Moreover, a solution C prepared through diluting 51.86 g of silver nitrate by adding distilled water to give the volume of 317.5 mL and a solution D prepared through diluting 44.2 g of potassium bromide and 2.2 g of potassium iodide with distilled water to give the volume of 400 mL were added. A controlled double jet method was executed through adding total amount of the solution C at a constant flow rate over 20 minutes, accompanied by adding the solution D while maintaining the pAg at 8.1. Potassium hexachloroiridate (III) was added in its entirely to give $1\times10^{-4}$ mol per 1 mol of silver, at 10 minutes post initiation of the addition of the solution C and the solution D. Moreover, at 5 seconds after completing the addition of the solution C, a potassium hexacyanoferrate (II) in an aqueous solution was added in its entirety to give $3\times10^{-4}$ mol per 1 mol of silver. The mixture was adjusted to the pH of 3.8 with 0.5 mol/L sulfuric acid. After stopping stirring, the mixture was subjected to precipitation/desalting/water washing steps. The mixture was adjusted to the pH of 5.9 with 1 mol/L sodium hydroxide to produce a silver halide dispersion having the pAg of 8.0.

The above-described silver halide dispersion was kept at 38° C. with stirring, and thereto was added 5 mL of a 0.34% by weight methanol solution of 1,2-benzoisothiazoline-3-one, followed by elevating the temperature to 47° C. at 40 minutes thereafter. At 20 minutes after elevating the temperature, sodium benzene thiosulfonate in a methanol solution was added at $7.6\times10^{-5}$ mol per 1 mol of silver. At additional 5 minutes later, a tellurium sensitizer C in a methanol solution was added at $2.9\times10^{-4}$ mol per 1 mol of silver and subjected to ripening for 91 minutes. Thereafter, a methanol solution of a spectral sensitizing dye A and a spectral sensitizing dye B with a molar ratio of 3:1 was added thereto at $1.2\times10^{-3}$ mol in total of the spectral sensitizing dye A and B per 1 mol of silver. At 1 minute later, 1.3 mL of a 0.8% by weight methanol solution of N,N'-dihydroxy-N",N"-diethylmelamine was added thereto, and at additional 4 minutes thereafter, 5-methyl-2-mercaptobenzimidazole in a methanol solution at $4.8\times10^{-3}$ mol per 1 mol of silver, 1-phenyl-2-heptyl-5-nercapto-1,3,4-triazole in a methanol solution at $5.4\times10^{-3}$ mol per 1 mol of silver, and 1-(3-methylureidophenyl)-5-mercaptotetrazole in an aqueous solution at $8.5\times10^{-3}$ mol per 1 mol of silver were added to produce a silver halide emulsion-1.

Grains in thus prepared silver halide emulsion were silver iodobromide grains having a mean equivalent spherical diameter of 0.042 μm, a variation coefficient of an equivalent spherical diameter distribution of 20%, which uniformly include iodine at 3.5 mol %. Grain size and the like were determined from the average of 1000 grains using an electron microscope. The {100} face ratio of these grains was found to be 80% using a Kubelka-Munk method.

<<Preparation of Silver Halide Emulsion-2>>

Preparation of silver halide emulsion-2 was conducted in a similar manner to the process in the preparation of the silver halide emulsion-1 except that: the temperature of the liquid upon the grain forming process was altered from 30° C. to 47° C.; the solution B was changed to that prepared through diluting 15.9 g of potassium bromide with distilled water to give the volume of 97.4 mL; the solution D was changed to that prepared through diluting 45.8 g of potassium bromide with distilled water to give the volume of 400 mL; time period for adding the solution C was changed to 30 minutes; and potassium hexacyanoferrate (II) was deleted. The precipitation/ desalting/water washing/dispersion were carried out similarly to the silver halide emulsion-1. Furthermore, the spectral sensitization, chemical sensitization, and addition of 5-methyl-2-mercaptobenzimidazole and 1-phenyl-2-heptyl-5-mercapto-1,3,4-triazole was executed similarly to the emulsion-1 except that: the amount of the tellurium sensitizer C to be added was changed to $1.1\times10^{-4}$ mol per 1 mol of silver; the amount of the methanol solution of the spectral sensitizing dye A and a spectral sensitizing dye B with a molar ratio of 3:1 to be added was changed to $7.0\times10^{-4}$ mol in total of the spectral sensitizing dye A and the spectral sensitizing dye B per 1 mol of silver; the addition of 1-phenyl-2-heptyl-5-mercapto-1,3,4-triazole was changed to give $3.3\times10^{-3}$ mol per 1 mol of silver; and the addition of 1-(3-methylureidophenyl)-5-mercaptotetrazole was changed to give $4.7\times10^{-3}$ mol per 1 mol of silver, to produce silver halide emulsion-2. The grains in the silver halide emulsion-2 were pure cubic silver bromide grains having a mean equivalent spherical diameter of 0.080 μm and a variation coefficient of an equivalent spherical diameter distribution of 20%.

<<Preparation of Silver Halide Emulsion-3>>

Preparation of silver halide emulsion-3 was conducted in a similar manner to the process in the preparation of the silver halide emulsion-1 except that the temperature of the liquid upon the grain forming process was altered from 30° C. to 27° C. In addition, the precipitation/desalting/water washing/dispersion were carried out similarly to the silver halide emulsion-1. Silver halide emulsion-3 was obtained similarly to the emulsion-1 except that: the addition of the methanol solution of the spectral sensitizing dye A and the spectral sensitizing dye B was changed to the solid dispersion (aqueous gelatin solution) at a molar ratio of 1:1 with the amount to be added being $6.0\times10^{-3}$ mol in total of the spectral sensitizing dye A and spectral sensitizing dye B per 1 mol of silver; the amount of the tellurium sensitizer C to be added was changed to $5.2\times10^{-4}$ mol per 1 mol of silver; and bromoauric acid at $5\times10^{-4}$ mol per 1 mol of silver and potassium thiocyanate at $2\times10^{-3}$ mol per 1 mol of silver were added at 3 minutes following the addition of the tellurium sensitizer. The grains in the silver halide emulsion-3 were silver iodide bromide grains having a mean equivalent spherical diameter of 0.034 μm and a variation coefficient of an equivalent spherical diameter distribution of 20%, which uniformly include iodine at 3.5 mol %.

<<Preparation of Mixed Emulsion A for Coating Solution>>

The silver halide emulsion-1 at 70% by weight, the silver halide emulsion-2 at 15% by weight, and the silver halide emulsion-3 at 15% by weight were dissolved, and thereto was added benzothiazolium iodide in a 1% by weight aqueous solution to give $7\times10^{-3}$ mol per 1 mol of silver. Further, water was added thereto to give the content of silver of 38.2 g per 1 kg of the mixed emulsion for a coating solution, and 1-(3-methylureidophenyl)-5-mercaptotetrazole was added to give 0.34 g per 1 kg of the mixed emulsion for a coating solution.

Further, as "a compound that can be one-electron-oxidized to provide a one-electron oxidation product, which releases one or more electrons", the compounds Nos. 2, 20, and 26 were added respectively in an amount of $2\times10^{-3}$ mol per 1 mol of silver contained in silver halide.

2) Preparations of Dispersion of Silver Salt of Fatty Acid

<Preparation of Recrystallized Behenic Acid>

Behenic acid manufactured by Henkel Co. (trade name: Edenor C22-85R) in an amount of 100 kg was admixed with 1200 kg of isopropyl alcohol, and dissolved at 50° C. The mixture was filtrated through a 10 μm filter, and cooled to 30° C. to allow recrystallization. Cooling speed for the recrystallization was controlled to be 3° C./hour. The resulting crystal was subjected to centrifugal filtration, and washing was performed with 100 kg of isopropyl alcohol. Thereafter, the crystal was dried. The resulting crystal was esterified, and subjected to GC-FID analysis to give the results of the content of behenic acid being 96 mol %, lignoceric acid 2 mol %, and arachidic acid 2 mol %. In addition, erucic acid was included at 0.001 mol %.

<Preparation of Dispersion of Silver Salt of Fatty Acid>

88 kg of the recrystallized behenic acid, 422 L of distilled water, 49.2 L of 5 mol/L sodium hydroxide aqueous solution, 120 L of t-butyl alcohol were admixed, and subjected to a reaction with stirring at 75° C. for one hour to give a solution of sodium behenate. Separately, 206.2 L of an aqueous solution of 40.4 kg of silver nitrate (pH 4.0) was provided, and kept at a temperature of 10° C. A reaction vessel charged with 635 L of distilled water and 30 L of t-butyl alcohol was kept at 30° C., and thereto were added the total amount of the solution of sodium behenate and the total amount of the aqueous silver nitrate solution with sufficient stirring at a constant flow rate over 93 minutes and 15 seconds, and 90 minutes, respectively. Upon this operation, during first 11 minutes following the initiation of adding the aqueous silver nitrate solution, the added material was restricted to the aqueous silver nitrate solution alone. The addition of the solution of sodium behenate was thereafter started, and during 14 minutes and 15 seconds following the completion of adding the aqueous silver nitrate solution, the added material was restricted to the solution of sodium behenate alone. The temperature inside of the reaction vessel was then set to be 30° C., and the temperature outside was controlled so that the liquid temperature could be kept constant. In addition, the temperature of a pipeline for the addition system of the solution of sodium behenate was kept constant by circulation of warm water outside of a double wall pipe, so that the temperature of the liquid at an outlet in the leading edge of the nozzle for addition was adjusted to be 75° C. Further, the temperature of a pipeline for the addition system of the aqueous silver nitrate solution was kept constant by circulation of cool water outside of a double wall pipe. Position at which the solution of sodium behenate was added and the position, at which the aqueous silver nitrate solution was added, was arranged symmetrically with a shaft for stirring located at a center. Moreover, both of the positions were adjusted to avoid contact with the reaction liquid.

After completing the addition of the solution of sodium behenate, the mixture was left to stand at the temperature as it was for 20 minutes. The temperature of the mixture was then elevated to 35° C. over 30 minutes followed by ripening for 210 minutes. Immediately after completing the ripening, solid matters were filtered out with centrifugal filtration. The solid matters were washed with water until the electric conductivity of the filtrated water became 30 μS/cm. A silver salt of fatty acid was thus obtained. The resulting solid matters were stored as a wet cake without drying.

When the shape of the resulting particles of the silver behenate was evaluated by an electron micrography, a crystal was revealed having a=0.21 μm, b=0.4 μm and c=0.4 μm on the average value, with a mean aspect ratio of 2.1, and a variation coefficient of an equivalent spherical diameter distribution of 11% (a, b and c are as defined aforementioned.).

To the wet cake corresponding to 260 kg of a dry solid matter content, were added 19.3 kg of polyvinyl alcohol (trade name: PVA-217) and water to give the total amount of 1000 kg. Then, a slurry was obtained from the mixture using a dissolver blade. Additionally, the slurry was subjected to preliminary dispersion with a pipeline mixer (manufactured by MIZUHO Industrial Co., Ltd.: PM-10 type).

Next, a stock liquid after the preliminary dispersion was treated three times using a dispersing machine (trade name: Microfluidizer M-610, manufactured by Microfluidex International Corporation, using Z type Interaction Chamber) with the pressure controlled to be 1150 kg/cm$^2$ to give a dispersion of the silver behenate. For the cooling manipulation, coiled heat exchangers were equipped in front of and behind the interaction chamber respectively, and accordingly, the temperature for the dispersion was set to be 18° C. by regulating the temperature of the cooling medium.

3) Preparations of Reducing Agent Dispersion

<Reducing Agent-1 Dispersion>

To 10 kg of reducing agent-1 (2,2'-methylenebis-(4-ethyl-6-tert-butylphenol)) and 16 kg of a 10% by weight aqueous solution of modified polyvinyl alcohol (manufactured by Kuraray Co., Ltd., Poval MP203) was added 10 kg of water, and thoroughly mixed to give a slurry. This slurry was fed with a diaphragm pump, and was subjected to dispersion with a horizontal sand mill (UVM-2: manufactured by AIMEX Co., Ltd.) packed with zirconia beads having a mean particle diameter of 0.5 mm for 3 hours. Thereafter, 0.2 g of a benzoisothiazolinone sodium salt and water were added thereto, thereby adjusting the concentration of the reducing agent to be 25% by weight. This dispersion was subjected to heat treatment at 60° C. for 5 hours to obtain reducing agent-1 dispersion. Particles of the reducing agent included in the resulting reducing agent dispersion had a median diameter of 0.40 μm, and a maximum particle diameter of 1.4 μm or less. The resultant reducing agent dispersion was subjected to filtration with a polypropylene filter having a pore size of 3.0 μm to remove foreign substances such as dust, and stored.

<Reducing Agent-2 Dispersion>

To 10 kg of reducing agent-2 (6,6'-di-t-butyl-4,4'-dimethyl-2,2'-butylidenediphenol)) and 16 kg of a 10% by weight aqueous solution of modified polyvinyl alcohol (manufactured by Kuraray Co., Ltd., Poval MP203) was added 10 kg of water, and thoroughly mixed to give a slurry. This slurry was fed with a diaphragm pump, and was subjected to dispersion with a horizontal sand mill (UVM-2: manufactured by AIMEX Co., Ltd.) packed with zirconia beads having a mean particle diameter of 0.5 mm for 3 hours and 30 minutes. Thereafter, 0.2 g of a benzoisothiazolinone sodium salt and water were added thereto, thereby adjusting the concentration of the reducing agent to be 25% by weight. This dispersion was warmed at 40° C. for one hour, followed by a subsequent heat treatment at 80° C. for one hour to obtain reducing agent-2 dispersion. Particles of the reducing agent included in the resulting reducing agent-2 dispersion had a median diameter of 0.50 μm, and a maximum particle diameter of 1.6 μm or less. The resultant reducing agent-2 dispersion was subjected to filtration with a polypropylene filter having a pore size of 3.0 μm to remove foreign substances such as dust, and stored.

4) Preparation of Hydrogen Bonding Compound Dispersion

To 10 kg of hydrogen bonding compound-1 (tri(4-t-butylphenyl)phosphineoxide) and 16 kg of a 10% by weight aqueous solution of modified polyvinyl alcohol (manufactured by Kuraray Co., Ltd., Poval MP203) was added 10 kg of water, and thoroughly mixed to give a slurry. This slurry was fed with a diaphragm pump, and was subjected to dispersion with a horizontal sand mill (UVM-2: manufactured by AIMEX Co., Ltd.) packed with zirconia beads having a mean particle diameter of 0.5 mm for 4 hours.

Thereafter, 0.2 g of a benzoisothiazolinone sodium salt and water were added thereto, thereby adjusting the concentration of the hydrogen bonding compound to be 25% by weight. This dispersion was warmed at 40° C. for one hour, followed by a subsequent heat treatment at 80° C. for one hour to obtain hydrogen bonding compound-1 dispersion. Particles of the hydrogen bonding compound included in the resulting hydrogen bonding compound dispersion had a median diameter of 0.45 μm, and a maximum particle diameter of 1.3 μm or less. The resultant hydrogen bonding compound dispersion was subjected to filtration with a polypropylene filter having a pore size of 3.0 μm to remove foreign substances such as dust, and stored.

5) Preparations of Development Accelerator-1 Dispersion

To 10 kg of development accelerator-1 and 20 kg of a 10% by weight aqueous solution of modified polyvinyl alcohol (manufactured by Kuraray Co., Ltd., Poval MP203) was added 10 kg of water, and thoroughly mixed to give a slurry. This slurry was fed with a diaphragm pump, and was subjected to dispersion with a horizontal sand mill (UVM-2: manufactured by AIMEX Co., Ltd.) packed with zirconia beads having a mean particle diameter of 0.5 mm for 3 hours and 30 minuets. Thereafter, 0.2 g of a benzoisothiazolinone sodium salt and water were added thereto, thereby adjusting the concentration of the development accelerator to be 20% by weight. Accordingly, development accelerator-1 dispersion was obtained. Particles of the development accelerator included in the resulting development accelerator dispersion had a median diameter of 0.48 μm, and a maximum particle diameter of 1.4 μm or less. The resultant development accelerator dispersion was subjected to filtration with a polypropylene filter having a pore size of 3.0 μm to remove foreign substances such as dust, and stored.

6) Preparations of Dispersions of Development Accelerator-2 and Color-tone-adjusting Agent-1

Also concerning solid dispersions of development accelerator-2 and color-tone-adjusting agent-1, dispersion was executed in a similar manner to the development accelerator-1, and thus dispersions of 20% by weight and 15% by weight were respectively obtained.

7) Preparations of Organic Polyhalogen Compound Dispersion

<Organic Polyhalogen Compound-1 Dispersion>

10 kg of organic polyhalogen compound-1 (tribromomethane sulfonylbenzene), 10 kg of a 20% by weight aqueous solution of modified polyvinyl alcohol (manufactured by Kuraray Co., Ltd., Poval MP203), 0.4 kg of a 20% by weight aqueous solution of sodium triisopropylnaphthalenesulfonate and 14 kg of water were thoroughly admixed to give a slurry. This slurry was fed with a diaphragm pump, and was subjected to dispersion with a horizontal sand mill (UVM-2: manufactured by AIMEX Co., Ltd.) packed with zirconia beads having a mean particle diameter of 0.5 mm for 5 hours. Thereafter, 0.2 g of a benzoisothiazolinone sodium salt and water were added thereto, thereby adjusting the concentration of the organic polyhalogen compound to be 30% by weight. Accordingly, organic polyhalogen compound-1 dispersion was obtained. Particles of the organic polyhalogen compound included in the resulting organic polyhalogen compound dispersion had a median diameter of 0.41 μm, and a maximum particle diameter of 2.0 μm or less. The resultant organic polyhalogen compound dispersion was subjected to filtration with a polypropylene filter having a pore size of 10.0 μm to remove foreign substances such as dust, and stored.

<Organic Polyhalogen Compound-2 Dispersion>

10 kg of organic polyhalogen compound-2 (N-butyl-3-tribromomethane sulfonylbenzoamide), 20 kg of a 10% by weight aqueous solution of modified polyvinyl alcohol (manufactured by Kuraray Co., Ltd., Poval MP203) and 0.4 kg of a 20% by weight aqueous solution of sodium triisopropylnaphthalenesulfonate were thoroughly admixed to give a slurry. This slurry was fed with a diaphragm pump, and was subjected to dispersion with a horizontal sand mill (UVM-2: manufactured by AIMEX Co., Ltd.) packed with zirconia beads having a mean particle diameter of 0.5 mm for 5 hours. Thereafter, 0.2 g of a benzoisothiazolinone sodium salt and water were added thereto, thereby adjusting the concentration of the organic polyhalogen compound to be 30% by weight. This fluid dispersion was heated at 40° C. for 5 hours to obtain organic polyhalogen compound-2 dispersion. Particles of the organic polyhalogen compound included in the resulting organic polyhalogen compound dispersion had a median diameter of 0.40 μm, and a maximum particle diameter of 1.3 μm or less. The resultant organic polyhalogen compound dispersion was subjected to filtration with a polypropylene filter having a pore size of 3.0 μm to remove foreign substances such as dust, and stored.

8) Preparation of Phthalazine Compound-1 Solution

Modified polyvinyl alcohol MP203 in an amount of 8 kg was dissolved in 174.57 kg of water, and then thereto were added 3.15 kg of a 20% by weight aqueous solution of sodium triisopropylnaphthalenesulfonate and 14.28 kg of a 70% by weight aqueous solution of phthalazine compound-1 (6-isopropyl phthalazine) to prepare a 5% by weight phthalazine compound-1 solution.

9) Preparations of Aqueous Solution of Mercapto Compound

<Aqueous Solution of Mercapto Compound-1>

Mercapto compound-1 (1-3-sulfophenyl)-5-mercaptotetrazole sodium salt) in an amount of 7 g was dissolved in 993 g of water to give a 0.7% by weight aqueous solution.

<Aqueous Solution of Mercapto Compound-2>

Mercapto compound-2 (1-3-methylureidophenyl)-5-mercaptotetrazole) in an amount of 20 g was dissolved in 980 g of water to give a 2.0% by weight aqueous solution.

10) Preparations of Magenta Dye of the Invention and Comparative Magenta Dye

<<Preparation of Pigment-1 Dispersion>>—Comparative

C.I. Pigment Blue 60 in an amount of 64 g and 6.4 g of DEMOL N manufactured by Kao Corporation were added to 250 g of water and thoroughly mixed to give a slurry. Zirconia beads having the mean particle diameter of 0.5 mm were provided in an amount of 800 g, and charged in a vessel with the slurry. Dispersion was performed with a dispersing machine (1/4G sand grinder mill: manufactured by AIMEX Co., Ltd.) for 25 hours. Thereto was added water to adjust so that the concentration of the pigment became 5% by weight to obtain a pigment-1 dispersion. Particles of the pigment included in the resulting pigment dispersion had a mean particle diameter of 0.21 μm.

<<Preparation of Dye Emulsion>>—Comparative

Dye emulsion A1 for comparision was prepared as described below. Comparative dye-1 is an oil-soluble dye, which is compound No. A-24 described in JP-A No. 2000-39685.

| | |
|---|---|
| <Solution 1> | |
| Comparative dye-1 | 10 g |
| High boiling solvent-3 | 20 g |
| High boiling solvent-4 | 20 g |
| High boiling solvent-5 | 35.4 mL |
| Ethyl acetate | 50 mL |
| Sodium dodecylbenzenesulfonate | 3.4 g |
| Emulsifying aid-2 | 1.26 g |
| <Solution 2> | |
| Water | 97.2 g |
| Gelatin | 15.7 g |
| Methyl p-hydroxybenzoate | 0.25 g |
| <Solution 3> | |
| Water | 172.8 mL |

After the solid matter of solution 1 was thoroughly dissolved at 50° C., solution 2 was added and emulsion-dispersed by a homogenizer. Rotation rate was 15,000 r.p.m., and time period for emulsification was timely arranged to get an excellent emulsion. After that, solution 3 was added to obtain dye emulsion A1.

A size of the obtained emulsion was measured by using Nanosizer N4 manufactured by Coulter Co. Ltd. Dye emulsion A1 had a mean size of 150 nm, and was well emusified.

Comparative dye-1

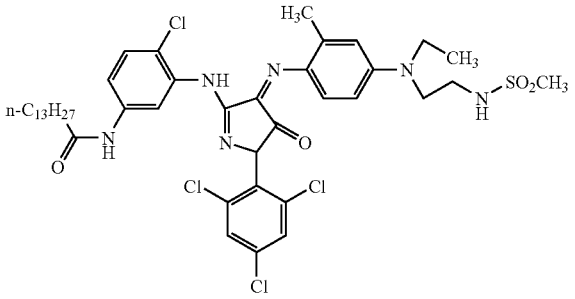

(Compound No. A-24 described in JP-A No. 2000-39685)

High boiling solvent-3

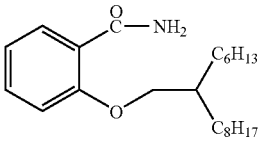

High boiling solvent-4

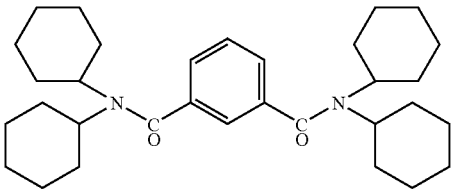

High boiling solvent-5

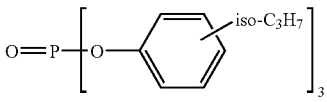

-continued

Emulsifying aid-2

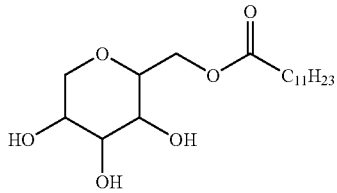

<<Preparation of Solution of Water-soluble Magenta Dye of the Invention>>

5% by weight aqueous solution of water-soluble magenta dye according to the invention was prepared.

11) Preparation of SBR Latex Solution

To a polymerization tank of a gas monomer reaction apparatus (manufactured by Taiatsu Techno Corporation, TAS-2J type), were charged 287 g of distilled water, 7.73 g of a surfactant (Pionin A-43-S (manufactured by TAKEMOTO OIL & FAT CO., LTD.): solid matter content of 48.5% by weight), 14.06 mL of 1 mol/L sodium hydroxide, 0.15 g of ethylenediamine tetraacetate tetrasodium salt, 255 g of styrene, 11.25 g of acrylic acid, and 3.0 g of tert-dodecyl mercaptan, followed by sealing of the reaction vessel and stirring at a stirring rate of 200 rpm. Degassing was conducted with a vacuum pump, followed by repeating nitrogen gas replacement several times. Thereto was injected 108.75 g of 1,3-butadiene, and the inner temperature was elevated to 60° C.

Thereto was added a solution of 1.875 g of ammonium persulfate dissolved in 50 mL of water, and the mixture was stirred for 5 hours as it stands. The temperature was further elevated to 90° C., followed by stirring for 3 hours. After completing the reaction, the inner temperature was lowered to reach to the room temperature, and thereafter the mixture was treated by adding 1 mol/L sodium hydroxide and ammonium hydroxide to give the molar ration of $Na^+$ ion: $NH_4^+$ ion=1:5.3, and thus, the pH of the mixture was adjusted to 8.4. Thereafter, filtration with a polypropylene filter having the pore size of 1.0 μm was conducted to remove foreign substances such as dust followed by storage. Accordingly, SBR latex was obtained in an amount of 774.7 g. Upon the measurement of halogen ion by ion chromatography, concentration of chloride ion was revealed to be 3 ppm. As a result of the measurement of the concentration of the chelating agent by high performance liquid chromatography, it was revealed to be 145 ppm.

The aforementioned latex had a mean particle diameter of 90 nm, Tg of 17° C., solid matter concentration of 44% by weight, the equilibrium moisture content at 25° C. and 60% RH of 0.6% by weight, ionic conductance of 4.80 mS/cm (measurement of the ionic conductance performed using a conductivity meter CM-30S manufactured by Toa Electronics Ltd. for the latex stock solution (44% by weight) at 25° C.).

2. Preparations of Coating Solutions

1) Preparation of Coating Solution for Image Forming Layer

The dispersion of the silver salt of fatty acid obtained as described above in an amount of 1000 g, 135 mL of water, 19 g of the organic polyhalogen compound-1 dispersion, 58 g of the organic polyhalogen compound-2 dispersion, 162 g of the phthalazine compound-1 solution, 1060 g of the SBR latex (Tg: 17° C.) solution, 75 g of the reducing agent-1 dispersion, 75 g of the reducing agent-2 dispersion, the color-tone-adjusting agent-1 dispersion, 106 g of the hydrogen bonding compound-1 dispersion, 4.8 g of the development accelerator-1 dispersion, 4.7 g of the development accelerator-2 dispersion, 9 mL of the mercapto compound-1 aqueous solution, and 27 mL of the mercapto compound-2 aqueous solution were serially added. The coating solution for the image forming layer prepared by adding 118 g of the mixed emulsion A for coating solution thereto followed by thorough mixing just prior to the coating was fed directly to a coating die.

2) Preparation of Coating Solution for Intermediate Layer-1

To 1000 g of polyvinyl alcohol PVA-205 (manufactured by Kuraray Co., Ltd.), 163 g of the pigment-1 dispersion, 27 mL of a 5% by weight aqueous solution of di(2-ethylhexyl) sodium sulfosuccinate and 4200 mL of a 19% by weight solution of methyl methacrylate/styrene/butyl acrylate/hydroxyethyl methacrylate/acrylic acid copolymer (weight ratio of the copolymerization of 57/8/28/5/2) latex, 27 mL of a 5% by weight aqueous solution of aerosol OT (manufactured by American Cyanamid Co.), 135 mL of a 20% by weight aqueous solution of ammonium secondary phthalate was added water to give total amount of 10000 g. The mixture was adjusted with sodium hydroxide to give the pH of 7.5. Accordingly, the coating solution for the intermediate layer was prepared, and was fed to a coating die to provide 8.9 mL/m$^2$.

Viscosity of the coating solution was 58 [mPa·s] which was measured with a B type viscometer at 40° C. (No. 1 rotor, 60 rpm).

3) Preparation of Coating Solution for Intermediate Layer-2

Preparation of coating solution for intermediate layer-2 was conducted in a similar manner to the preparation of coating solution for intermediate layer-1, except that using the dye emulsion for comparision or the aqueous solution of the magenta dye according to the invention as shown in Table 1, instead of using pigment-1 dispersion.

4) Coating Solution for First Layer of Surface Protective Layers

In 840 mL of water were dissolved 100 g of inert gelatin and 10 mg of benzoisothiazolinone, and thereto were added 180 g of a 19% by weight solution of methyl methacrylate/styrene/butyl acrylate/hydroxyethyl methacrylate/acrylic acid copolymer (weight ratio of the copolymerization of 57/8/28/5/2) latex, 46 mL of a 15% by weight methanol solution of phthalic acid and 5.4 mL of a 5% by weight aqueous solution of di(2-ethylhexyl) sodium sulfosuccinate, and were mixed. Immediately before coating, 40 mL of a 4% by weight chrome alum which had been mixed with a static mixer was fed to a coating die so that the amount of the coating solution became 26.1 mL/m$^2$.

Viscosity of the coating solution was 20 [mPa·s] which was measured with a B type viscometer at 40° C. (No. 1 rotor, 60 rpm).

5) Coating Solution for Second Layer of Surface Protective Layers

In 800 mL of water were dissolved 100 g of inert gelatin and 10 mg of benzoisothiazolinone, and thereto were added liquid paraffin emulsion at 8.0 g equivalent to liquid paraffin, 180 g of a 19% by weight solution of methyl methacrylate/styrene/butyl acrylate/hydroxyethyl methacrylate/acrylic acid copolymer (weight ratio of the copolymerization of 57/8/28/5/2) latex, 40 mL of a 15% by weight methanol solution of phthalic acid, 5.5 mL of a 1% by weight solution of a fluorocarbon surfactant (F-1), 5.5 mL of a 1% by weight aqueous solution of another fluorocarbon surfactant (F-2), 28 mL of a 5% by weight aqueous solution of di(2-ethylhexyl) sodium sulfosuccinate, 4 g of polymethyl methacrylate fine particles (mean particle diameter of 0.7 μm) and 21 g of polymethyl methacrylate fine particles (mean particle diameter of 4.5 μm), and were mixed to give a coating solution for the surface protective layer, which was fed to a coating die so that 8.3 mL/m$^2$ could be provided.

Viscosity of the coating solution was 19 [mPa·s] which was measured with a B type viscometer at 40° C. (No. 1 rotor, 60 rpm).

3. Preparations of Photothermographic Material

1) Preparations of Photothermographic Material-101 to -118

Reverse surface of the back surface on which the back layer was coated was subjected to simultaneous overlaying coating by a slide bead coating method in order of the image forming layer, intermediate layer, first layer of the surface protective layers and second layer of the surface protective layers starting from the undercoated face, and thus sample of photothermographic material was produced. In this method, the temperature of the coating solution was adjusted to 31° C. for the image forming layer and intermediate layer, to 36° C. for the first layer of the surface protective layers, and to 37° C. for the second layer of the surface protective layers.

The combination of the back layer and the intermediate layer is shown in Table 1.

TABLE 1

| | Intermediate Layer | | | Condition of Thermal Development | Photographic | Image Storability | | |
|---|---|---|---|---|---|---|---|---|
| Sample No. | Dye No. | Hue Angle (°) | Addition Amount (mg/m$^2$) | Time Period for Thermal Development | Property Residual Color | Discolor Level | Change in Surface Gloss | Note |
| 101 | Pigment-1 | 240 | 8 | 14 | 4 | 4 | 1 | Comparative |
| 102 | Pigment-1 | 240 | 8 | 10 | 2 | 4 | 2 | Comparative |
| 103 | Pigment-1 | 240 | 8 | 8 | 1 | 3 | 2 | Comparative |
| 104 | Emulsion A1 | 325 | 8 | 14 | 4 | 3 | 2 | Comparative |
| 105 | Emulsion A1 | 325 | 8 | 10 | 3 | 3 | 2 | Comparative |
| 106 | Emulsion A1 | 325 | 8 | 8 | 2 | 2 | 3 | Comparative |
| 107 | 1 | 310 | 8 | 14 | 5 | 5 | 5 | Invention |
| 108 | 1 | 310 | 8 | 10 | 4 | 5 | 5 | Invention |

TABLE 1-continued

| Sample No. | Intermediate Layer Dye No. | Intermediate Layer Hue Angle (°) | Intermediate Layer Addition Amount (mg/m$^2$) | Condition of Thermal Development Time Period for Thermal Development | Photographic Property Residual Color | Image Storability Discolor Level | Image Storability Change in Surface Gloss | Note |
|---|---|---|---|---|---|---|---|---|
| 109 | 1 | 310 | 8 | 8 | 3 | 4 | 5 | Invention |
| 110 | 3 | 312 | 8 | 14 | 5 | 5 | 5 | Invention |
| 111 | 3 | 312 | 8 | 10 | 4 | 5 | 5 | Invention |
| 112 | 3 | 312 | 8 | 8 | 3 | 4 | 5 | Invention |
| 113 | 3 | 312 | 4 | 8 | 3 | 4 | 5 | Invention |
| 114 | 3 | 312 | 16 | 8 | 4 | 5 | 5 | Invention |
| 115 | 6 | 308 | 8 | 8 | 4 | 5 | 5 | Invention |
| 116 | 7 | 343 | 8 | 8 | 4 | 5 | 5 | Invention |
| 117 | 15 | 307 | 8 | 8 | 4 | 5 | 5 | Invention |
| 118 | 31 | 309 | 8 | 8 | 4 | 5 | 5 | Invention |

The coating amount of each compound (g/m$^2$) for the image forming layer is as follows.

| | |
|---|---|
| Silver salt of fatty acid | 5.42 |
| Organic polyhalogen compound-1 | 0.12 |
| Organic polyhalogen compound-2 | 0.25 |
| Phthalazine compound-1 | 0.18 |
| SBR latex | 9.70 |
| Reducing agent-1 | 0.40 |
| Reducing agent-2 | 0.40 |
| Color-tone-adjusting agent-1 | 0.006 |
| Hydrogen bonding compound-1 | 0.58 |
| Development accelerator-1 | 0.019 |
| Development accelerator-2 | 0.016 |
| Mercapto compound-1 | 0.002 |
| Mercapto compound-2 | 0.012 |
| Silver halide (on the basis of Ag content) | 0.10 |

Conditions for coating and drying are as follows.

Coating was performed at the speed of 160 m/min. The clearance between the leading end of the coating die and the support was 0.10 mm to 0.30 mm. The pressure in the vacuum chamber set to be lower than atmospheric pressure by 196 Pa to 882 Pa. The support was decharged by ionic wind.

In the subsequent cooling zone, the coating solution was cooled by wind having the dry-bulb temperature of 10° C. to 20° C. Transportation with no contact was carried out, and the coated support was dried with an air of the dry-bulb of 23° C. to 45° C. and the wet-bulb of 15° C. to 21° C. in a helical type contactless drying apparatus.

After drying, moisture conditioning was performed at 25° C. in the humidity of 40% RH to 60% RH. Then, the film surface was heated to be 70° C. to 90° C., and after heating, the film surface was cooled to 25° C.

Thus prepared photothermographic material had the matness of 550 seconds on the image forming layer side surface, and 130 seconds on the back surface as Beck's smoothness. In addition, measurement of the pH of the film surface on the image forming layer surface side gave the result of 6.0.

Chemical structures of the compounds used in Examples of the invention are shown below.

Spectral Sensitizing Dye A

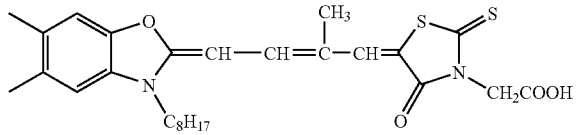

Spectral Sensitizing Dye B

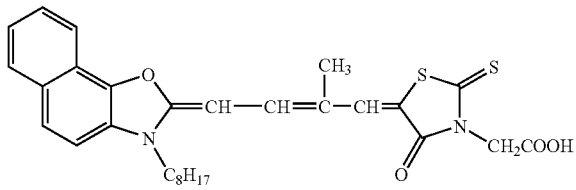

Tellurium Sensitizer C

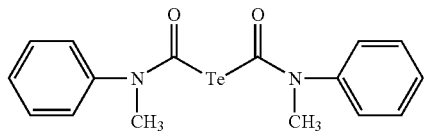

Compound 2 that can be one-electron-oxidized to provide a one-electron oxidation product which releases one or more electrons

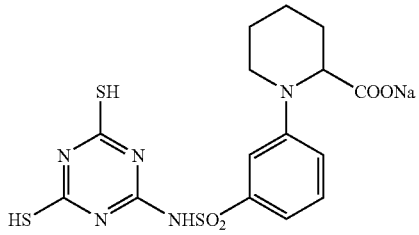

Compound 20 that can be one-electron-oxidized to provide a one-electron oxidation product which releases one or more electrons

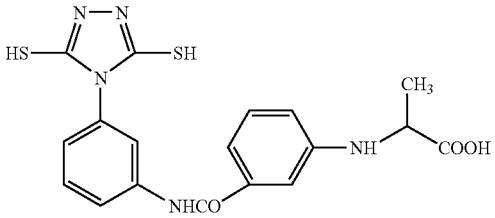

Compound 26 that can be one-electron-oxidized to provide a one-electron oxidation product which releases one or more electrons

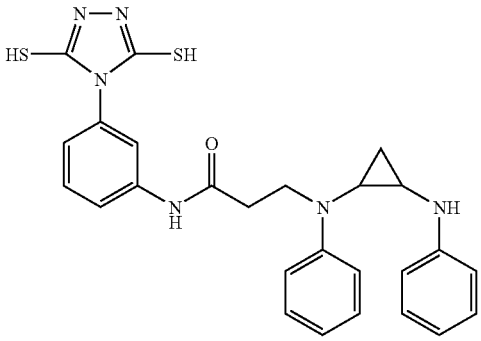

Reducing agent-1

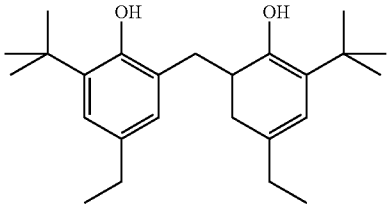

Reducing agent-2

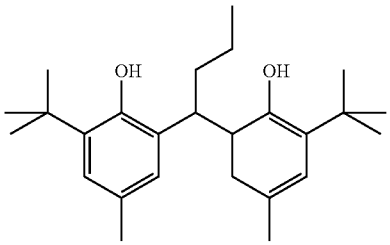

Hydrogen bonding compound-1

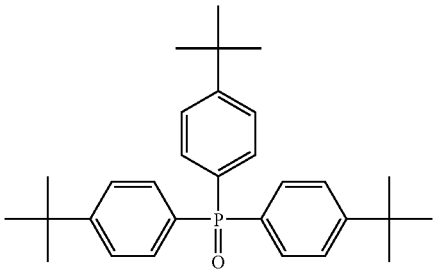

-continued

Organic polyhalogen compound-1

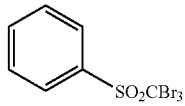

Organic polyhalogen compound-2

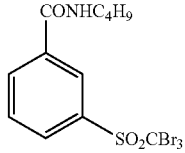

Mercapto compound-1

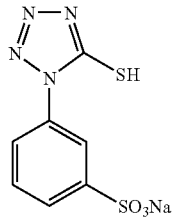

Mercapto compound-2

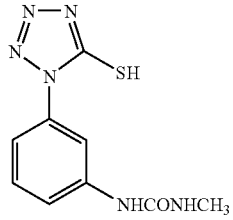

Phthalazine compound-1

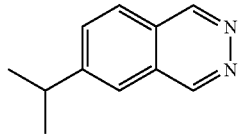

Development accelerator-1

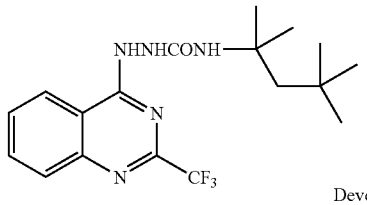

Development accelerator-2

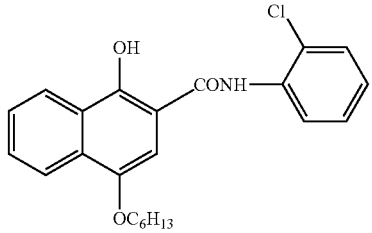

Color-tone-adjusting agent-1

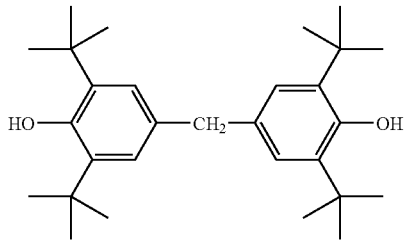

-continued (F-1)

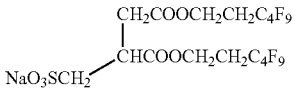

(F-2)

Mixture of

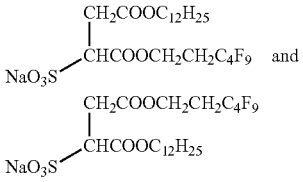

4. Evaluation of Photographic Properties

1) Preparation

The resulting sample was cut into a half-cut size (43 cm in length×35 cm in width), and was wrapped with the following packaging material under an environment of 25° C. and 50% RH, and stored for 2 weeks at an ambient temperature.

(Packaging Material)

A film laminated with PET 10 μm/PE 12 μm/aluminum foil 9 μm/Ny 15 μm/polyethylene 50 μm containing carbon at 3% by weight:

oxygen permeability at 25° C.: 0.02 $mL \cdot atm^{-1}m^{-2}day^{-1}$;

vapor permeability at 25° C.: 0.10 $g \cdot atm^{-1}m^{-2}day^{-1}$.

2) Exposure and Thermal Development

To each sample, imagewise exposure and thermal development (3 panel heaters set to 107° C.-121° C.-121° C.) with Fuji Medical Dry Laser Imager DRYPIX 7000 (equipped with 660 nm laser diode having a maximum output of 50 mW (IIIB)) were performed.

Time period for thermal development was set to be the time shown in Table 1, by changing the line speed during transporting the sample.

Evaluation on an image obtained was performed with a densitometer.

3) Evaluation of Photographic Properties

<Residual Color>

Regarding to the processed samples after thermal development, the coloring of the unexposed part of the obtained sample was evaluated by visual observation and classified into five sensory evaluation criteria as follows,

[5]: excellent level

[1]: unacceptable level for practical use

[3]: allowable level for practical use.

<Image Storability>

Discolor: The processed samples after thermal development were stored for 24 hours while placing the samples on a lighting table of 4,000 Lux used for viewing the medical images. Thereafter, changes in coloring of the unexposed part were evaluated by visual observation and classified into five sensory evaluation criteria as follows,

[5]: excellent level

[1]: unacceptable level for practical use

[3]: allowable level for practical use.

Change in Surface Gloss: Regarding to the processed samples after thermal development, the surface of the image forming layer were placed on the surface of the back layer in close contact, and then they were sealed tightly. The sealed set was stored for one month under an environment of 60° C. and 40% RH. Thereafter, the change in surface gloss was evaluated by visual observation and classified into five sensory evaluation criteria as follows,

[5]: excellent level

[1]: unacceptable level for practical use

[3]: allowable level for practical use.

The obtained results are shown in Table 1.

The photothermographic materials using the compounds of the present invention can attain excellent quality in less residual color, less discoloration and little change in surface gloss.

Example 2

1) Preparations of Coated Sample

Preparations of sample-201 to -222 were conducted in a similar manner to the process in the preparation of sample-109 in Example 1 except that the dye was removed from the intermediate layer and, in stead of that, the dye was added to the image forming layer, surface protective layer, or antihalation layer. The kind of the dye, the addition amount of the dye and the layer in which the dye was added are shown in Table 2.

2) Evaluation of Photographic Properties

Evaluation was performed similarly to Example 1. The results are shown in Table 2.

The photothermographic materials using the compounds of the present invention can attain excellent quality in less residual color, less discoloration and little change in surface gloss.

TABLE 2

| | Image Forming Layer | | First Layer of Surface Protective Layers | | Second Layer of Surface Protective Layers | | Antihalation Layer | | Photographic | Image Storability | | |
|---|---|---|---|---|---|---|---|---|---|---|---|---|
| Sample No. | Dye No. | Addition Amount ($mg/m^2$) | Dye No. | Addition Amount ($mg/m^2$) | Dye No. | Addition Amount ($mg/m^2$) | Dye No. | Addition Amount ($mg/m^2$) | Property Residual Color | Discolor Level | Change in Surface Gloss | Note |
| 201 | A1 | 8 | — | — | — | — | — | — | 2 | 2 | 3 | Comparative |
| 202 | — | — | A1 | 8 | — | — | — | — | 2 | 2 | 3 | Comparative |
| 203 | — | — | — | — | A1 | 8 | — | — | 2 | 2 | 3 | Comparative |
| 204 | 1 | 8 | — | — | — | — | — | — | 3 | 4 | 5 | Invention |
| 205 | — | — | 1 | 8 | — | — | — | — | 3 | 4 | 5 | Invention |

TABLE 2-continued

| Sample No. | Image Forming Layer Dye No. | Image Forming Layer Addition Amount (mg/m$^2$) | First Layer of Surface Protective Layers Dye No. | First Layer of Surface Protective Layers Addition Amount (mg/m$^2$) | Second Layer of Surface Protective Layers Dye No. | Second Layer of Surface Protective Layers Addition Amount (mg/m$^2$) | Antihalation Layer Dye No. | Antihalation Layer Addition Amount (mg/m$^2$) | Photographic Property Residual Color | Image Storability Discolor Level | Image Storability Change in Surface Gloss | Note |
|---|---|---|---|---|---|---|---|---|---|---|---|---|
| 206 | — | — | — | — | 1 | 8 | — | — | 3 | 4 | 5 | Invention |
| 207 | 3 | 8 | — | — | — | — | — | — | 3 | 4 | 5 | Invention |
| 208 | — | — | 3 | 8 | — | — | — | — | 3 | 4 | 5 | Invention |
| 209 | — | — | — | — | 3 | 8 | — | — | 3 | 4 | 5 | Invention |
| 210 | 6 | 8 | — | — | — | — | — | — | 3 | 4 | 5 | Invention |
| 211 | — | — | 6 | 8 | — | — | — | — | 3 | 4 | 5 | Invention |
| 212 | — | — | — | — | 6 | 8 | — | — | 3 | 4 | 5 | Invention |
| 213 | 30 | 8 | — | — | — | — | — | — | 3 | 3 | 4 | Invention |
| 214 | — | — | 30 | 8 | — | — | — | — | 3 | 3 | 4 | Invention |
| 215 | — | — | — | — | 30 | 8 | — | — | 3 | 3 | 4 | Invention |
| 216 | 31 | 8 | — | — | — | — | — | — | 3 | 4 | 5 | Invention |
| 217 | — | — | 31 | 8 | — | — | — | — | 3 | 4 | 5 | Invention |
| 218 | — | — | — | — | 31 | 8 | — | — | 3 | 4 | 5 | Invention |
| 219 | — | — | — | — | — | — | 1 | 8 | 3 | 4 | 5 | Invention |
| 220 | — | — | — | — | — | — | 3 | 8 | 3 | 4 | 5 | Invention |
| 221 | — | — | — | — | — | — | 6 | 8 | 3 | 4 | 5 | Invention |
| 222 | — | — | — | — | — | — | 31 | 8 | 3 | 4 | 5 | Invention |

Example 3

It is an Example where a color-tone-adjusting layer is disposed under the image forming layer, and a water-soluble magenta dye is added to the color-tone-adjusting layer.

1) Preparations of Sample-301 to -308

Preparations of sample-301 to -308 were conducted in a similar manner to the process in the preparation of sample-109 in Example 1, except that the dye was removed from the intermediate layer and, in stead of that, the following color-tone-adjusting layer was set between the image forming layer and the support, and the dye was added to the color-tone-adjusting layer.

(Color-tone-adjusting Layer)

A vessel was kept at 40° C., and thereto were added 40 g of gelatin, 20 g of monodispersed polymethyl methacrylate fine particles (mean particle size of 8 μm, standard deviation of particle diameter of 0.4), 0.1 g of benzoisothiazolinone and 840 mL of water to allow gelatin to be dissolved. Additionally, 2.3 mL of a 1 mol/L aqueous sodium hydroxide solution, the dye shown in Table 3 (the addition amount is shown in Table 3), 12 mL of a 3% by weight aqueous solution of sodium polystyrenesulfonate, and 180 g of a 10% by weight solution of SBR latex were admixed. Just prior to the coating, 80 mL of a 4% by weight aqueous solution of N,N-ethylenebis(vinylsulfone acetamide) was admixed to give a coating solution for the antihalation layer.

2) Evaluation of Photographic Properties

Evaluation was performed similarly to Example 1. The results are shown in Table 3.

The photothermographic materials using the compounds of the present invention can attain excellent quality in less residual color, less discoloration and little change in surface gloss.

What is claimed is:

1. A photothermographic material comprising, on at least one side of a support, an image forming layer comprising at least a photosensitive silver halide, a non-photosensitive organic silver salt, and a reducing agent for the organic silver salt, and at least one non-photosensitive layer, wherein the photothermographic material contains a water-soluble magenta dye represented by the following Formula (III):

Formula (III)

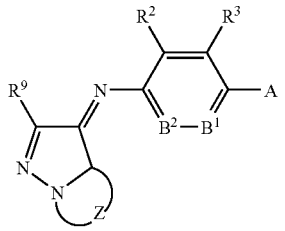

wherein in Formula (III), $R^9$ represents one selected from a hydrogen atom, an aliphatic group, an aromatic group, a heterocyclic group, cyano, —$OR^{11}$, —$SR^{12}$, —$CO_2R^{13}$, —$OCOR^{14}$, —$NR^{15}R^{16}$, —$CONR^{17}R^{18}$, —$SO_2R^{19}$, —$SO_2NR^{20}R^{21}$, —$NR^{22}CONR^{23}R^{24}$, —$NR^{25}CO_2R^{26}$, —$COR^{27}$, —$NR^{28}COR^{29}$, and —$NR^{30}SO_2NR^{31}$, and $R^{11}$, $R^{12}$, $R^{13}$, $R^{14}$, $R^{15}$, $R^{16}$, $R^{17}$, $R^{18}$, $R^{19}$, $R^{20}$, $R^{21}$, $R^{22}$, $R^{23}$, $R^{24}$, $R^{25}$, $R^{26}$, $R^{27}$, $R^{28}$, $R^{29}$, $R^{30}$ and $R^{31}$ each independently represent one selected from a hydrogen atom, an aliphatic group, and an aromatic group; Z represents a group of atoms forming a 5 or 6-membered nitrogen-containing heterocycle, which may be substituted by at least one of an aliphatic group, an aromatic group, a heterocyclic group, cyano, —$OR^{111}$, —$SR^{112}$, —$CO_2R^{113}$, —$OCOR^{114}$, —$NR^{115}R^{116}$, —$CONR^{117}R^{118}$, —$SO_2R^{119}$, —$SO_2NR^{120}R^{121}$, —$NR^{122}CONR^{123}R^{124}$, —$NR^{125}CO_2R^{126}$, —$COR^{127}$, —$NR^{128}COR^{129}$, and —$NR^{130}SO_2NR^{131}$, and this heterocycle may further form a condensed ring with another ring; $R^{111}$, $R^{112}$, $R^{113}$, $R^{114}$, $R^{115}$, $R^{116}$, $R^{117}$, $R^{118}$, $R^{119}$, $R^{120}$, $R^{121}$, $R^{122}$, $R^{123}$, $R^{124}$, $R^{125}$, $R^{126}$, $R^{127}$, $R^{128}$, $R^{129}$, $R^{130}$, and $R^{131}$ each independently represent one selected from a hydrogen atom, an aliphatic group, and an aromatic group; A represents one selected from —$NR^4R^5$ and a hydroxy group, $R^4$ and $R^5$ each independently representing one selected from a hydrogen atom, an aliphatic group, an aromatic group and a heterocyclic group; $B^1$ represents one selected from $=C(R^6)-$ and $=N-$; $B^2$ represents one selected from $-C(R^7)=$ and $-N=$; $R^2$, $R^3$, $R^6$ and $R^7$ each independently representing one selected from a hydrogen atom, a halogen atom, an aliphatic group, an aromatic group, a heterocyclic group, cyano, $-OR^{51}$, $-SR^{52}$, $-CO_2R^{53}$, $-OCOR^{54}$, $-NR^{55}R^{56}$, $-CONR^{57}R^{58}$, $-SO_2R^{59}$, $-SO_2NR^{60}R^{61}$, $-NR^{62}CONR^{63}R^{64}$, $-NR^{65}CO_2R^{66}$, $-COR^{67}$, $-NR^{68}COR^{69}$ and $-NR^{70}SO_2NR^{71}$, and $R^{51}$, $R^{52}$, $R^{53}$, $R^{54}$, $R^{55}$, $R^{56}$, $R^{57}$, $R^{58}$, $R^{59}$, $R^{60}$, $R^{61}$, $R^{62}$, $R^{63}$, $R^{64}$, $R^{65}$, $R^{66}$, $R^{67}$, $R^{68}$, $R^{69}$, $R^{70}$ and $R^{71}$ each independently represent one selected from a hydrogen atom, an aliphatic group and an aromatic group; and at least one of Z, $R^2$, $R^3$, $R^9$, $B^1$, $B^2$ and A contains a water-soluble group.

2. The photothermographic material according to claim 1, wherein the image forming layer contains the water-soluble magenta dye.

3. The photothermographic material according to claim 1, wherein the non-photosensitive layer contains the water-soluble magenta dye.

4. The photothermographic material according to claim 3, wherein the non-photosensitive layer is a back layer.

5. The photothermographic material according to claim 3, wherein the non-photosensitive layer is provided between the support and the image forming layer.

6. The photothermographic material according to claim 3, wherein the non-photosensitive layer is provided above the image forming layer with respect to the support.

7. The photothermographic material according to claim 6, wherein an outermost layer is provided above the image forming layer with respect to the support, and the non-photosensitive layer is provided between the outermost layer and the image forming layer.

8. The photothermographic material according to claim 1, wherein the image forming layer is provided on one side of a support and a back layer that contains a bleaching dye is provided on the other side.

9. The photothermographic material according to claim 8, wherein the back layer contains a base precursor.

10. The photothermographic material according to claim 1, wherein a hue angle of the water-soluble magenta dye is 280° to 360° or 0° to 60°.

11. The photothermographic material according to claim 10, wherein the hue angle is 280° to 360°.

12. The photothermographic material according to claim 11, wherein the hue angle is 290° to 340°.

13. The photothermographic material according to claim 1, wherein the water-soluble magenta dye comprises as a water-soluble group at least one substituent selected from the group consisting of a carboxyl group, a sulfo group, a phosphate group, a group having a quaternary salt structure of nitrogen, and a group having an ethyleneoxy group as a repeating unit.

14. An image forming method comprising:

exposing imagewise a photothermographic material which has, on at least one side of a support, an image forming layer comprising at least a photosensitive silver halide, a non-photosensitive organic silver salt, and a reducing agent for the organic silver salt, and at least one non-photosensitive layer, and which contains a water-soluble magenta dye having a hue angle of 280° to 360° or 0° to 60°; the water-soluble magenta dye being represented by the following Formula (III):

Formula (III)

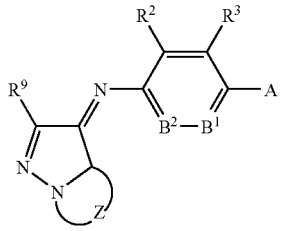

wherein in Formula (III), $R^9$ represents one selected from, a hydrogen atom, an aliphatic group, an aromatic group, a heterocyclic group, cyano, $-OR^{11}$, $-SR^{12}$, $-CO_2R^{13}$, $-OCOR^{14}$, $-NR^{15}R^{16}$, $-CONR^{17}R^{18}$, $-SO_2R^{19}$, $-SO_2NR^{20}R^{21}$, $-NR^{22}CONR^{23}R^{24}$, $-NR^{25}CO_2R^{26}$, $-COR^{27}$, $-NR^{28}COR^{29}$, and $-NR^{30}SO_2NR^{31}$, and $R^{11}$, $R^{12}$, $R^{13}$, $R^{14}$, $R^{15}$, $R^{16}$, $R^{17}$, $R^{18}$, $R^{19}$, $R^{20}$, $R^{21}$, $R^{22}$, $R^{23}$, $R^{24}$, $R^{25}$, $R^{26}$, $R^{27}$, $R^{28}$, $R^{29}$, $R^{30}$ and $R^{31}$ each independently represent one selected from a hydrogen atom, an aliphatic group, and an aromatic group; Z represents a group of atoms forming a 5 or 6-membered nitrogen-containing heterocycle, which may be substituted by at least one of an aliphatic group, an aromatic group, a heterocyclic group, cyano, $-OR^{111}$, $-SR^{112}$, $-CO_2R^{113}$, $-OCOR^{114}$, $-NR^{115}R^{116}$, $-CONR^{117}R^{118}$, $-SO_2R^{119}$, $-SO_2NR^{120}R^{121}$, $-NR^{122}CONR^{123}R^{124}$, $-NR^{125}CO_2R^{126}$, $-COR^{127}$, $-NR^{128}COR^{129}$, and $-NR^{130}SO_2NR^{131}$, and this heterocycle may further form a condensed ring with another ring; $R^{111}$, $R^{112}$, $R^{113}$, $R^{114}$, $R^{115}$, $R^{116}$, $R^{117}$, $R^{118}$, $R^{119}$, $R^{120}$, $R^{121}$, $R^{122}$, $R^{123}$, $R^{124}$, $R^{125}$, $R^{126}$, $R^{127}$, $R^{128}$, $R^{129}$, $R^{130}$, and $R^{131}$ each independently represent one selected from a hydrogen atom, an aliphatic group, and an aromatic group; A represents one selected from $-NR^4R^5$ and a hydroxy group, $R^4$ and $R^5$ each independently representing one selected from a hydrogen atom, an aliphatic group, an aromatic group and a heterocyclic group: $B^1$ represents one selected from $=C(R^6)-$ and $=N-$: $B^2$ represents one selected from $-C(R^7)=$ and $-N=$; $R^2$, $R^3$, $R^6$ and $R^7$ each independently representing one selected from a hydrogen atom, a haloaen atom, an aliphatic group, an aromatic group, a heterocyclic group, cyano, $-OR^{51}$, $-SR^{52}$, $-CO_2R^{53}$, $-OCOR^{54}$, $-NR^{55}R^{56}$, $-CONR^{57}R^{58}$, $-SO_2R^{59}$, $-SO_2NR^{60}R^{61}$, $-NR^{62}CONR^{63}R^{64}$, $-NR^{65}CO_2R^{66}$, $-COR^{67}$, $-NR^{68}COR^{69}$ and $-NR^{70}SO_2NR^{71}$, and $R^{51}$, $R^{52}$, $R^{53}$, $R^{54}$, $R^{55}$, $R^{56}$, $R^{57}$, $R^{58}$, $R^{59}$, $R^{60}$, $R^{61}$, $R^{62}$, $R^{63}$, $R^{64}$, $R^{65}$, $R^{66}$, R67, $R^{68}$, $R^{69}$, $R^{70}$ and $R^{71}$ each independently represent one selected from a hydrogen atom, an aliphatic group and an aromatic group; and at least one of Z, $R^2$, $R^3$, $R^9$, $B^1$, $B^2$ and A contains a water-soluble group;

and thermally developing the photothermographic material by heating for a period of from 1 second to 14 seconds.

15. A photothermographic material comprising, on at least one side of a support, an image forming layer comprising at least a photosensitive silver halide, a non-photosensitive organic silver salt, and a reducing agent for the organic silver salt, and at least one non-photosensitive layer, wherein the photothermographic material contains a water-soluble magenta dye represented by the following Formula (IV):

Formula (IV)

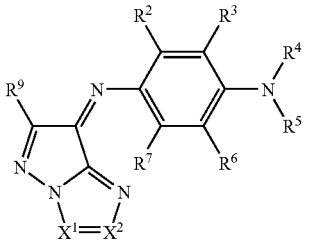

wherein in Formula (IV), $R^2$, $R^3$, $R^6$ and $R^7$ each independently representing one selected from a hydrogen atom, a halogen atom, an aliphatic group, an aromatic group, a heterocyclic group, cyano, —$OR^{51}$, —$SR^{52}$, —$CO_2R^{53}$, —$OCOR^{54}$, —$NR^{55}R^{56}$, —$CONR^{57}R^{58}$, —$SO_2R^{59}$, —$SO_2NR^{60}R^{61}$, —$NR^{62}CONR^{63}R^{64}$, —$NR^{65}CO_2R^{66}$, —$COR^{67}$, —$NR^{68}COR^{69}$ and —$NR^{70}SO_2NR^{71}$, and $R^{51}$, $R^{52}$, $R^{53}$, $R^{54}$, $R^{55}$, $R^{56}$, $R^{57}$, $R^{58}$, $R^{59}$, $R^{60}$, $R^{61}$, $R^{62}$, $R^{63}$, $R^{64}$, $R^{65}$, $R^{66}$, $R^{67}$, $R^{68}$, $R^{69}$, $R^{70}$ and $R^{71}$ each independently represent one selected from a hydrogen atom, an aliphatic group and an aromatic group; $R^4$ and $R^5$ each independently representing one selected from a hydrogen atom, an aliphatic group, an aromatic group and a heterocyclic group; $R^9$ has the same meaning as defined in Formula (III); $X^1$ and $X^2$ each independently represent one selected from —$C(R^{10})$= and —N=; $R^{10}$ represents one selected from a hydrogen atom, an aliphatic group, and an aromatic group; one of $X^1$ and $X^2$ is —N=, $X^1$ and $X^2$ not being —N= at the same time; at least one of $R^2$, $R^3$, $R^4$, $R^5$, $R^6$, $R^7$, $R^9$, $X^1$, and $X^2$ contains a water-soluble group.

16. The photothermographic material according to claim 15, wherein the image forming layer contains the water-soluble magenta dye.

17. The photothermographic material according to claim 15, wherein the non-photosensitive layer contains the water-soluble magenta dye.

18. The photothermographic material according to claim 17, wherein the non-photosensitive layer is a back layer.

19. The photothermographic material according to claim 17, wherein the non-photosensitive layer is provided between the support and the image forming layer.

20. The photothermographic material according to claim 17, wherein the non-photosensitive layer is provided above the image forming layer with respect to the support.

21. The photothermographic material according to claim 20, wherein an outermost layer is provided above the image forming layer with respect to the support, and the non-photosensitive layer is provided between the outermost layer and the image forming layer.

22. The photothermographic material according to claim 15, wherein the image forming layer is provided on one side of a support and a back layer that contains a bleaching dye is provided on the other side.

23. The photothermographic material according to claim 22, wherein the back layer contains a base precursor.

24. The photothermographic material according to claim 15, wherein a hue angle of the water-soluble magenta dye is 280° to 360° or 0° to 60°.

25. The photothermographic material according to claim 24, wherein the hue angle is 280° to 360°.

26. The photothermographic material according to claim 25, wherein the hue angle is 290° to 340°.

27. The photothermographic material according to claim 15, wherein the water-soluble magenta dye comprises as a water-soluble group at least one substituent selected from the group consisting of a carboxyl group, a sulfo group, a phosphate group, a group having a quaternary salt structure of nitrogen, and a group having an ethyleneoxy group as a repeating unit.

28. An image forming method comprising:

exposing imagewise a photothermographic material which has, on at least one side of a support, an image forming layer comprising at least a photosensitive silver halide, a non-photosensitive organic silver salt, and a reducing agent for the organic silver salt, and at least one non-photosensitive layer, and which contains a water-soluble magenta dye having a hue angle of 280° to 360° or 0° to 60°; the water-soluble magenta dye being represented by the following Formula (IV):

Formula (IV)

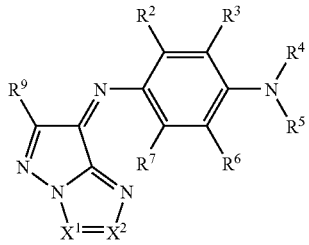

wherein in Formula (IV), $R^2$, $R^3$, $R^6$ and $R^7$ each independently representing one selected from a hydrogen atom, a halogen atom, an aliphatic group, an aromatic group, a heterocyclic group, cyano, —$OR^{51}$, —$SR^{52}$, —$CO_2R^{53}$, —$OCOR^{54}$, —$NR^{55}R^{56}$, —$CONR^{57}R^{58}$, —$SO_2R_{59}$, —$SO_2NR^{60}R^{61}$, —$NR^{62}CONR^{63}R^{64}$, —$NR^{65}CO_2R^{66}$, —$COR^{67}$, —$NR^{68}COR^{69}$ and —$NR^{70}SO_2NR^{71}$, and $R^{51}$, $R^{52}$, $R^{53}$, $R^{54}$, $R^{55}$, $R^{56}$, $R^{57}$, $R^{58}$, $R^{59}$, $R^{60}$, $R^{61}$, $R^{62}$, $R^{63}$, $R^{64}$, $R^{65}$, $R^{66}$, $R^{67}$, $R^{68}$, $R^{69}$, $R^{70}$ and $R^{71}$ each independently represent one selected from a hydrogen atom, an aliphatic group and an aromatic group; $R^4$ and $R^5$ each independently representing one selected from a hydrogen atom, an aliphatic group, an aromatic group and a heterocyclic group; $R^9$ has the same meaning as defined in Formula (III); $X^1$ and $X^2$ each independently represent one selected from —$C(R^{10})$= and —N=; $R^{10}$ represents one selected from a hydrogen atom, an aliphatic group, and an aromatic group; one of $X^1$ and $X^2$ is —N=, $X^1$ and $X^2$ not being —N= at the same time; at least one of $R^2$, $R^3$, $R^4$, $R^5$, $R^6$, $R^7$, $R^9$, $X^1$, and $X^2$ contains a water-soluble group;

and thermally developing the photothermographic material by heating for a period of from 1 second to 14 seconds.

* * * * *